US011737537B2

(12) United States Patent
Selhi et al.

(10) Patent No.: US 11,737,537 B2
(45) Date of Patent: Aug. 29, 2023

(54) GARMENT HANGER MECHANISM AND SYSTEM FOR TRAVEL BAGS AND LUGGAGE

(71) Applicant: RUEBEL LIMITED, Brighton (CA)

(72) Inventors: Spencer Vikram Selhi, Brighton (CA); Christopher Lyle Edwards, Ottawa (CA); James Patrick Henderson, Gatineau (CA)

(73) Assignee: Ruebel Limited, Brighton (CA)

( * ) Notice: Subject to any disclaimer, the term of this patent is extended or adjusted under 35 U.S.C. 154(b) by 508 days.

(21) Appl. No.: 16/700,287

(22) Filed: Dec. 2, 2019

(65) Prior Publication Data

US 2020/0170367 A1 Jun. 4, 2020

Related U.S. Application Data

(63) Continuation-in-part of application No. PCT/CA2018/050665, filed on Jun. 4, 2018.
(Continued)

(51) Int. Cl.
*A45C 13/03* (2006.01)
*A45C 3/00* (2006.01)
*A45C 5/03* (2006.01)

(52) U.S. Cl.
CPC ..... *A45C 13/03* (2013.01); *A45C 3/004* (2013.01); *A45C 5/03* (2013.01)

(58) Field of Classification Search
CPC ..... A45C 13/03; A45C 3/004; A45C 5/03
See application file for complete search history.

(56) References Cited

U.S. PATENT DOCUMENTS 1,340,565 A * 5/1920 Seidenburg ..... A47B 61/06 312/200
1,894,485 A 1/1933 Jacques
(Continued)

FOREIGN PATENT DOCUMENTS

EP 0872200 B1 1/2004
WO 2016139346 A1 9/2016

OTHER PUBLICATIONS

Black Magic Hanger Holder (Set of 10), www.organizeit.com, Dec. 5, 2019.

(Continued)

*Primary Examiner* — Tri M Mai
(74) *Attorney, Agent, or Firm* — Widerman Malek, PL; Daniel C. Pierron

(57) ABSTRACT

A garment hanger mechanism and system are provided for a multi-panel, foldable travel bag. The mechanism comprises a garment hanger member with spaced recesses for receiving clothes hangers. The member is attached to or integrated with a panel of the travel bag, and resides on the inside of the bag when folded. A removable securing means ensures hangers remain within the member recesses during travel. By using hanging means for both the bag and mechanism when the travel bag is unfolded, hanging garments can be efficiently unpacked and accessed from the travel bag without removing hangers from the member recesses. In this manner, the travel bag may be converted into a temporary travel closet within an existing closet. The bag can also be hung using just the bag hanging means from a door or in a closet.

16 Claims, 112 Drawing Sheets

Related U.S. Application Data

(60) Provisional application No. 62/514,064, filed on Jun. 2, 2017.

(56) References Cited

U.S. PATENT DOCUMENTS

| | | | | |
|---|---|---|---|---|
| 2,016,520 | A | 10/1935 | Short | |
| 2,185,688 | A * | 1/1940 | Hargis | A47G 25/54 206/285 |
| 2,206,564 | A | 7/1940 | Hallman | |
| 2,264,552 | A | 12/1941 | Ritter | |
| 2,285,745 | A | 6/1942 | Ritter | |
| 2,316,717 | A | 4/1943 | Ries | |
| 2,317,083 | A | 4/1943 | Plotkin | |
| 2,341,104 | A | 2/1944 | Kleber | |
| 2,453,663 | A | 11/1948 | James | |
| 3,035,673 | A | 5/1962 | Schenkler | |
| 3,228,738 | A | 1/1966 | Sol | |
| 3,869,034 | A | 3/1975 | Thornton | |
| 4,158,406 | A | 6/1979 | Feder | |
| 4,252,220 | A * | 2/1981 | London | A45C 3/004 206/285 |
| 4,613,039 | A | 9/1986 | Shaw et al. | |
| 4,693,368 | A | 9/1987 | King et al. | |
| 4,753,342 | A | 6/1988 | Pulichino et al. | |
| 4,801,010 | A | 1/1989 | Levitas | |
| 4,811,853 | A * | 3/1989 | Mead | B65D 85/185 211/124 |
| 4,854,431 | A | 8/1989 | Pulichino et al. | |
| 4,887,700 | A | 12/1989 | Rice | |
| 4,953,717 | A | 9/1990 | Rosch | |
| 5,113,982 | A | 5/1992 | Pulichino et al. | |
| 5,139,298 | A * | 8/1992 | Dowell | A47G 25/145 294/165 |
| 5,180,057 | A | 1/1993 | Franklin | |
| 5,531,335 | A * | 7/1996 | Chen | A45C 13/03 211/124 |
| 5,547,052 | A | 8/1996 | Latshaw | |
| 5,566,797 | A | 10/1996 | Himbeeck | |
| 6,076,666 | A * | 6/2000 | Santa-Maria | A45C 5/14 206/290 |
| 6,276,501 | B1 | 8/2001 | Tong | |
| 7,140,479 | B2 | 11/2006 | Mangano et al. | |
| 7,861,857 | B2 | 1/2011 | Vorderkunz | |
| 7,886,918 | B1 * | 2/2011 | Sauer | B60P 3/36 211/99 |
| 8,141,722 | B2 | 3/2012 | Heroux | |
| 2002/0113186 | A1 | 8/2002 | Sher | |
| 2002/0139627 | A1 | 10/2002 | Mahanavanont | |
| 2005/0103655 | A1 | 5/2005 | Cohen | |
| 2005/0109721 | A1 | 5/2005 | Schneider et al. | |
| 2013/0233660 | A1 | 9/2013 | Bettua et al. | |
| 2015/0053520 | A1 | 2/2015 | Findlay | |

OTHER PUBLICATIONS

Transcend 200 22" Carry-On Exp Upright, Briggs & Riley, www.ebags.com, Dec. 5, 2019.
Luggage Deluxe Wheeled Garment Bag, Briggs & Riley, www.amazon.com, Dec. 5, 2019.
Stainless-Steel Hook & Hanger, Lee Valey, Dec. 5, 2019.
House Day Black Magic Hangers Space Saving Clothes Hangers Organizers Smart Closet Space Saver Pack of 10 with Sturdy Plastic for Heavy Clothes, House Day, www.amazon.com, Dec. 5, 2019.
Over the Door Wonder Hanger—Single (Platinum Edition), www.amazon.com, Dec. 5, 2019.
RueBel Carry-On, Ruebel Limited, www.kickstarter.com, Dec. 9, 2019.
Insignis Wheeled Garment Bag, Samsonite, www.samsonite.com, Dec. 5, 2019.
Wingman Bicycle Garment Bag, Henty Designs (Australia), www.cyclestyle.com, Dec. 5, 2019.
Vocier Zero Crease, Vocier, www.vocier.com, Dec. 5, 2019.
Von der Formel 1 inspiriert: Anzuge endlich knitterfrei transportieren, Dec. 5, 2019.
Wonder Hanger Max, New & Improved, Pack of 6-3x The Closet Space for Easy, Effortless, Wrinkle-Free Clothes, White, Wonder Hanger, www.amazon.com, Dec. 5, 2019.
Alpha Tri-Fold Carry-On Garment Bag, Tumi, www.ebags.com, Dec. 9, 2019.
Wingman Backpack, Henty, www.henty.cc, Dec. 11, 2019.
London' Garment Bag, Lexdray, www.nordstrom.com, Dec. 11, 2019.
Quadrion Trifold Garment Bag, Black (66594-1041), Samsonite, www.staples.com, Dec. 11, 2019.
Rolo II, Rolo, www.rolotravel.com, Dec. 11, 2019.
Stow-N-Go Portable Luggage System Suitcase Organizer—Small, Packable Hanging Travel Shelves & Packing Cube Organizer, Grand Fusion Housewares, www.amazon.com, Dec. 11, 2019.
Weekender, Duffle Bag, Rise Gear, www.risegear.com, Dec. 11, 2019.

* cited by examiner 2
106
14
3
98

GARMENT HANGER MECHANISM AND SYSTEM FOR TRAVEL BAGS AND LUGGAGE

RELATED APPLICATIONS

This application is a bypass continuation-in-part application of and claims priority under 35 U.S.C. § 120 of PCT Application Serial No. PCT/CA2018/050665 filed on Jun. 4, 2018 and titled GARMENT HANGER MECHANISM AND SYSTEM FOR TRAVEL BAGS AND LUGGAGE, which in turn claims priority under 35 U.S.C. § 119(e) of U.S. Provisional Patent Application Ser. No. 62/514,064 filed on Jun. 2, 2017 and titled Garment hanger mechanism and system for travel bags and luggage. The contents of these applications are incorporated herein by reference.

FIELD OF THE INVENTION

The present invention relates to the field of garment hanger mechanisms and systems in luggage and travel bags.

BACKGROUND OF THE INVENTION

The background to the invention provides information about the state of the art relating to luggage and travel bags incorporating means for efficiently packing and unpacking clothing, other apparel and items.

Contemporary trends in air travel are to minimize the amount of luggage for cost and time saving reasons, and there is the preference of many travellers to use a travel bag, otherwise known as a flight or carry-on bag. This preference has increased demand for travel bags with versatile and diverse functionalities that can accommodate a multitude of apparel items, toiletries and other accessories. Travel bag construction must be light and small enough to help travellers pack varied amounts and arrays of personal items and still meet airline carry-on specifications for packed bag dimensions and weight.

Luggage cases and travel bags which accommodate garments on clothes hangers, as well as folded apparel and accessories are known in the art. Some of these cases and bags can be opened or unfolded and hung in a closet or on a door to gain access to the garments on hangers and other packed items. One of the more tedious aspects of using such luggage systems, however, relates to the condition of clothing after being packed for travel and the time needed to unpack and care for apparel to make it wearable again. Compressed hanging garments may need to be removed from the luggage system, and hung in a closet in order to minimize further bunching, wrinkling and provide easy access to individual garments.

U.S. Pat. No. 3,869,034 discloses a luggage case with a first hook on the top face of the case, which can be used to hang the case from a closet rod. Inside the case there is a hanging garment compartment, which includes an extendable bar attached to an internal compartment partition for hanging clothes. A clip is provided for keeping clothes hangers compressed together without separation along a relatively short length of the extendable bar when in a packed state. A second hook can be attached to the extendable end of the bar and used to hang the bar from the closet rod, so that clothes hangers can be spread out along the bar when hanging in a closet in an unpacked state.

U.S. Pat. No. 5,566,797 discloses a multi-panel foldable travel bag with a hook attached to the panel at one end of the travel bag so that the bag can be hung when unfolded. A garment hook mechanism is attached in the interior cavity midway between the two ends of the travel bag for receiving clothes hangers. The garment hook mechanism does not provide any means to separate the clothes hangers while hanging from the mechanism. This can result in unnecessary wrinkling and bunching of garments, as well as the possibility that hangers will slip out of or off of the garment hook mechanism during travel. When unpacking the travel bag the hangers must be removed from the garment hook mechanism and hung directly in a closet in order to be separated for ease of care and access to apparel.

U.S. Pat. No. 6,276,501 provides an alternative configuration of a multi-panel foldable travel bag with a hook to hang the travel bag from a door or in a closet and a hanger fastener to receive and secure a clothes hanger. The fastener has a limited capacity and to the extent that more than one clothes hanger may be received at the fastener, the hangers must be removed for ease of care and access to apparel.

U.S. Pat. No. 5,180,057 discloses a garment bag with a telescoping rod coupled to cupped cover and handle mechanism that can be turned about the rod to cover and secure the hook portion of hangers on the rod. The rod, however, does not have any means for spacing the hangers in their stowed position and neither does the mechanism collapse to allow for the most efficient use of space in a travel bag for packing multiple garments.

U.S. Pat. No. 4,753,342 discloses a garment bag with a hanger bracket that has two members with opposing, aligned projections and recesses forming a channel and pockets for receiving hanger hooks. A latch is provided at the entry point of the channel for inserting the hanger hooks, which opens and closes as needed for the insertion, removal and securing of hangers within the bracket. The channel spacing is such that the projections must flex slightly for the hanger hooks to pass by them and into an available channel pocket.

US Patent Application Publication No. 2015/0053520 discloses a portable closet system for transporting clothing, with two or more framed cavities which can be folded and unfolded supported by a framed and wheeled base. Clothing can be stored without being removed from hangers within a hanger holder designed to keep the hangers secured during transport. Given the stand-alone configuration of the portable closet, the hanger holder is a permanent fixture within a compartment of the portable closet system. The hooks of the hangers that can be used with it have been adapted to a non-standard format to fit into a narrow channel with a flat inner surface, instead of having rounded hooks typical of hangers configured for closet rods.

Other types of space saving and organizational devices for hanging clothing have been developed for closets, or as make-shift hanger racks on a door (e.g. US Patent Application Publication No. 2005/0109721, U.S. Pat. Nos. 4,953,717, 8,141,722). Such devices, however, have not generally been adapted for use in luggage cases and travel bags.

The diversification of traveller preferences and deficiencies in the art relating to the storage of hanging clothing and other articles in foldable travel bags signal a need for new or improved organizational functionalities to ameliorate the tendency for packed hanging apparel to bunch and wrinkle, as well as make individual garments and other apparel easier to pack and unpack and to access.

SUMMARY OF THE INVENTION

The present invention relates generally to multi-functional travel bag systems which incorporate mechanisms for packing, unpacking and organizing hanging apparel. It is an object of the present disclosure to provide a garment hanger mechanism and system which can be integrated into a travel bag so that the bag can function as a travel closet for packing, unpacking and organizing apparel and other items.

According to one aspect there is provided a garment hanger mechanism for a multi-panel, foldable travel bag with first and second ends when unfolded and a substantially prismatic form when folded, the mechanism comprising:

a garment hanger member comprising two ends, two side surfaces, a top surface, a bottom surface, and a member portion with one or more recesses along its length for receiving clothes hangers, said garment hanger member being attachable to a panel proximal to the first end of the travel bag;

a securing means configured to engage and disengage with the member portion, and create an impediment over one or more recesses of the member portion when engaged; and a mechanism hanging means operatively associated with the garment hanger member to hang the garment hanger member in a closet.

According to another aspect there is provided a garment hanger system for a multi-panel, foldable travel bag with first and second ends when unfolded and a substantially prismatic form when folded, the system comprising:

a first bag hanging means, attachable to a panel proximal to the first end of the travel bag;

a garment hanger member comprising two ends, two side surfaces, a top surface, a bottom surface, and a member portion with one or more recesses along its length for receiving clothes hangers, said garment hanger member being attachable to a panel proximal to the first end of the travel bag;

a securing means configured to engage and disengage with the member portion, and create an impediment over one or more recesses of the member portion when engaged; and a mechanism hanging means operatively associated with the garment hanger member to hang the garment hanger member in a closet, wherein when the travel bag is unfolded, the first bag and mechanism hanging means can be used to hang the travel bag and garment hanger member, respectively.

A multi-panel, foldable travel bag with first and second ends when unfolded and a substantially prismatic form when folded, comprising:

a garment hanger system, comprising:

a first bag hanging means, attachable to a panel proximal to the first end of the travel bag;

a garment hanger member comprising two ends, two side surfaces, a top surface, and a bottom surface, and a member portion with one or more recesses along its length for receiving clothes hangers, said garment hanger member being attachable to a panel proximal to the first end of the travel bag;

a securing means configured to engage and disengage with the member portion, and create an impediment over one or more recesses of the member portion when engaged; and a mechanism hanging means operatively associated with the garment hanger member to hang the garment hanger member in a closet, wherein when the travel bag is unfolded, the first bag and mechanism hanging means can be used to hang the travel bag and garment hanger member, respectively.

According to yet a further aspect there is provided a method of constructing a multi-panel, foldable travel bag with first and second ends when unfolded and a substantially prismatic form when folded, for securely packing and unpacking clothes hangers with apparel, comprising the step of integrating a garment hanger system therein, said garment hanger system comprising:

a first bag hanging means, attached to a panel proximal to the first end of the travel bag;

a garment hanger member comprising two ends, two side surfaces, a top surface, and a bottom surface, and a member portion with one or more recesses along its length for receiving clothes hangers, said garment hanger member being attachable to a panel proximal to the first end of the travel bag;

a securing means configured to engage and disengage with the member portion, and create an impediment over one or more recesses of the member portion when engaged; and a mechanism hanging means operatively associated with the garment hanger member to hang the garment hanger member in a closet, wherein when the travel bag is unfolded, the first bag and mechanism hanging means can be used to hang the travel bag and garment hanger member, respectively.

In various embodiments, the garment hanger mechanism comprises a support arm which functions as a securing means for garment hangers with hanging apparel in a travel bag. In one embodiment, the garment hanger member of the mechanism may be configured as a slider system comprising a support arm slider rail connected to a hanger slider. In other words, the securing means may be a support arm slider rail and the member portion may be a hanger slider.

In other embodiments of the garment hanger mechanism and system, the top or one end of the garment hanger member is attached to a substantially rigid or semi-rigid structure integrated with the panel proximal to the first end of the travel bag. In related embodiments, the first bag hanging means and the garment hanger member are attached to the same panel proximal to the first end of the travel bag. In another embodiment the first bag hanging means and the garment hanger member are attached to distinct panels proximal to the first end of the travel bag.

In a further embodiment, the garment hanger member is articulable about an end attached to a panel proximal to the first end of the travel bag from a packed position to an unpacked position.

In yet another embodiment the mechanism hanging means is an articulable hook.

In still other embodiments, a travel bag incorporating a garment hanger system of the present disclosure further comprises a second bag hanging means attachable proximal to the second end of the travel bag, wherein when the first and second bag hanging means are used to hang the travel bag, a shelf is formed with a panel in between the first and second ends of the travel bag.

In one embodiment the travel bag comprises four sides connected in series and foldable to form a back side, front side and two side panels of the travel bag when folded; and two substantially rigid panels attached to opposing free ends of the back side to form the top and bottom sides of the travel bag when folded.

BRIEF DESCRIPTION OF THE DRAWINGS

These and other features of the invention will become more apparent in the following detailed description in which reference is made to the appended drawings (Figures), briefly described as follows:

FIG. 109: A side/isometric (top) view of an embodiment of the garment hanger mechanism/system according to the present disclosure configured as a slider system with a trough shaped member portion (open) viewed from the back end, with a single recess for receiving hangers.

DETAILED DESCRIPTION OF THE INVENTION

Figure 1D:
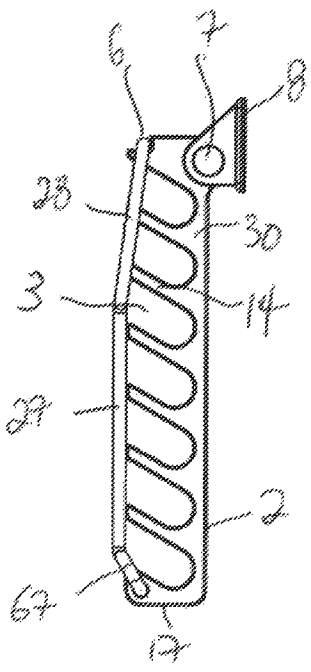
FIG. 1A-1D: Various views of an embodiment of a garment hanger mechanism according to the present disclosure in a collapsed state where A=isometric, B=top, C=front and D=side views of the garment hanger mechanism.
Figure 1B:
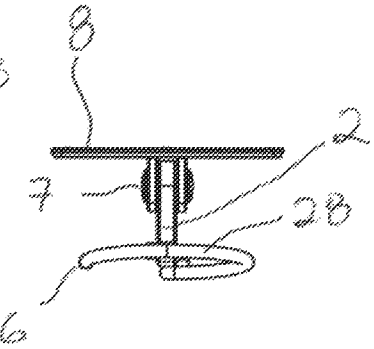
Figure 1C:
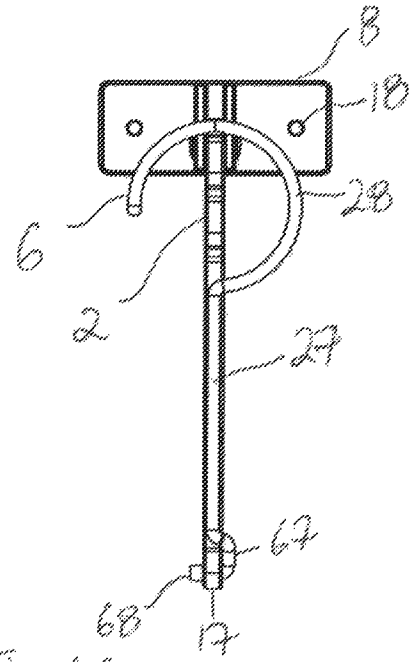
Figure 1A:
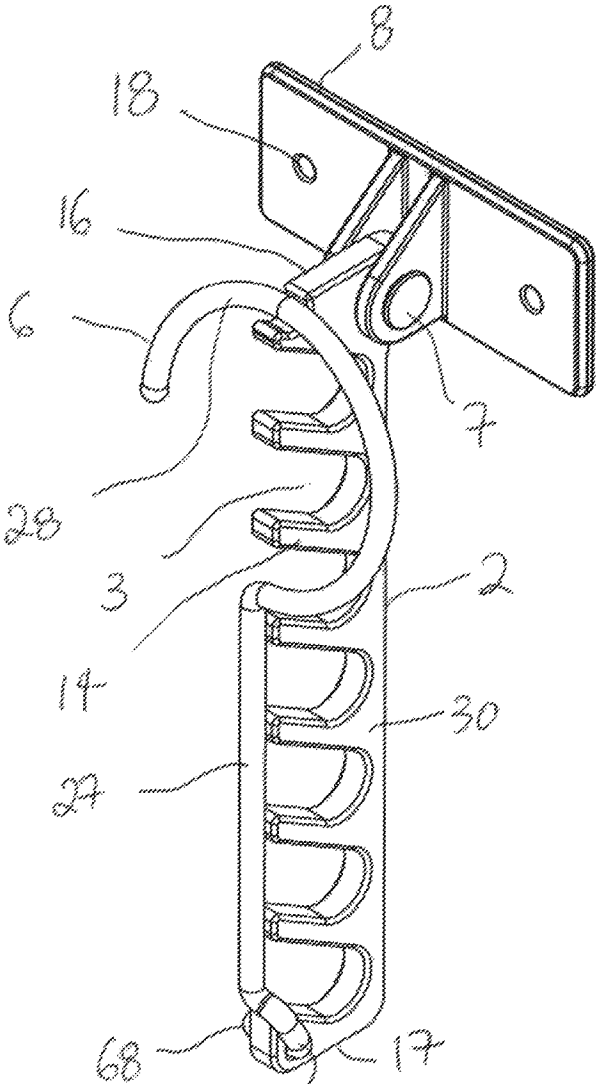
Figure 2:
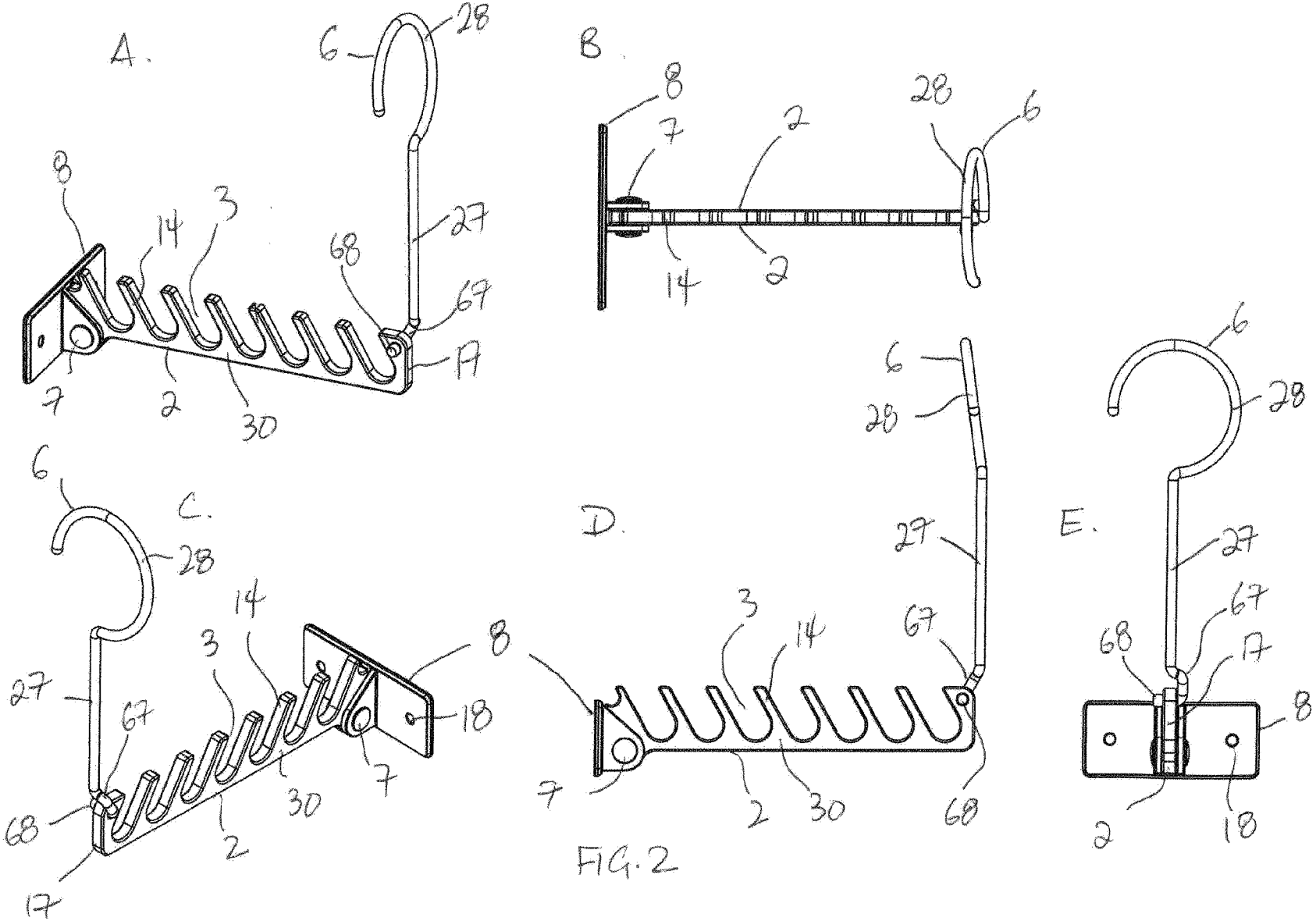
FIG. 2A-2E: Various views of an embodiment of a garment hanger mechanism according to the present disclosure in an expanded state where A=left isometric, B=top, C=right isometric, D=side and E=front views of the garment hanger mechanism.

The present invention disclosure provides a garment hanger mechanism and system for transforming a travel bag to a travel closet for packing, unpacking and organizing apparel and other items.

Definitions

Various features of the invention will become apparent from the following detailed description taken together with the illustrations in the Figures. The design factors, construction and use of the buoyant recreational articles disclosed herein are described with reference to various examples representing embodiments which are not intended to limit the scope of the invention as described and claimed herein. The skilled technician in the field to which the invention pertains will appreciate that there may be other variations, examples and embodiments of the invention not disclosed herein that may be practiced according to the teachings of the present disclosure without departing from the scope and spirit of the invention.

Unless defined otherwise, all technical and scientific terms used herein have the same meaning as commonly understood by one of ordinary skill in the art to which this invention belongs.

The use of the word "a" or "an" when used herein in conjunction with the term "comprising" may mean "one," but it is also consistent with the meaning of "one or more," "at least one" and "one or more than one."

As used herein, the terms "comprising," "having," "including" and "containing," and grammatical variations thereof, are inclusive or open-ended and do not exclude additional, un-recited elements and/or method steps. The term "consisting essentially of" when used herein in connection with a composition, use or method, denotes that additional elements and/or method steps may be present, but that these additions do not materially affect the manner in which the recited composition, method or use functions. The term "consisting of" when used herein in connection with a composition, use or method, excludes the presence of additional elements and/or method steps. A composition, use or method described herein as comprising certain elements and/or steps may also, in certain embodiments consist essentially of those elements and/or steps, and in other embodiments consist of those elements and/or steps, whether or not these embodiments are specifically referred to.

As used herein, the term "about" refers to an approximately +/−10% variation from a given value. It is to be understood that such a variation is always included in any given value provided herein, whether or not it is specifically referred to.

The recitation of ranges herein is intended to convey both the ranges and individual values falling within the ranges, to the same place value as the numerals used to denote the range, unless otherwise indicated herein.

The use of any and examples or exemplary language, e.g. "such as", "exemplary embodiment", and "for example" is intended to illustrate or denote aspects, embodiments, variations, elements or features of the invention and not intended to limit the scope of the invention.

As used herein, the terms "connect", "connecting", "connectable" and "connected" refer to any direct, indirect, permanent or impermanent physical association between elements or entities. Accordingly, these terms may be understood to denote elements or entities that are partly or completely contained within one another, attached, coupled, disposed on, abutting, fixed, fastened, mounted, joined together, interlocked, sandwiched, engaged, etc., and even if there are other elements or entities intervening between the elements or entities described as being connected.

For example, the garment hanger member of the present disclosure may be bolted or riveted to, or screwed into a surface of a board integrated into a panel of a travel bag through the fabric of the panel enveloping the board. Alternatively, the garment hanger member may be connected to a support structure, such as a support arm, which is bolted, or riveted to, or screwed into a surface of a board integrated into a panel of a travel bag through the fabric of a panel enveloping the board. In another instance, the garment hanger member by be connected to other support or mounting structures through a panel of a travel bag, effectively sandwiching the panel of the bag in between the garment hanger member and other structure. In each of the instances the elements are connected to construct an integrated assembly comprising the garment hanger member, panel of the travel bag and any other supporting or mounting structures.

Connected elements or entities may also be constructed in such a manner so as to form a continuous element or entity. For example, different fabric elements of a travel bag may be glued, sewn or fused together to form a continuous panel fabric. Similarly, when two or more elements or entities are operatively associated with one another using various means, said elements or entities are understood to be connected to one another. For example, different elements of the garment hanger mechanism may be operatively associated with one another using a hinge or articulating pin mechanism.

The terms "attach", "attached" and "attachable" are, respectively, used interchangeably with the terms "connect", "connected" and "connectable".

As used herein, the terms "engage" and "engaged" refer to the physical interaction of two physical elements or entities to achieve a physical result, such as the securing of clothes hangers to the garment hanger mechanism according to the present disclosure. Accordingly, the terms "disengage" and "disengaged" refer to the condition or state of two physical elements or entities, which cease to physically interact with each other.

As used herein, the terms "fabric", and "fabric-like material(s)" refer to any flexible, sheet like material that can be manipulated to create different forms and shapes of chambers suitable to construct a travel bag according to the present disclosure.

As used herein, the term "panel" is used to denote a substantially rigid, semi-rigid or flexible planar element or feature of a travel bag, including without limitation the exterior front, back, side, top and bottom walls of a travel bag and inner bag panels used to create compartments or delineate spaces within the travel bag for the placement, packing and segregation of apparel and other items from one another. Panels may be attached to one another in series or otherwise connected edge to edge, nested or layered relative to one another, as in the case of a travel bag pocket and compartment panels relative to a bag wall.

As used herein, the term "proximal" is used to denote the relative placement of a physical element or entity as close to are essentially at a given reference point, such as the two ends of an unfolded travel bag.

As used herein, the terms "secure", "secured" and "securing" refer to a physical element or entity used to maintain the placement or state of another physical element or entity (such as clothes hangers in a travel bag, or straps used to keep clothing in place), so that it cannot be removed or lost. Alternatively, these terms may also be used to denote the state of a physical element or entity that is attached to another physical element or entity in a manner so as not to be removed, give way, become loose or be lost, such as using nuts, bolts, rivets, screws and plates to attach (mount) a hook to a surface or structure.

As used herein, the terms, "substantially rigid" or "rigid" are used to denote that the shape or form of a structure cannot be readily and markedly changed, e.g. by bending, folding, molding, or otherwise. A substantially rigid structure may have some flexibility or material tolerance to be bent, deformed, etc., in response to a force applied to it while still retaining its original shape or form and in a manner which is readily recognizable to the eye.

It is contemplated that any embodiment of the garment hanger mechanism and system, methods and uses disclosed herein can be implemented by one skilled in the art, as is, or by making such variations or equivalents without departing from the scope and spirit of the invention.

While the following description and the figures detail certain embodiments to illustrate and exemplify the invention, it is to be understood that the invention is not limited by the details of the construction and specific illustration of such embodiments which follows.

Garment Hanger Mechanism

The present disclosure provides a garment hanger mechanism for efficiently packing and unpacking garments on clothes hangers in and out of a travel bag, as well as for establishing a temporary travel closet. The mechanism comprises a garment hanger member for receiving clothes hangers, a securing means for securing clothes hangers for travel and a (mechanism) hanging means for hanging the garment hanger member from a closet rod or clothes rack.

Garment Hanger Member

The garment hanger mechanism comprises a garment hanger member, which is optionally articulable about a point of attachment to a panel of the travel bag. The garment hanger member facilitates the packing and unpacking of clothing, and easy access to hung clothing by separating hangers out horizontally from an open (unfolded), vertically hung travel bag. The garment hanger member comprises a member portion with one or more spaced recesses for receiving clothes hangers and may also comprise other support structures or features to facilitate its integration into a travel bag. In one embodiment, the member portion comprises multiple, e.g. two or more, three or more, four or more, five or more, or six or more, recesses. As known in the art, for example, U.S. Pat. No. 8,141,722, the recesses may take on different outline forms suited for receiving hangers from an opening or unobstructed access point.

The member portion may be constructed by injection molding using plastics and composite materials such as glass filled reinforced nylon. Alternatively, the member portion may be constructed of metals such as steel, aluminum and other suitable metal-like materials available to one skilled in the art. Rubber-like paddings and coatings may be used to create higher friction surfaces within the recesses of the member portion, and on other surfaces of the garment hanger member where needed, to reduce the possibility of clothes hangers slipping off of, or out of the recesses of the member portion.

Figure 59:
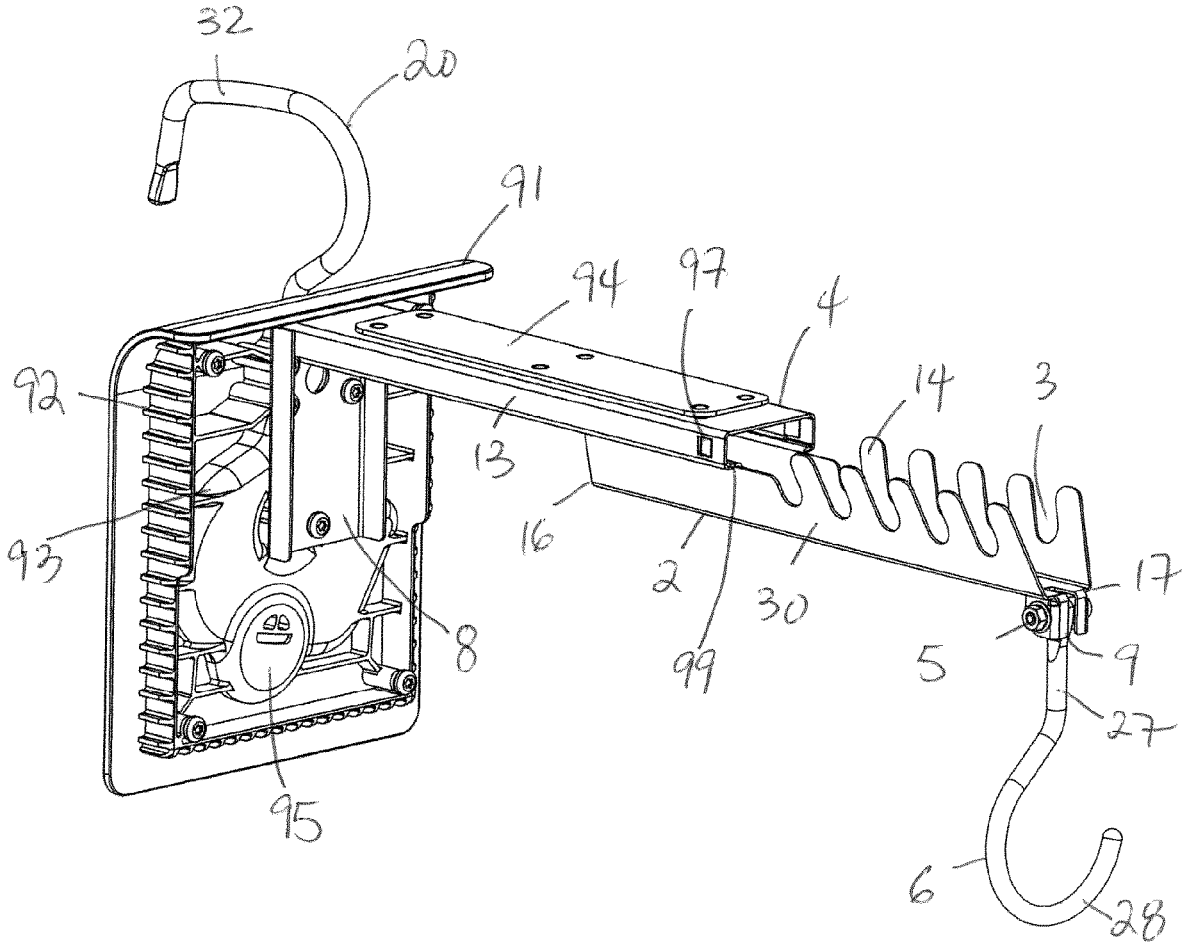
FIG. 59: A first isometric view of an embodiment of the garment hanger mechanism/system according to the present disclosure configured as a slider system with a trough shaped member portion (door mode, open).
Figure 60:
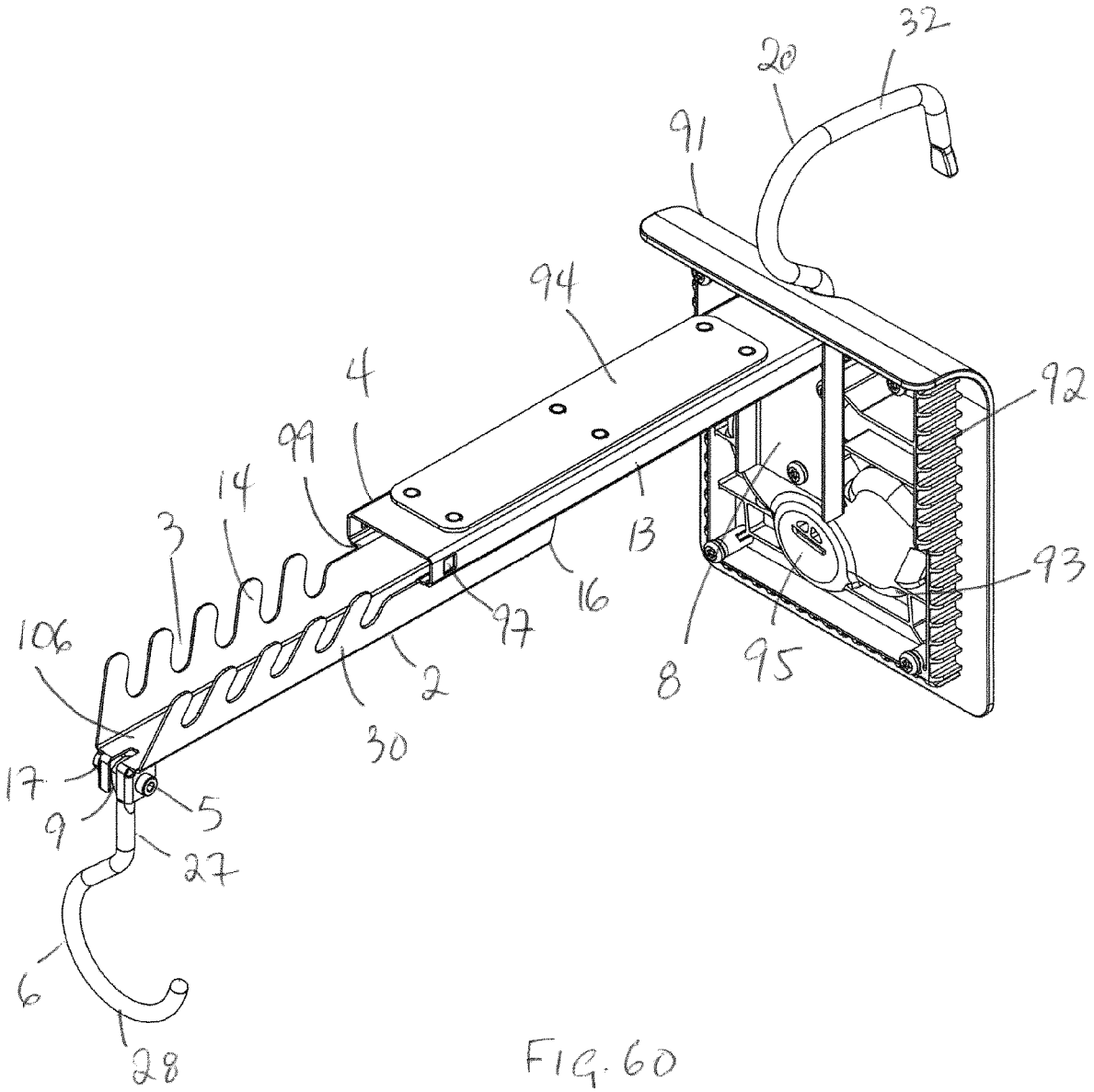
FIG. 60: A second isometric view of an embodiment of the garment hanger mechanism/system according to the present disclosure configured as a slider system with a trough shaped member portion (door mode, open).
Figure 61:
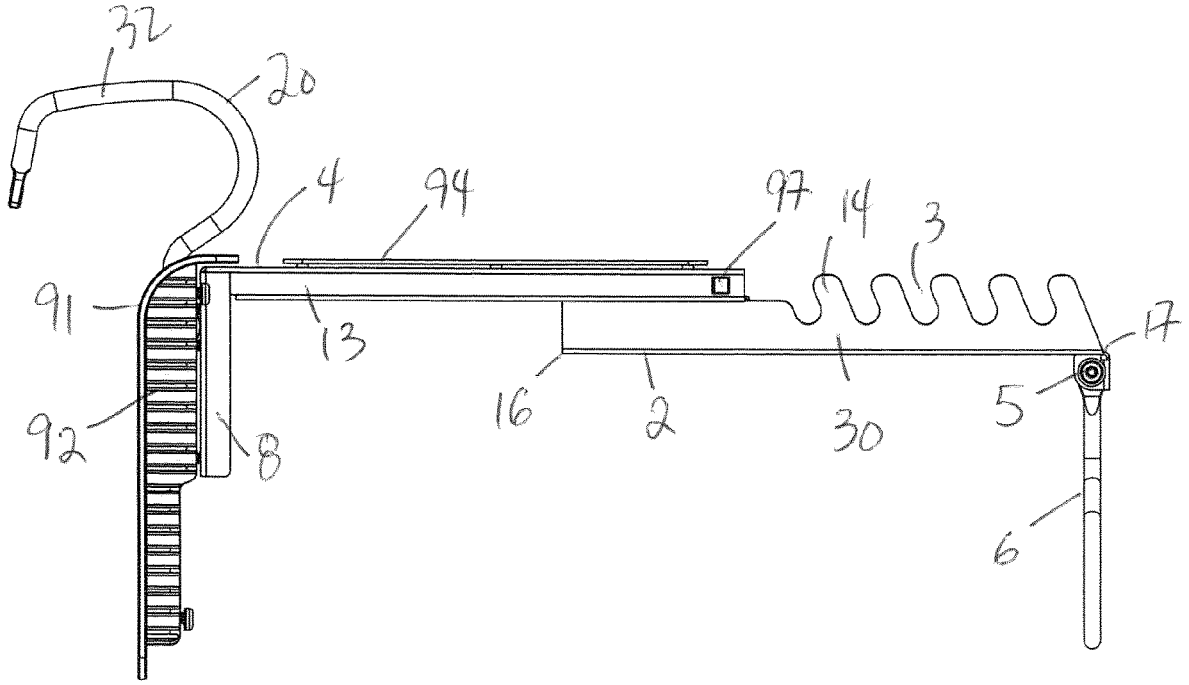
FIG. 61: A side view of an embodiment of the garment hanger mechanism/system according to the present disclosure configured as a slider system with a trough shaped member portion (door mode, open).
Figure 62:
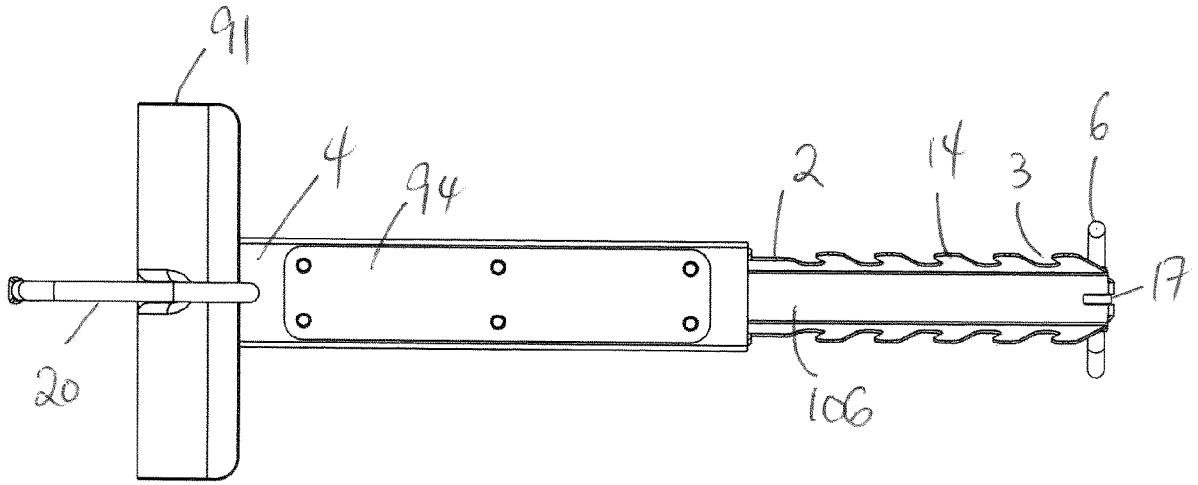
FIG. 62: A top view of an embodiment of the garment hanger mechanism/system according to the present disclosure configured as a slider system with a trough shaped member portion (door mode, open).
Figure 63:
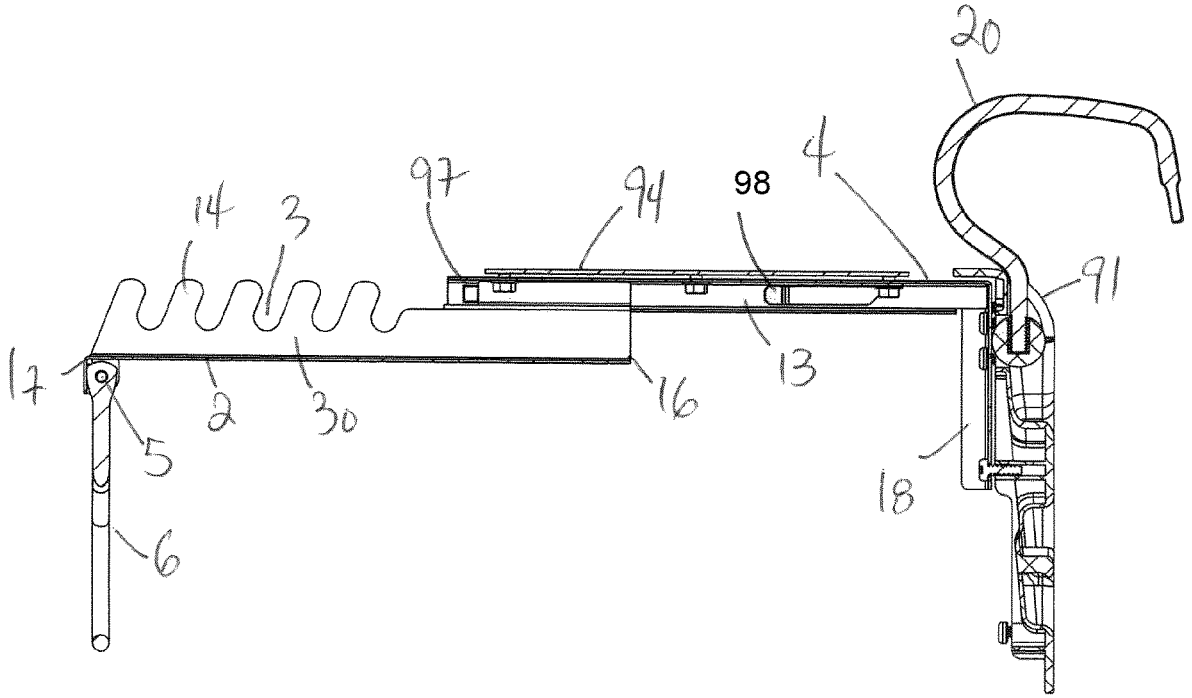
FIG. 63: A cross-sectional, side view of an embodiment of the garment hanger mechanism/system according to the present disclosure configured as a slider system with a trough shaped member portion (door mode, open).
Figure 64:
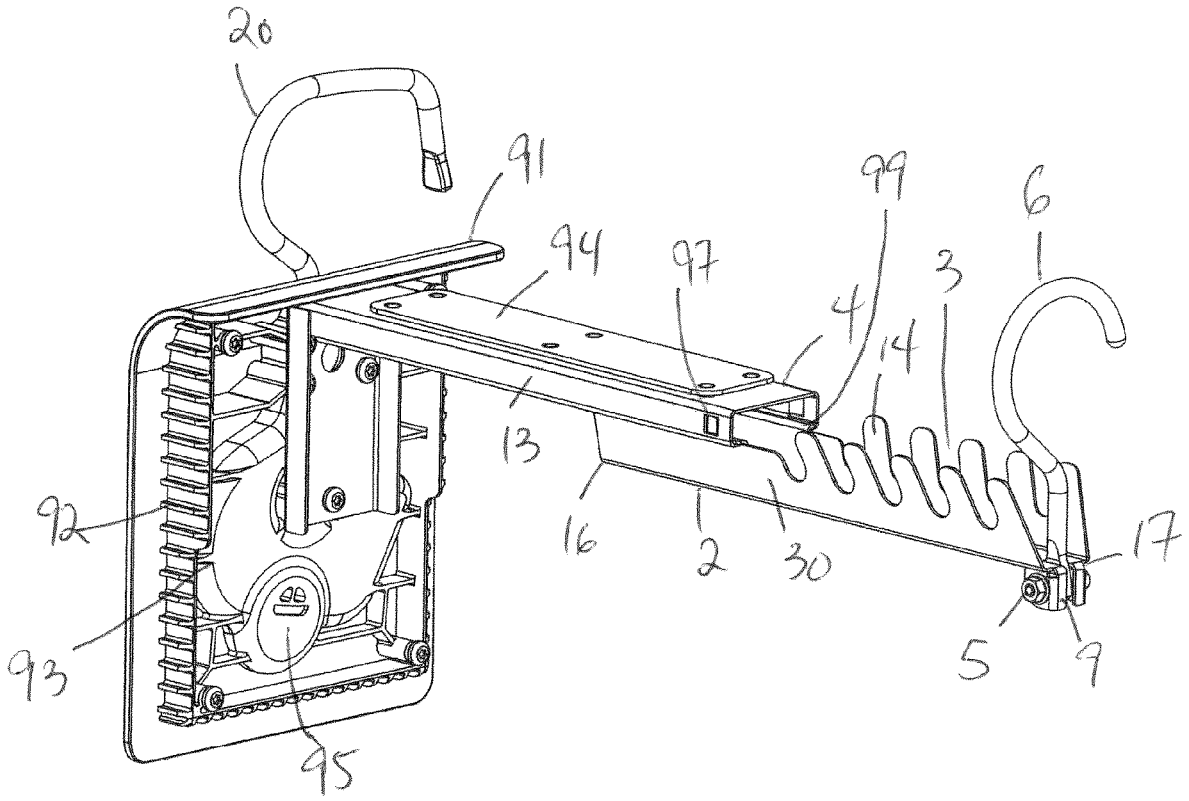
FIG. 64: A first isometric view of an embodiment of the garment hanger mechanism/system according to the present disclosure configured as a slider system with a trough shaped member portion (closet mode, open).
Figure 65:
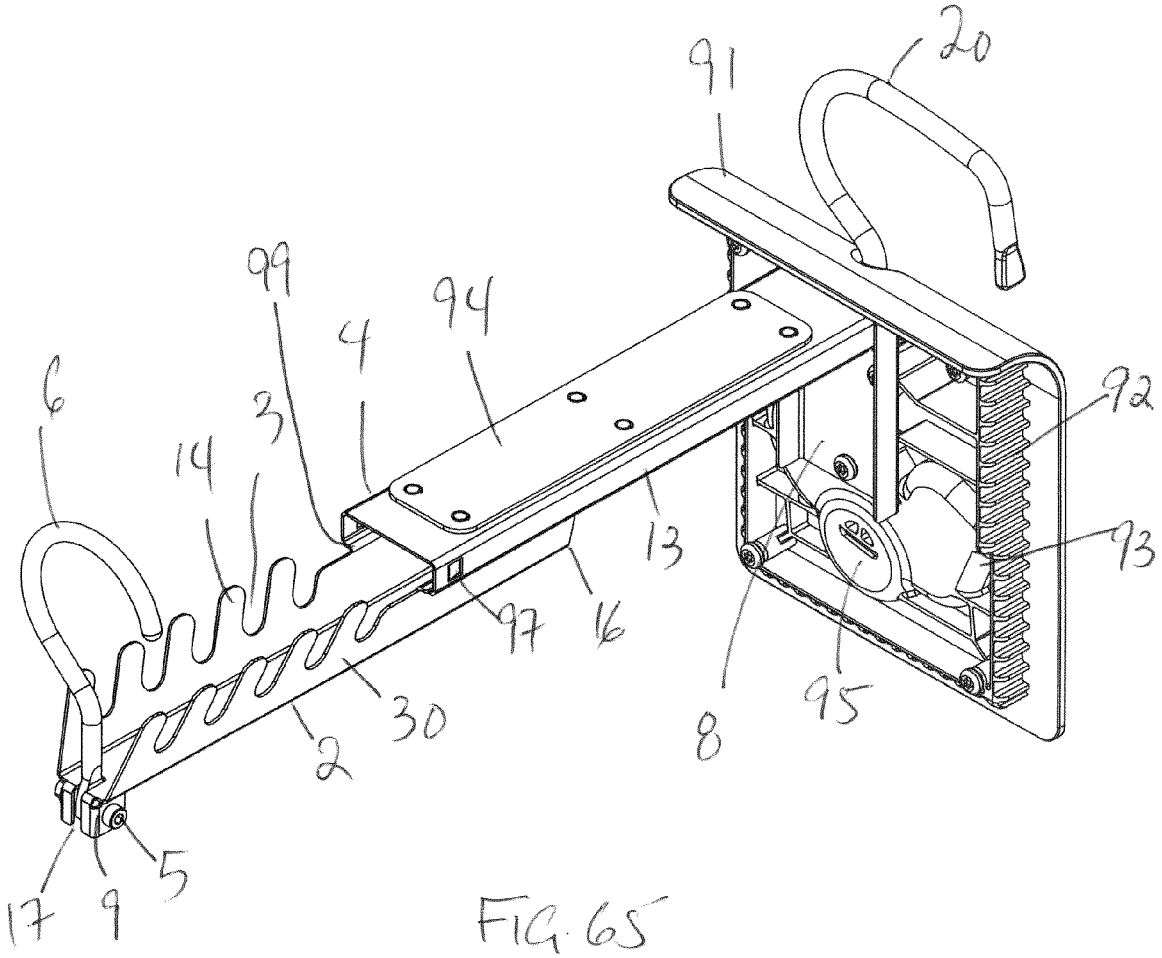
FIG. 65: A second isometric view of an embodiment of the garment hanger mechanism/system according to the present disclosure configured as a slider system with a trough shaped member portion (closet mode, open).
Figure 66:
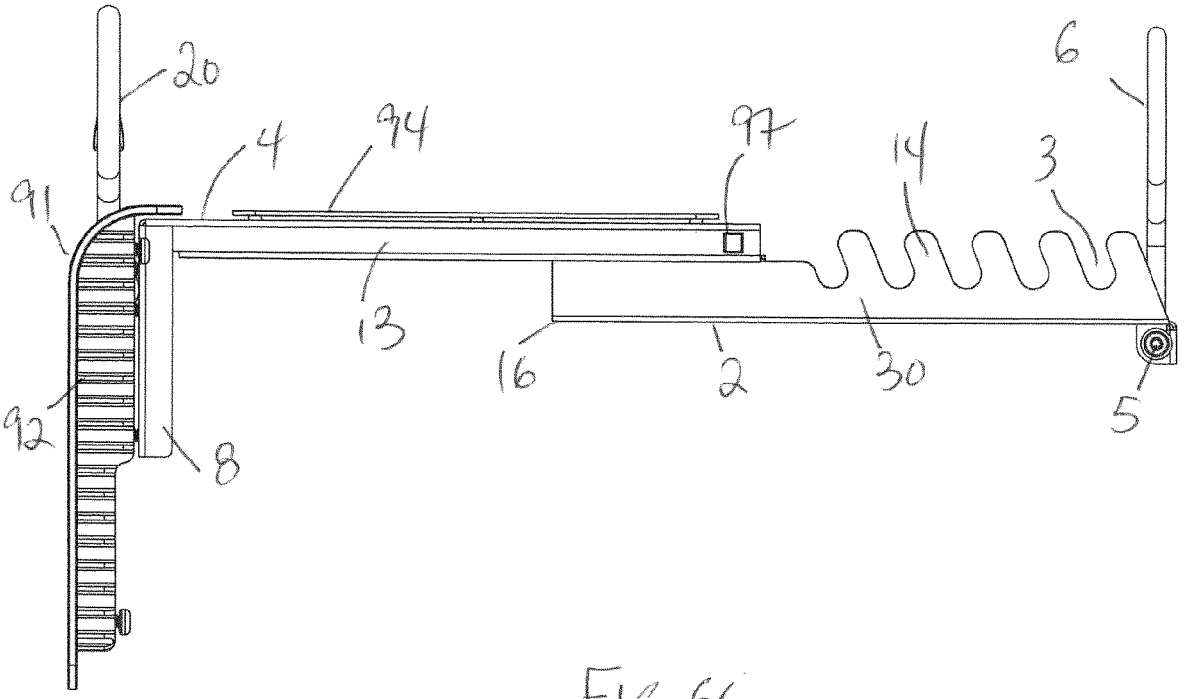
FIG. 66: A side view of an embodiment of the garment hanger mechanism/system according to the present disclosure configured as a slider system with a trough shaped member portion (closet mode, open).
Figure 67:
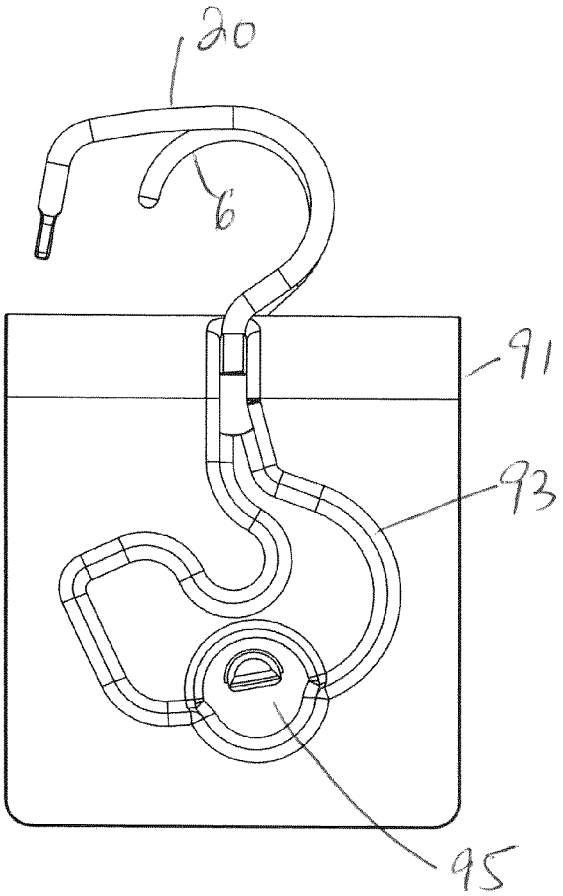
FIG. 67: A back view of an embodiment of the garment hanger mechanism/system according to the present disclosure configured as a slider system with a trough shaped member portion (closet mode, open).
Figure 68:
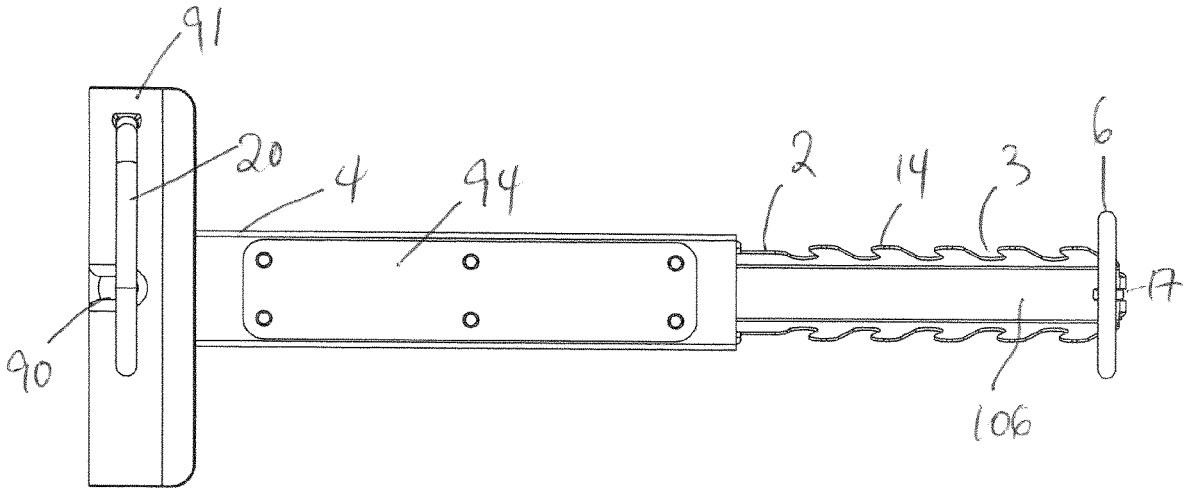
FIG. 68: A top view of an embodiment of the garment hanger mechanism/system according to the present disclosure configured as a slider system with a trough shaped member portion (closet mode, open).
Figure 69:
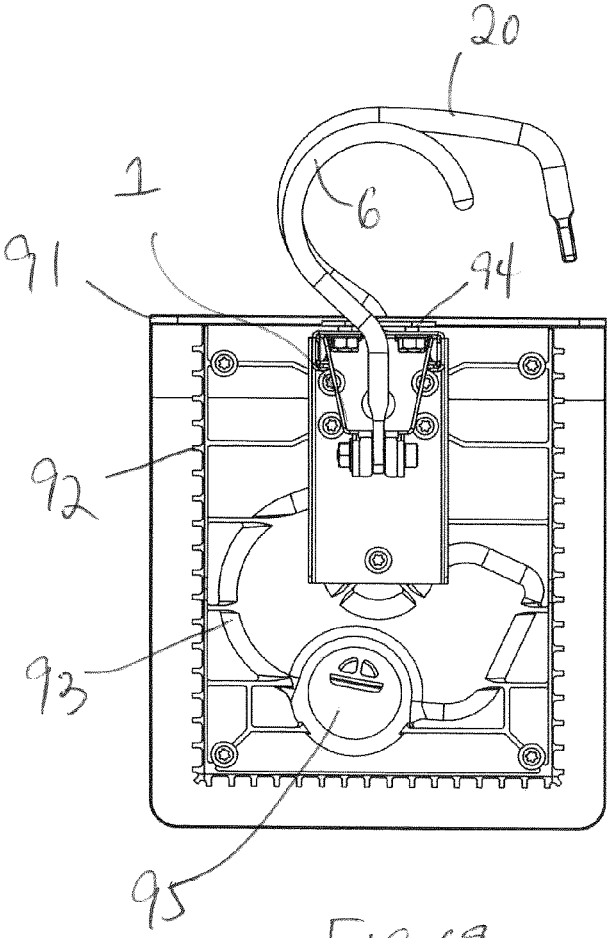
FIG. 69: A front view of an embodiment of the garment hanger mechanism/system according to the present disclosure configured as a slider system with a trough shaped member portion (closet mode, open).
Figure 70:
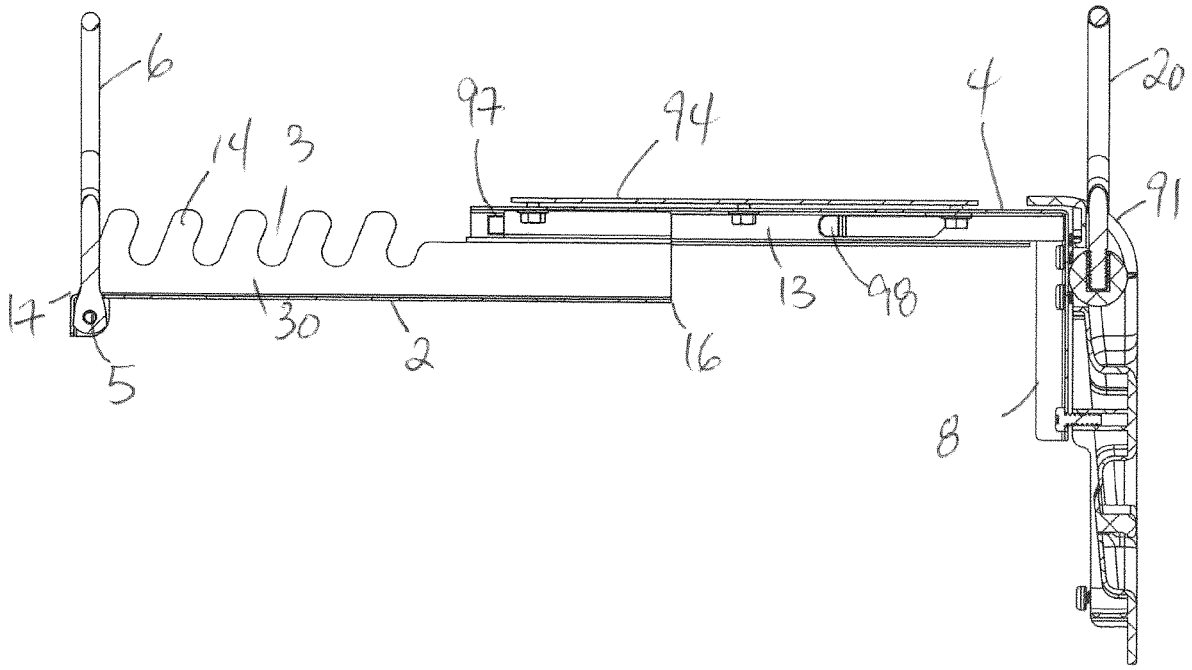
FIG. 70: A cross-sectional, side view of an embodiment of the garment hanger mechanism/system according to the present disclosure configured as a slider system with a trough shaped member portion (closet mode, open).
Figure 71:
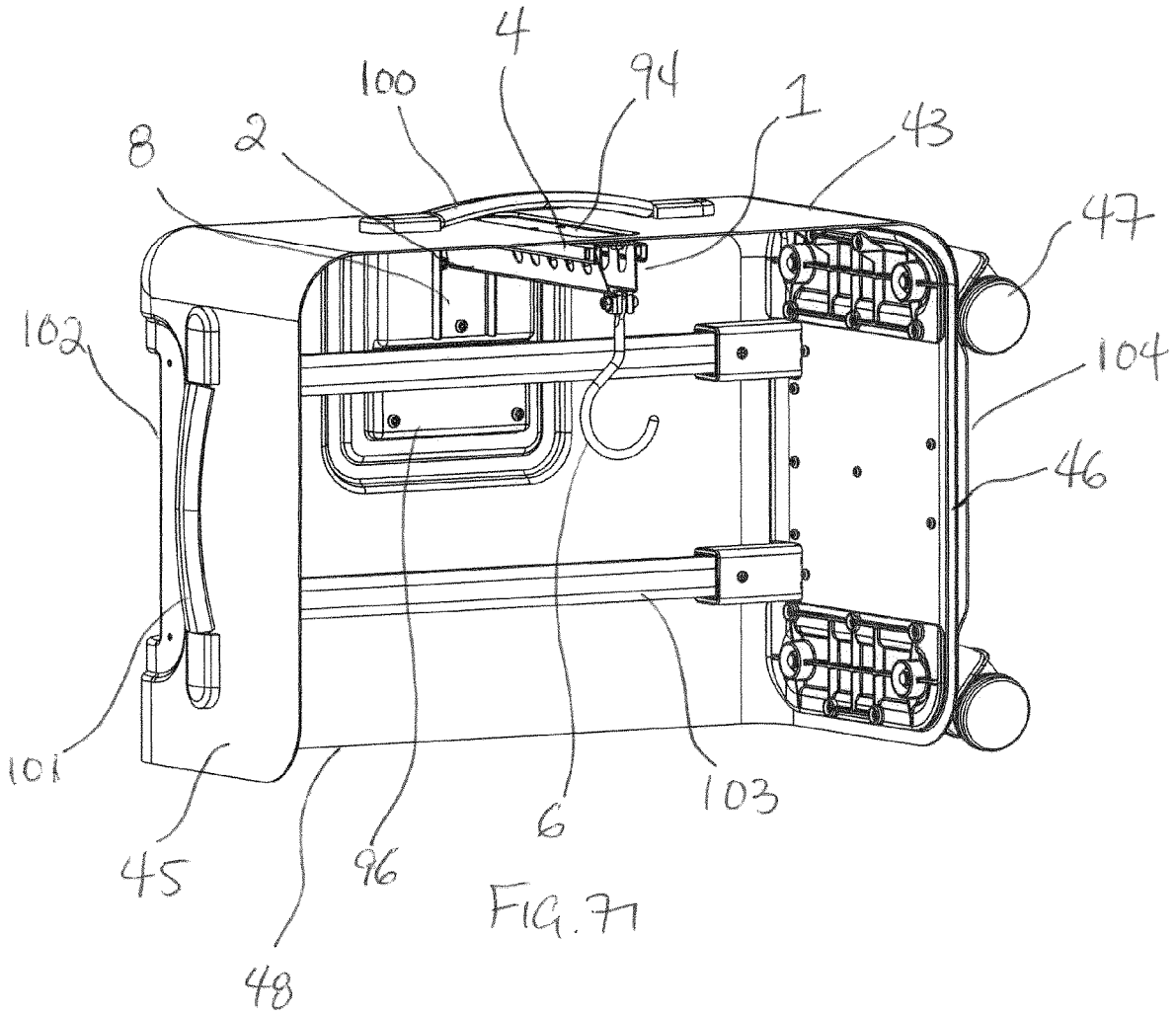
FIG. 71: A first isometric view of an embodiment of the garment hanger mechanism/system integrated into a travel bag according to the present disclosure configured as a slider system with a trough shaped member portion (travel mode).
Figure 72:
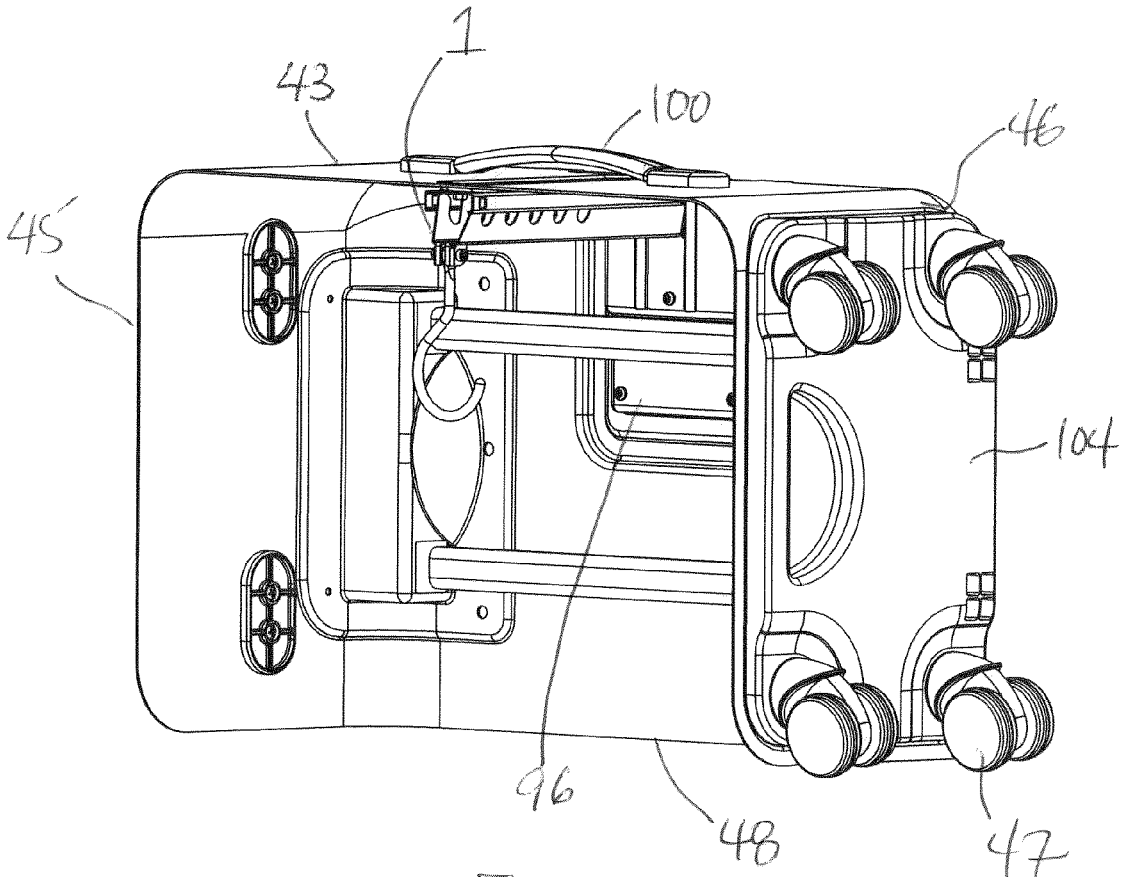
FIG. 72: A second isometric view of an embodiment of the garment hanger mechanism/system integrated into a travel bag according to the present disclosure configured as a slider system with a trough shaped member portion (travel mode).
Figure 73:
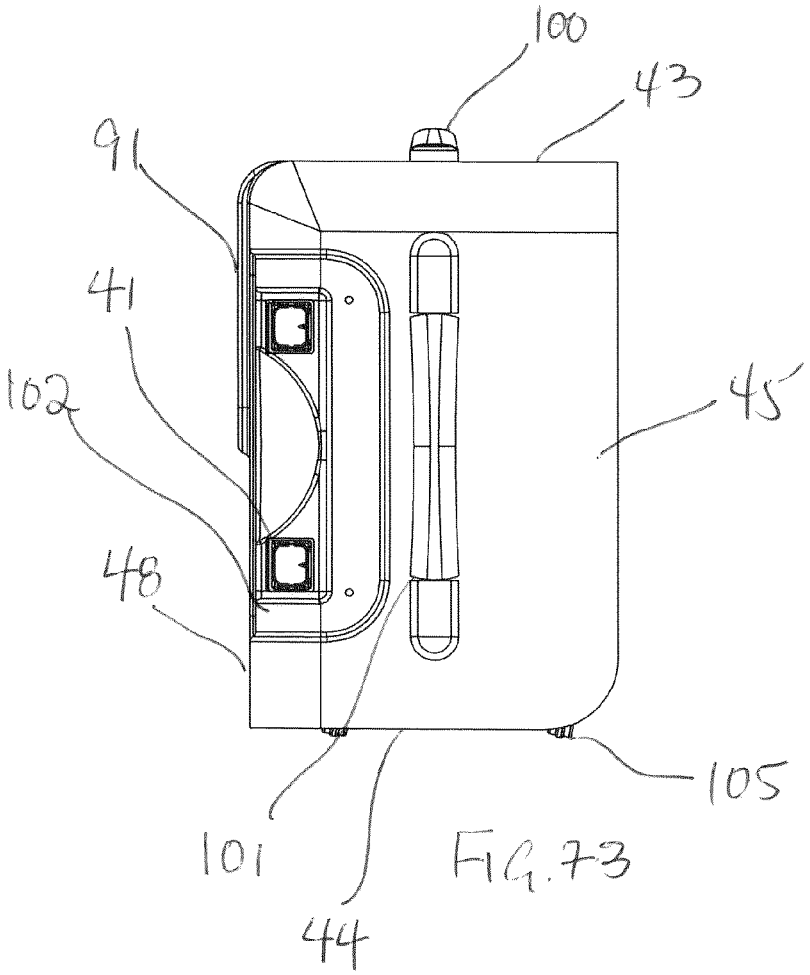
FIG. 73: A view of the top panel/wall of a travel bag suitable for integrating a garment hanger mechanism/system according to the present disclosure configured as a slider system with a trough shaped member portion (travel mode).
Figure 74:
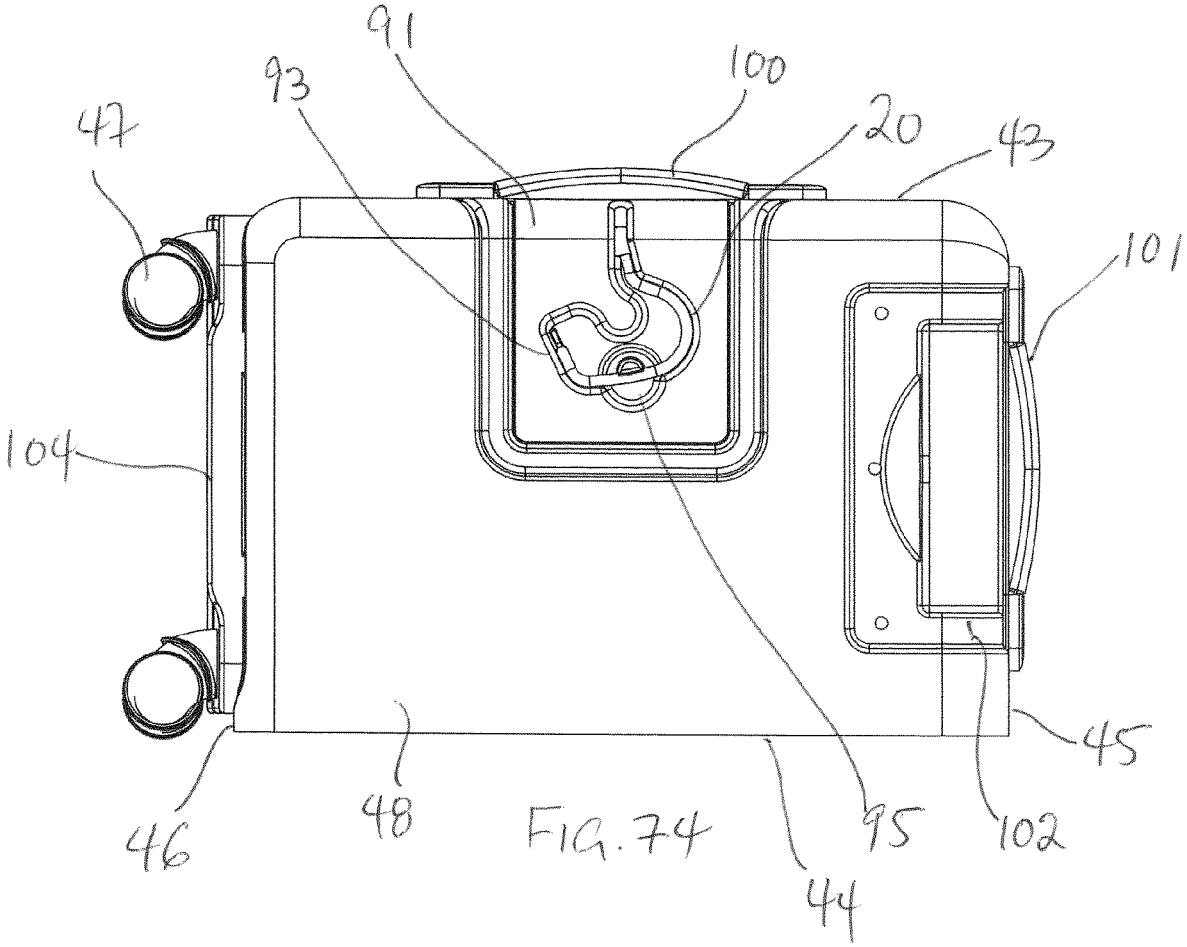
FIG. 74: A back view of an embodiment of the garment hanger mechanism/system integrated into a travel bag according to the present disclosure configured as a slider system with a trough shaped member portion (travel mode).
Figure 75:
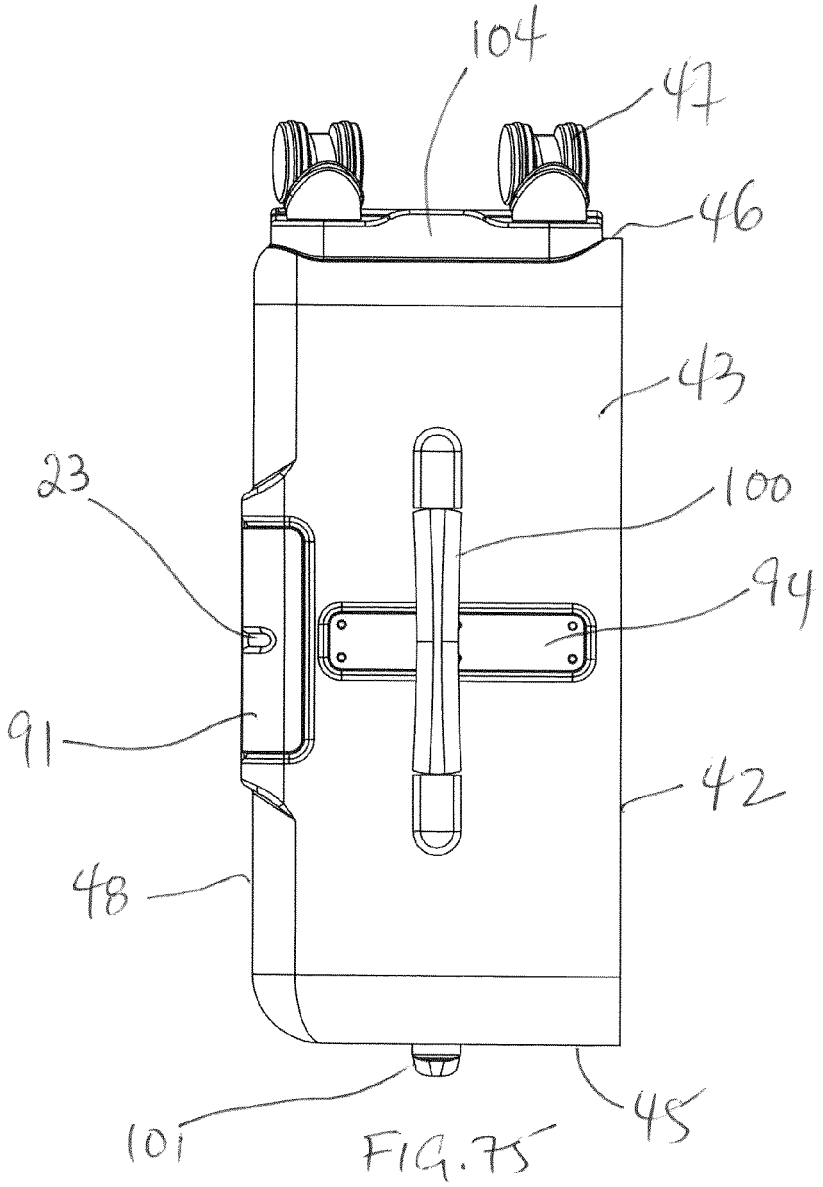
FIG. 75: A top view of an embodiment of the garment hanger mechanism/system integrated into a travel bag according to the present disclosure configured as a slider system with a trough shaped member portion (travel mode).
Figure 76:
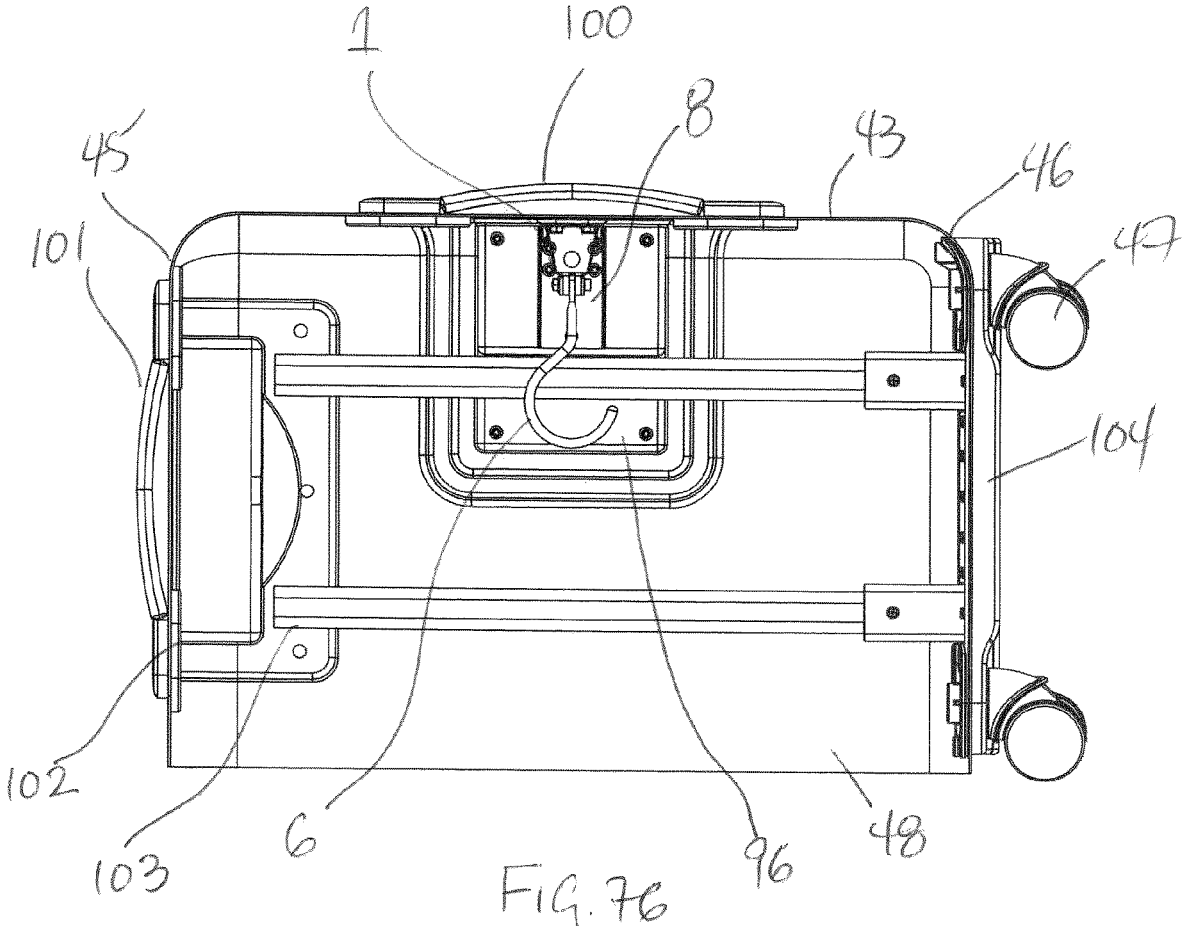
FIG. 76: A front view of an embodiment of the garment hanger mechanism/system integrated into a travel bag according to the present disclosure configured as a slider system with a trough shaped member portion (travel mode).
Figure 105:
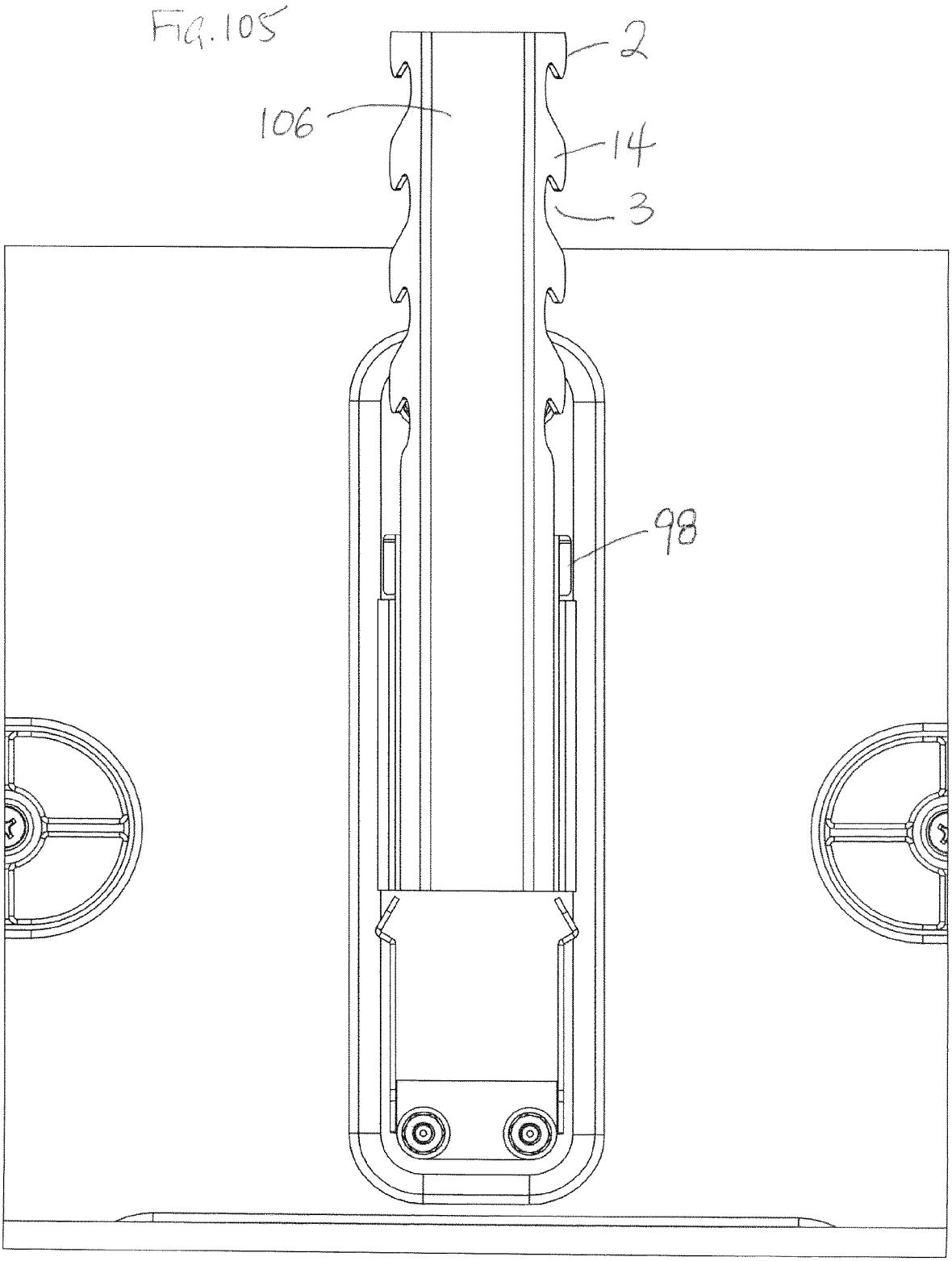
FIG. 105: A top sectional view of an embodiment of the garment hanger mechanism/system according to the present disclosure configured as a slider system with a trough shaped member portion (open), shown without the slider rail.
Figure 106:
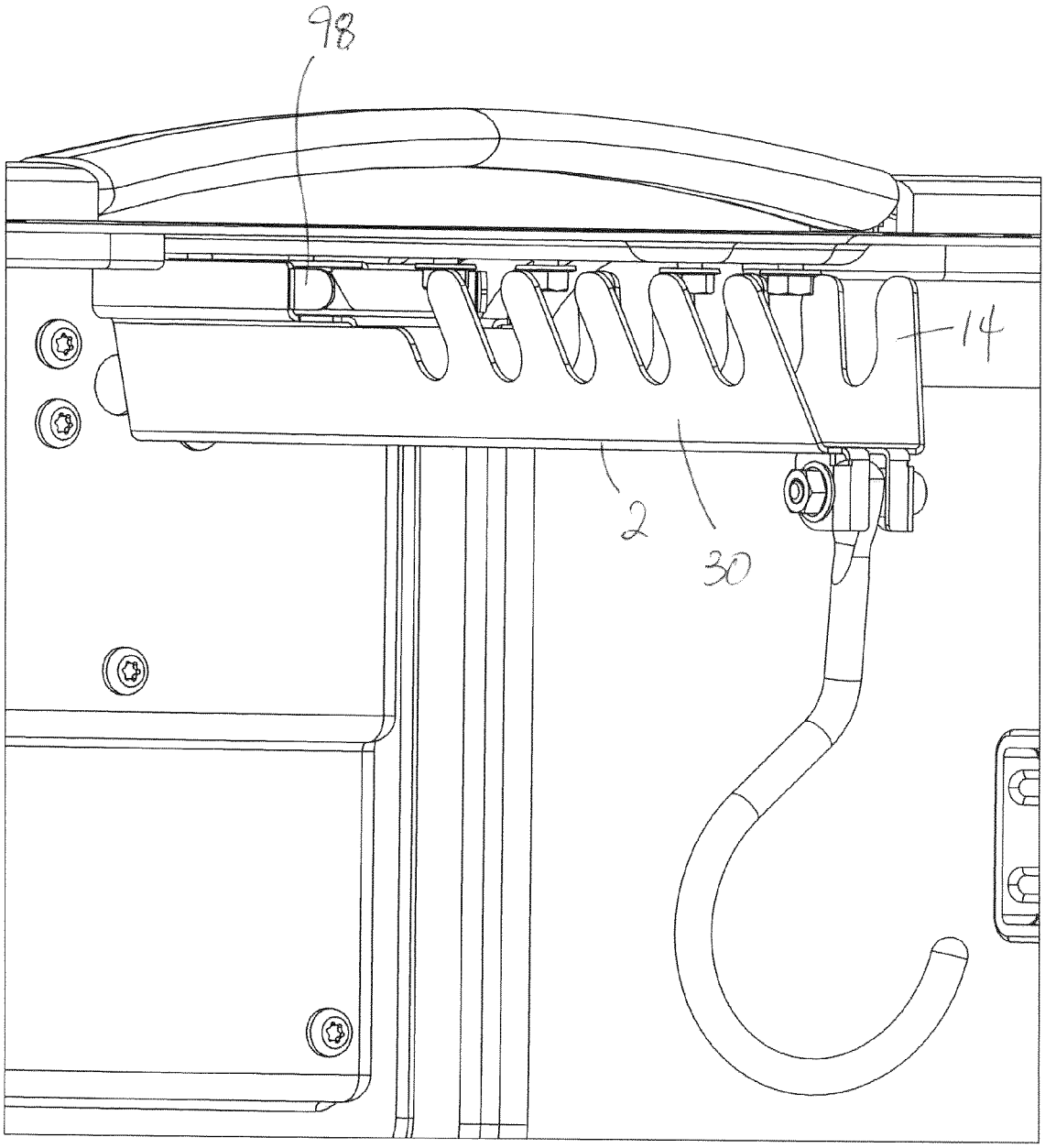
FIG. 106: A side/isometric view of an embodiment of the garment hanger mechanism/system according to the present disclosure configured as a slider system with a trough shaped member portion (open), shown without the slider rail.
Figure 107:
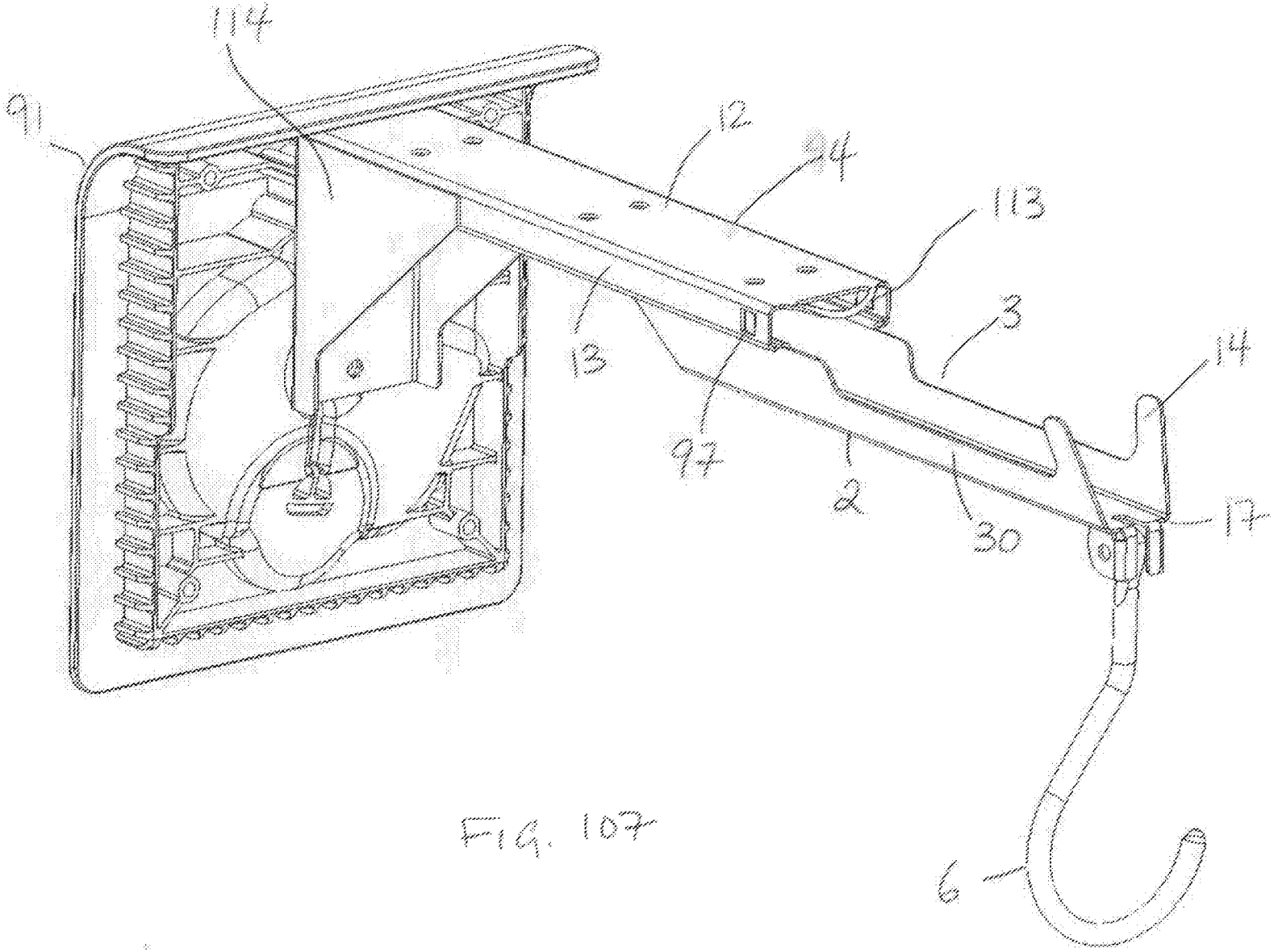
FIG. 107: A side/isometric (top) view of an embodiment of the garment hanger mechanism/system according to the present disclosure configured as a reinforced slider system with a trough shaped member portion (open) viewed from the front end, with a single recess for receiving hangers.
Figure 108:
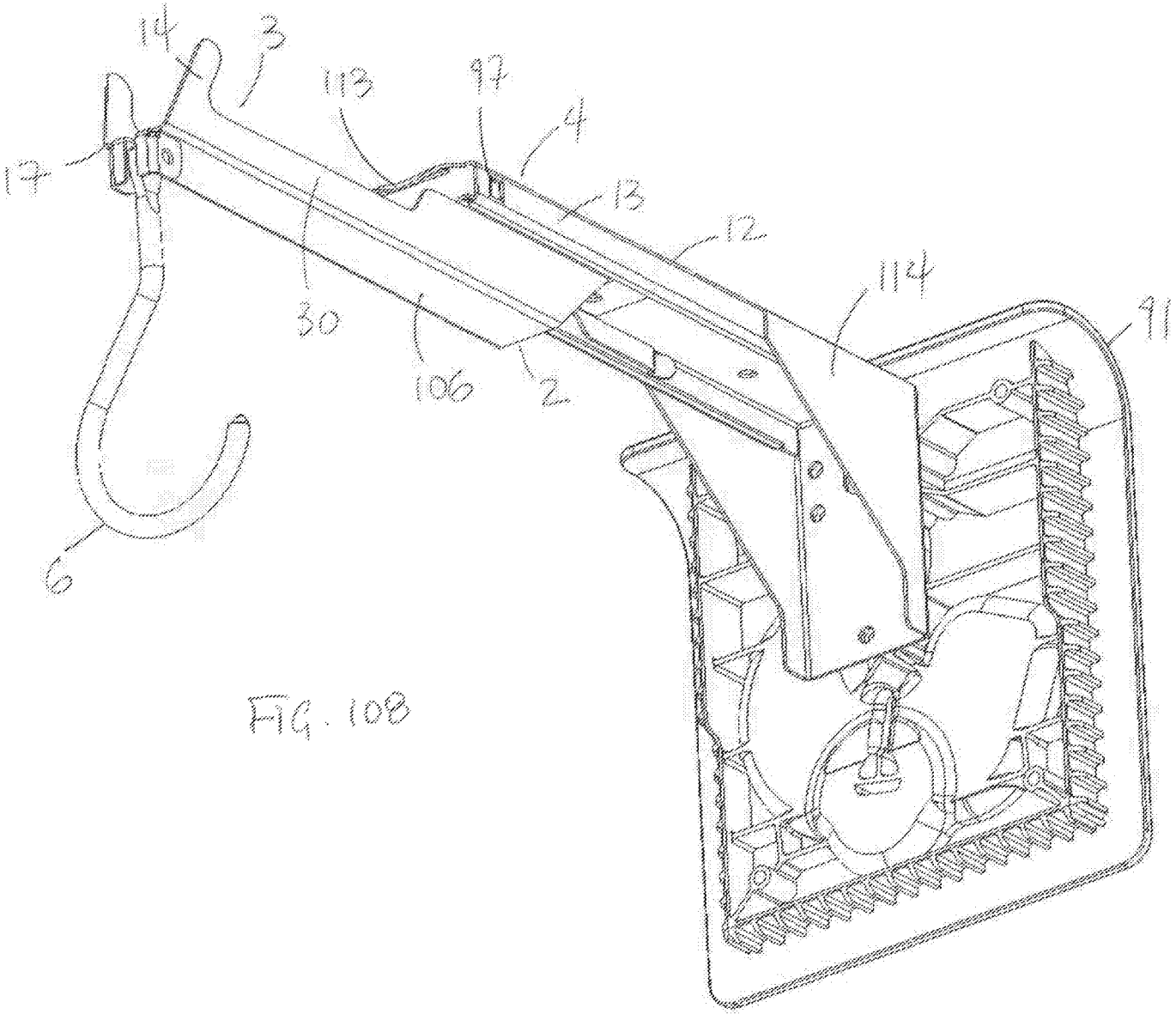
FIG. 108: A side/isometric (bottom) view of an embodiment of the garment hanger mechanism/system according to the present disclosure configured as a slider system with a trough shaped member portion (open) viewed from the front end, with single recess for receiving hangers.
Figure 104:
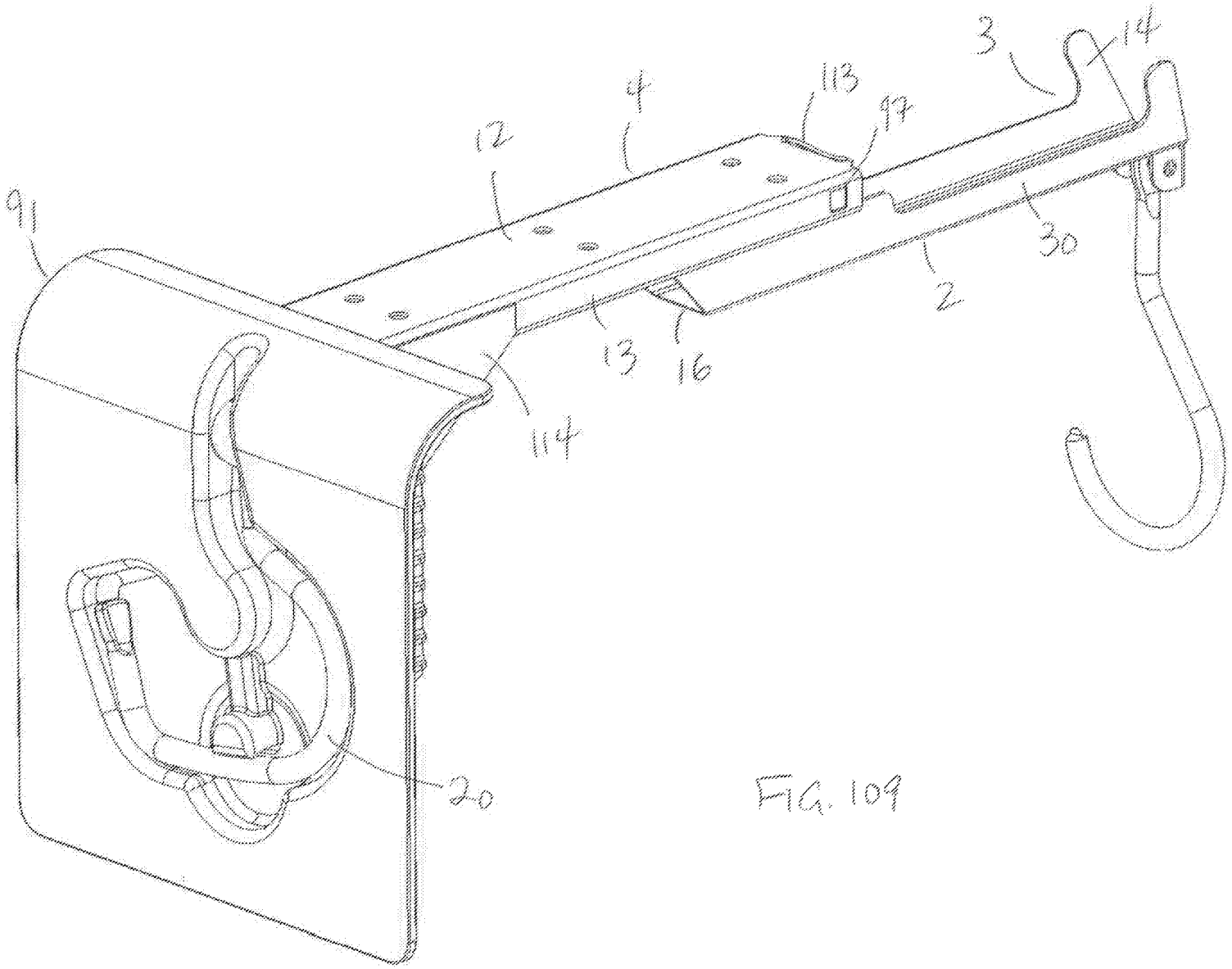
Figure 110:
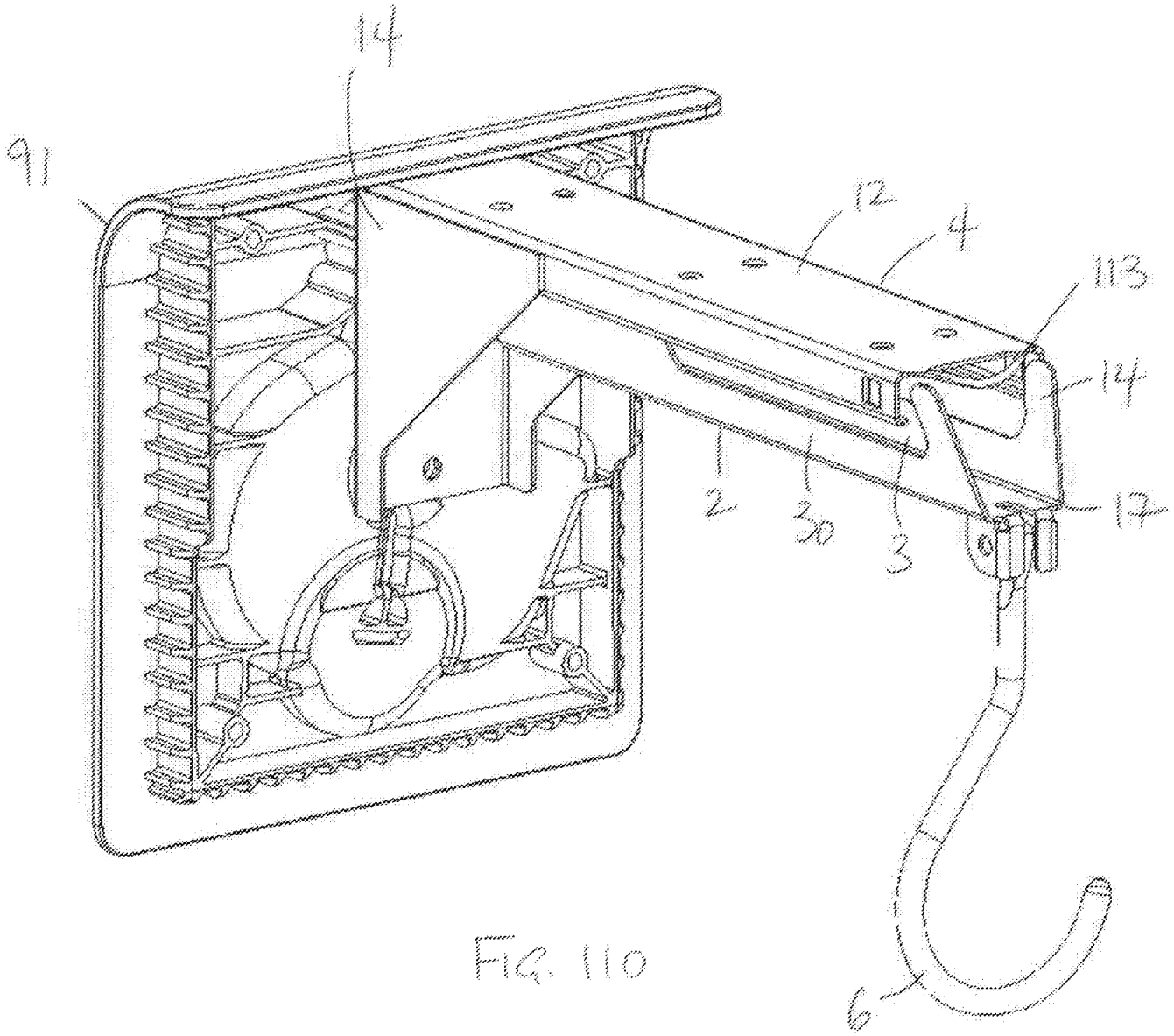
FIG. 110: A side/isometric (top) view of an embodiment of the garment hanger mechanism/system according to the present disclosure configured as a slider system with a trough shaped member portion (closed) viewed from the front end, with a single recess for receiving hangers.
Figure 111:
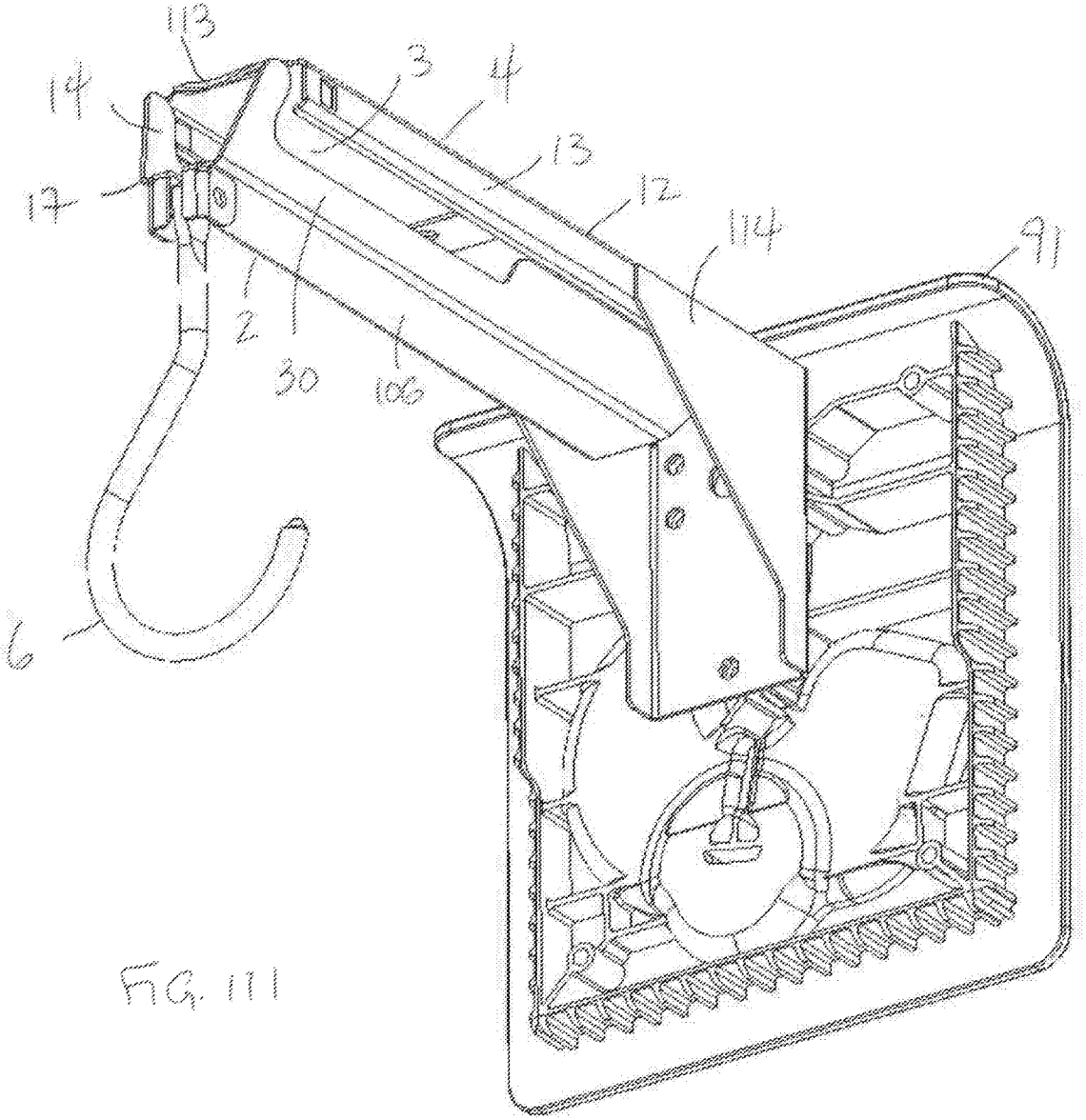
FIG. 111: A side/isometric (bottom) view of an embodiment of the garment hanger mechanism/system according to the present disclosure configured as a slider system with a trough shaped member portion (closed) viewed from the front end, with single recess for receiving hangers.
Figure 112:
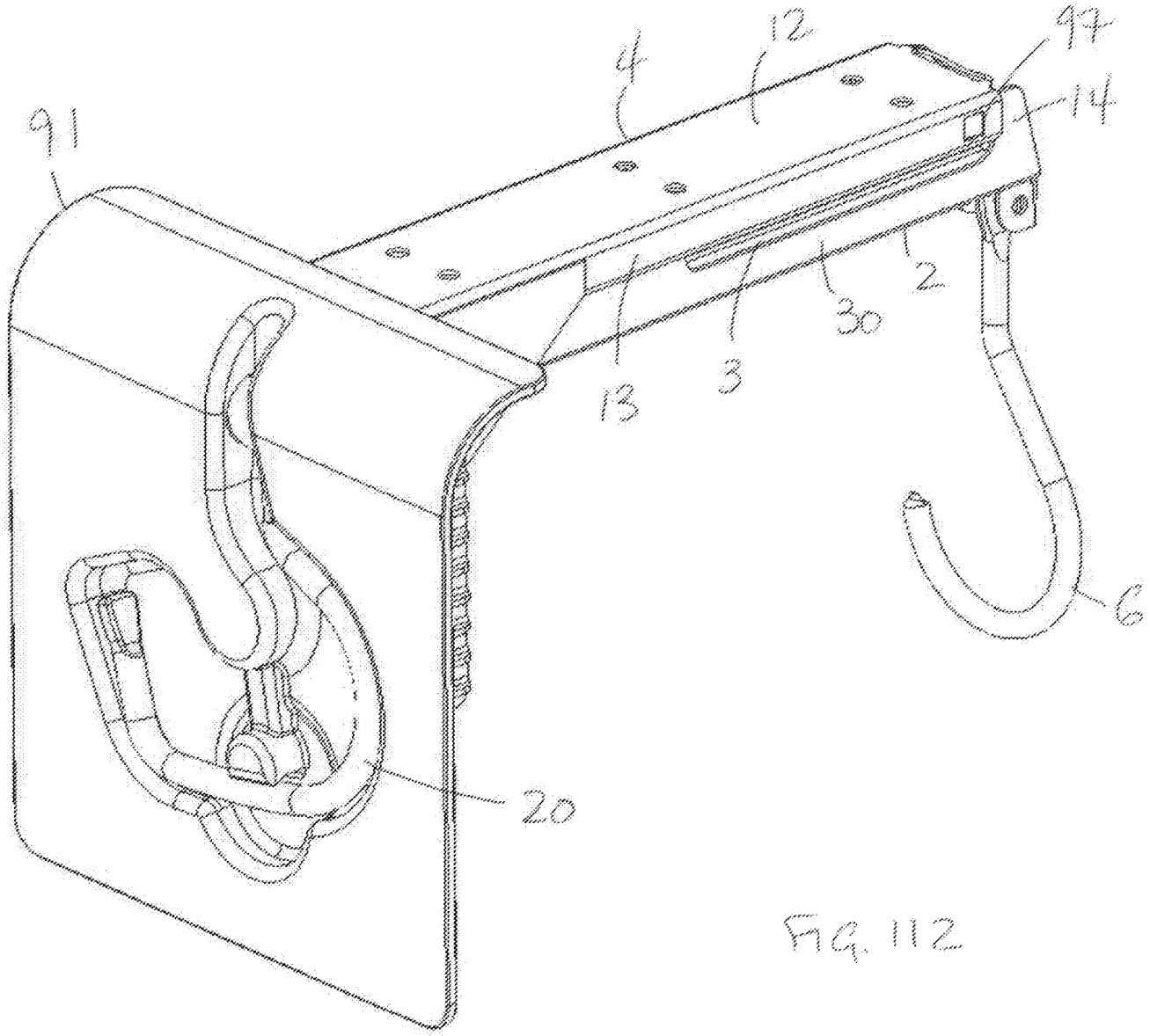
FIG. 112: A side/isometric (bottom) view of an embodiment of the garment hanger mechanism/system according to the present disclosure configured as a slider system with a trough shaped member portion (closed) viewed from the front end, with single recess for receiving hangers.

In one embodiment the member portion has a trough configuration (e.g. See FIGS. 59, 60 and 62) with a base 106 separating two series of projections 14 forming recesses 3 into each side 30 of the member portion. The sides 30 extend at an outward angle from the base 106 and each other to engage with the sides 13 of the support arm and securing means 4. FIGS. 105 and 106 provide additional detail of the trough configuration for the member portion of the garment hanger member unobscured by the support arm and securing means 4.

With reference to the figures, the recesses 3 of the member portion 2 may be sized and spaced to receive clothes hangers of variable types and sizes (e.g. commercially available metal and plastic hangers) and provide some distance between hangers, so that garments hanging from the clothes hangers are readily accessible when the garment hanger mechanism is in an unpacked state. When the garment hanger mechanism is in a packed state the spaced recesses help to prevent excessive bunching and compression of clothes hangers with apparel, which can contribute to the wrinkling of garments during travel. As shown in FIGS. 1-4, the projections or protrusions 14 defining the recesses may project upwards from the base of the member portion at an angle biased towards the end of the garment hanger member or member portion 16 connected to the panel of a travel bag.

Alternatively, the projections of the member portion defining the recesses may be bent, widened or include extensions at their top ends to partially obstruct or narrow the openings of the recesses. In this way hangers may be partially secured in the member portion, particularly when the garment hanger member is in a collapsed state, as would be the case when the garment hanger mechanism is stowed for travel, or when the travel bag is unfolded and hung only from a door or from a closet rod in a mode to minimize the space it occupies.

In one embodiment the garment hanger member is attached to a board integrated into a panel of a travel bag, e.g. enveloped by fabric. The member portion of the garment hanger member may be mounted (connected) to a board, using a mounting plate. In an alternative embodiment, the member portion may be attached to a support structure, which is attached to a board using a mounting plate.

Figure 77:
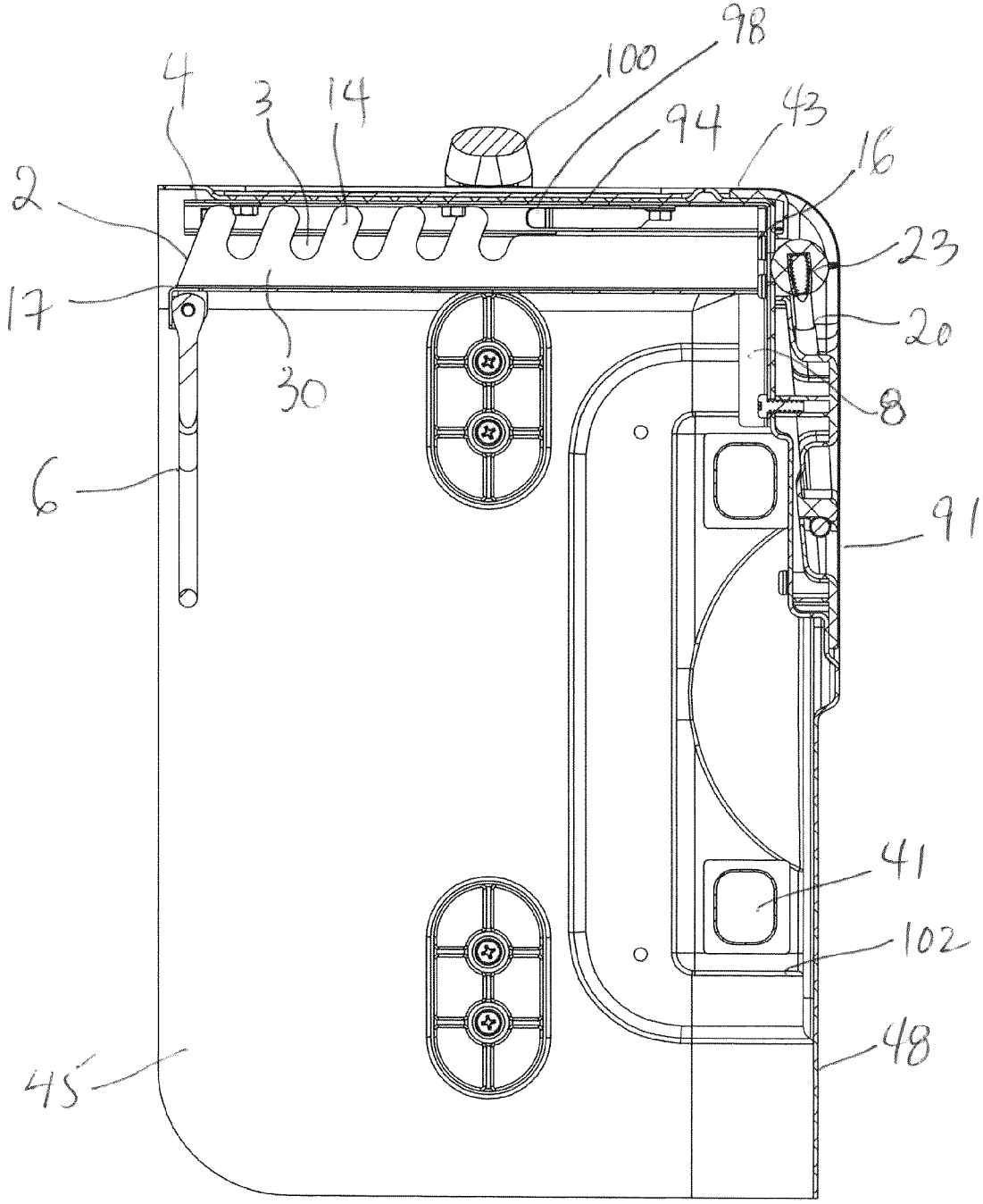
FIG. 77: A cross-sectional side view of an embodiment of the garment hanger mechanism/system integrated into a travel bag according to the present disclosure configured as a slider system with a trough shaped member portion (travel mode).
Figure 78:
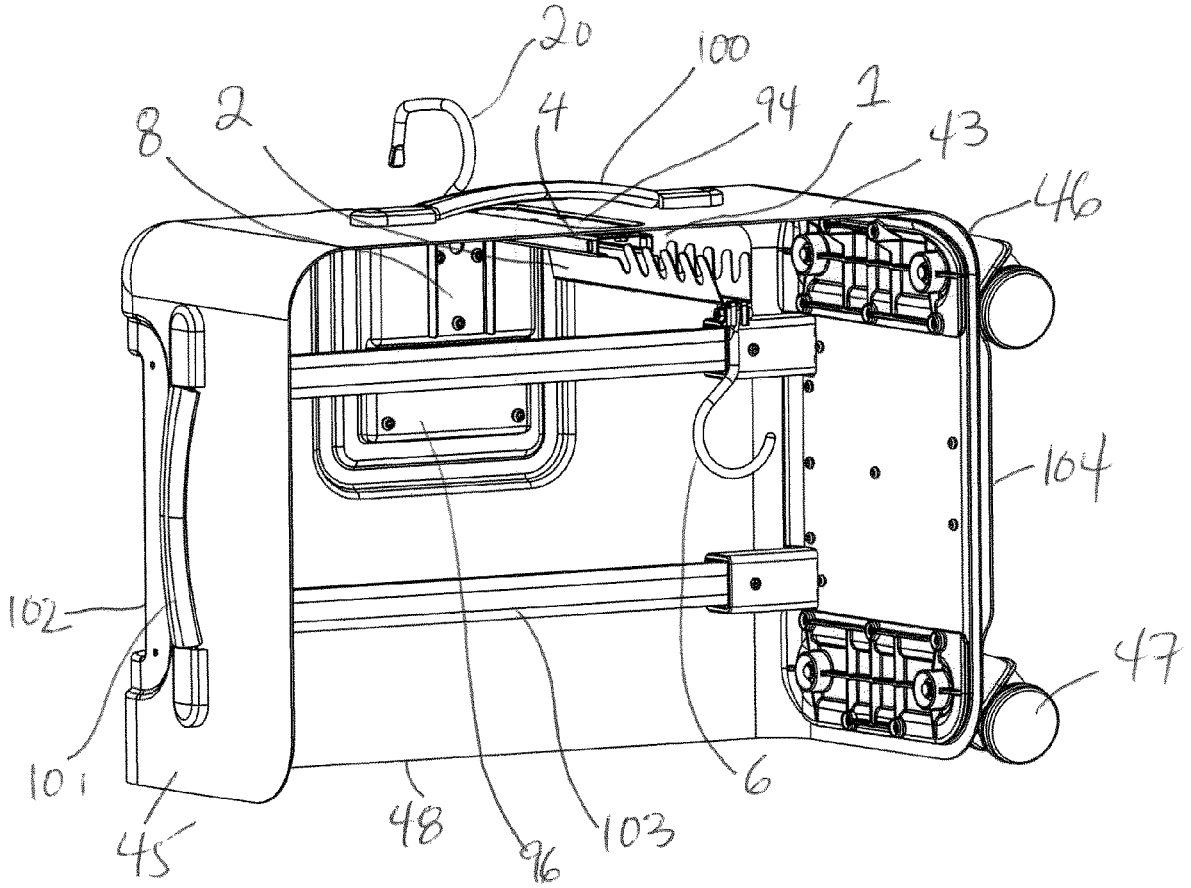
FIG. 78: A first isometric view of an embodiment of the garment hanger mechanism/system integrated into a travel bag according to the present disclosure configured as a slider system with a trough shaped member portion (door mode, open).
Figure 79:
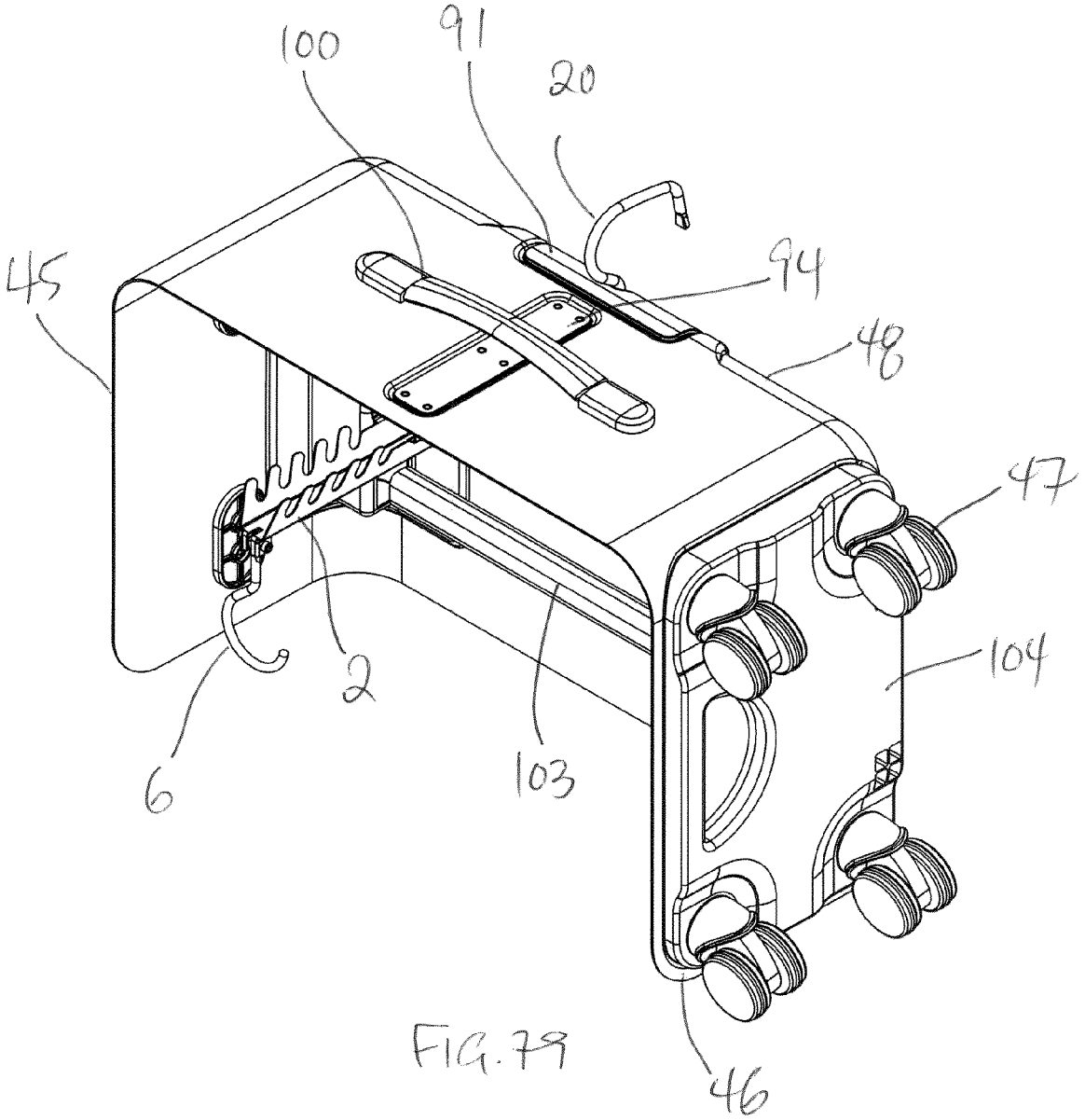
FIG. 79: A second isometric view of an embodiment of the garment hanger mechanism/system integrated into a travel bag according to the present disclosure configured as a slider system with a trough shaped member portion (door mode, open).
Figure 80:
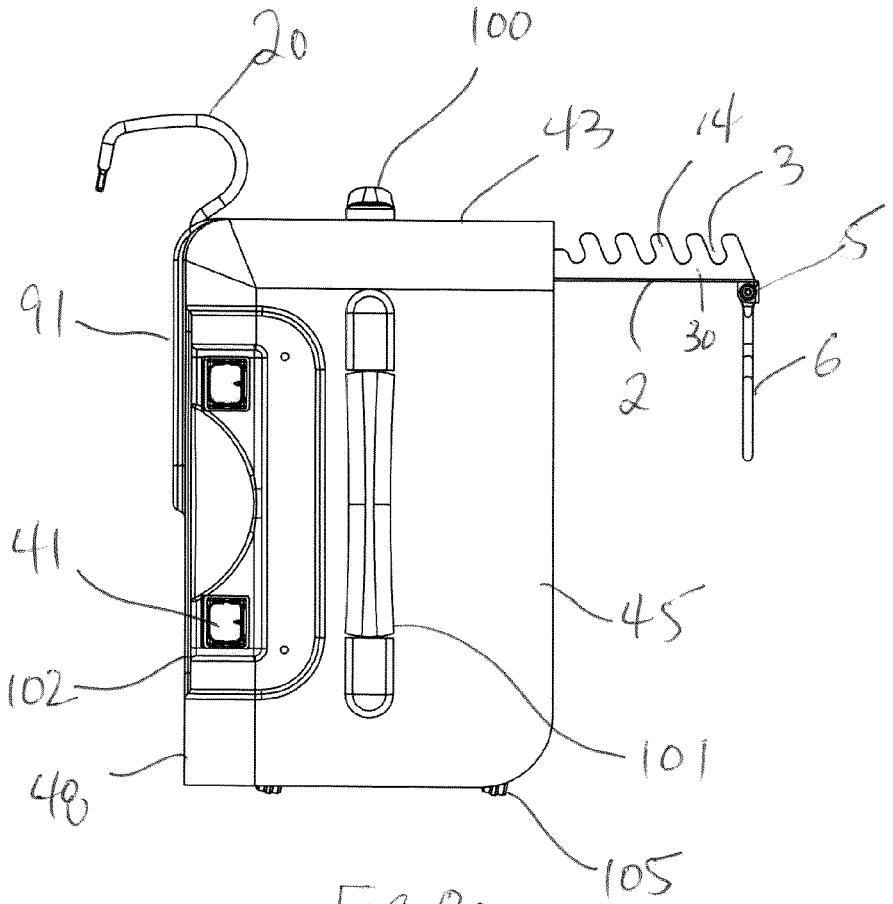
FIG. 80: A side view of an embodiment of the garment hanger mechanism/system integrated into a travel bag according to the present disclosure configured as a slider system with a trough shaped member portion (door mode, open).
Figure 81:
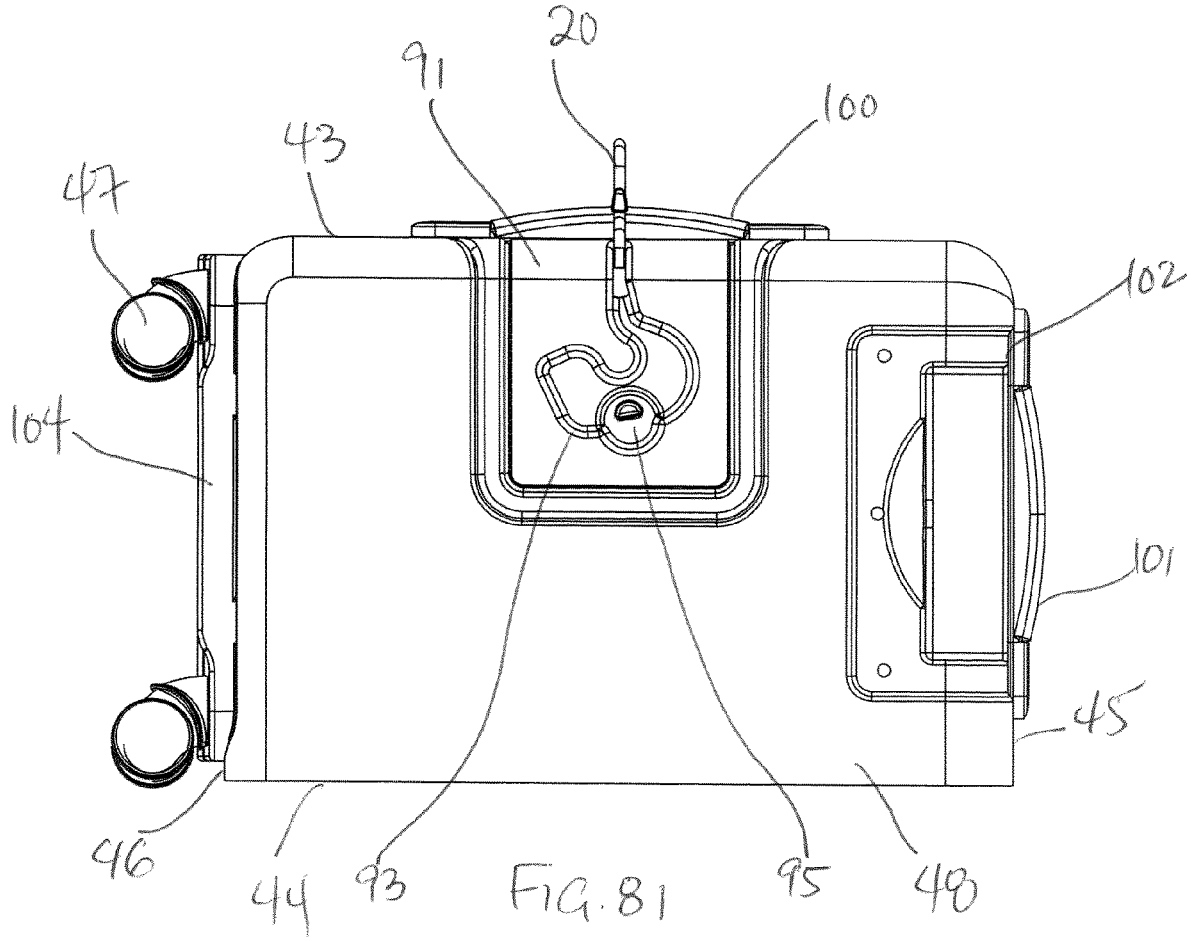
FIG. 81: A back view of an embodiment of the garment hanger mechanism/system integrated into a travel bag according to the present disclosure configured as a slider system with a trough shaped member portion (door mode, open).
Figure 82:
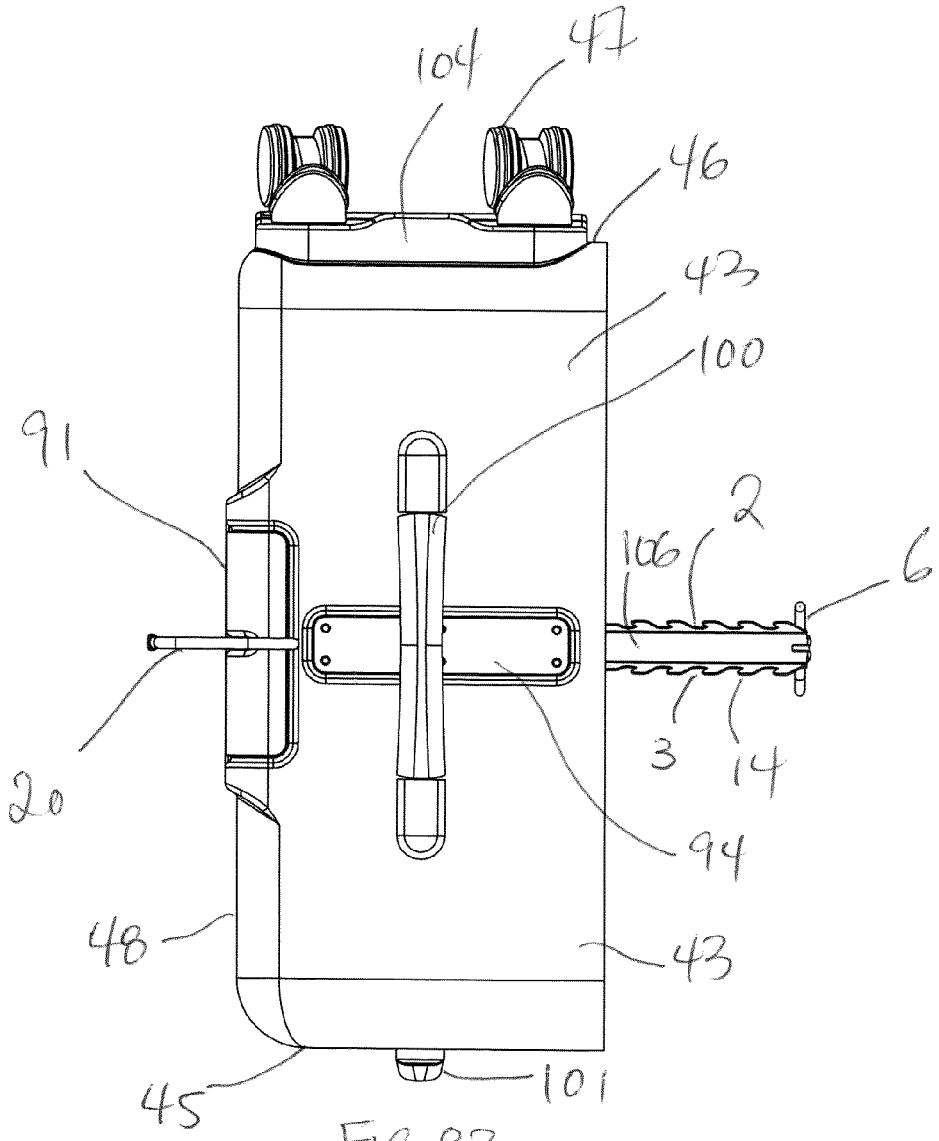
FIG. 82: A top view of an embodiment of the garment hanger mechanism/system integrated into a travel bag according to the present disclosure configured as a slider system with a trough shaped member portion (door mode, open).
Figure 83:
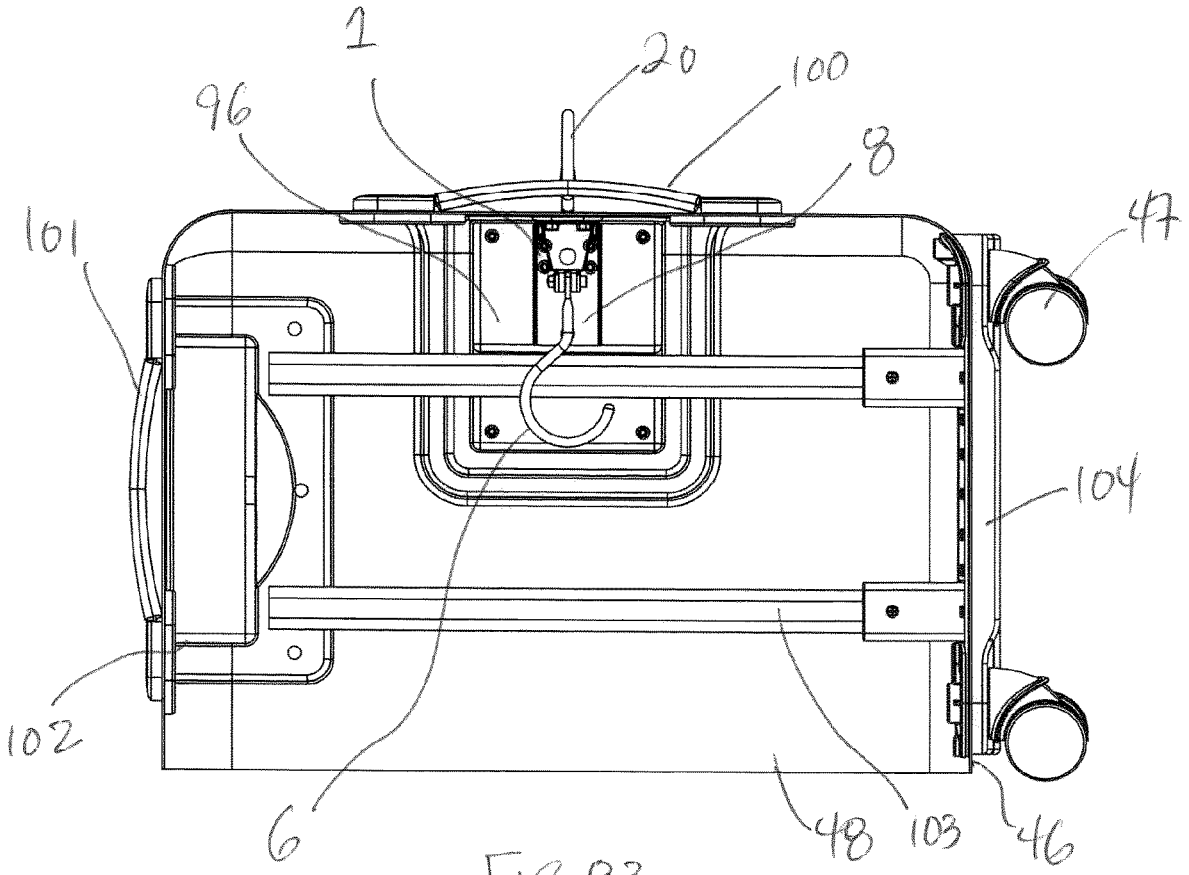
FIG. 83: A front view of an embodiment of the garment hanger mechanism/system integrated into a travel bag according to the present disclosure configured as a slider system with a trough shaped member portion (door mode, open).
Figure 84:
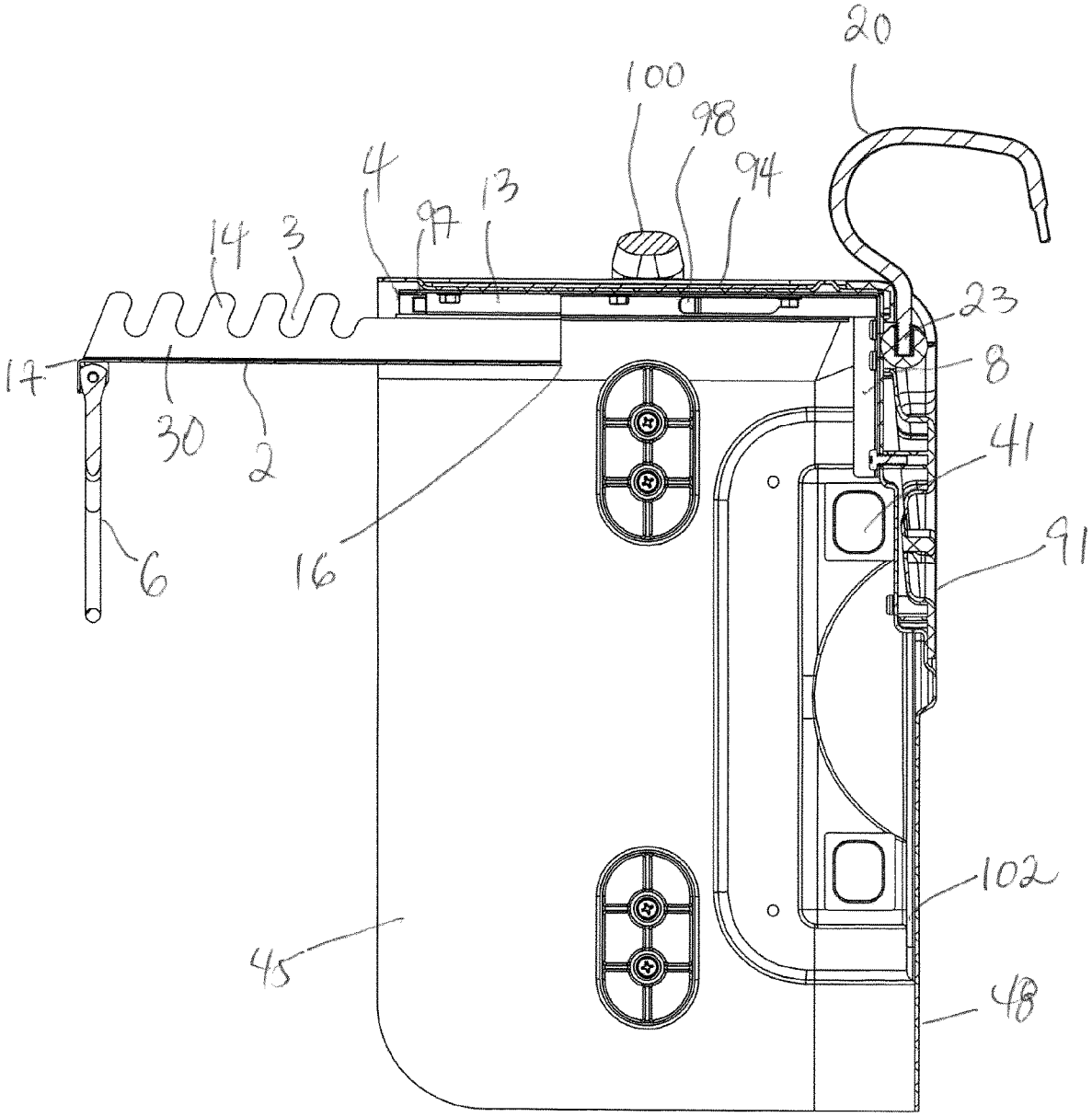
FIG. 84: A cross-sectional side view of an embodiment of the garment hanger mechanism/system integrated into a travel bag according to the present disclosure configured as a slider system with a trough shaped member portion (door mode, open).
Figure 85:
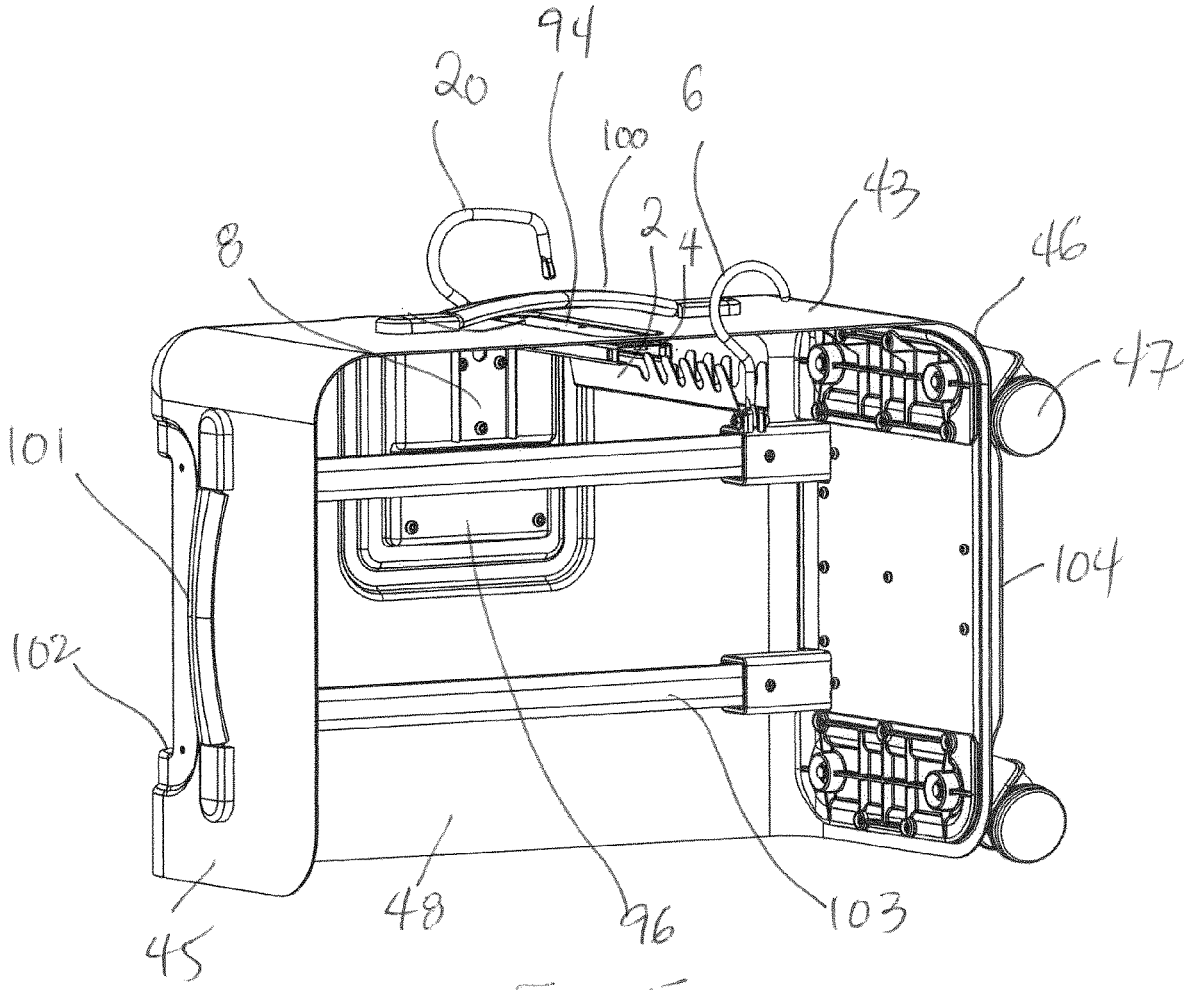
FIG. 85: A first isometric view of an embodiment of the garment hanger mechanism/system integrated into a travel bag according to the present disclosure configured as a slider system with a trough shaped member portion (closet mode, open).
Figure 86:
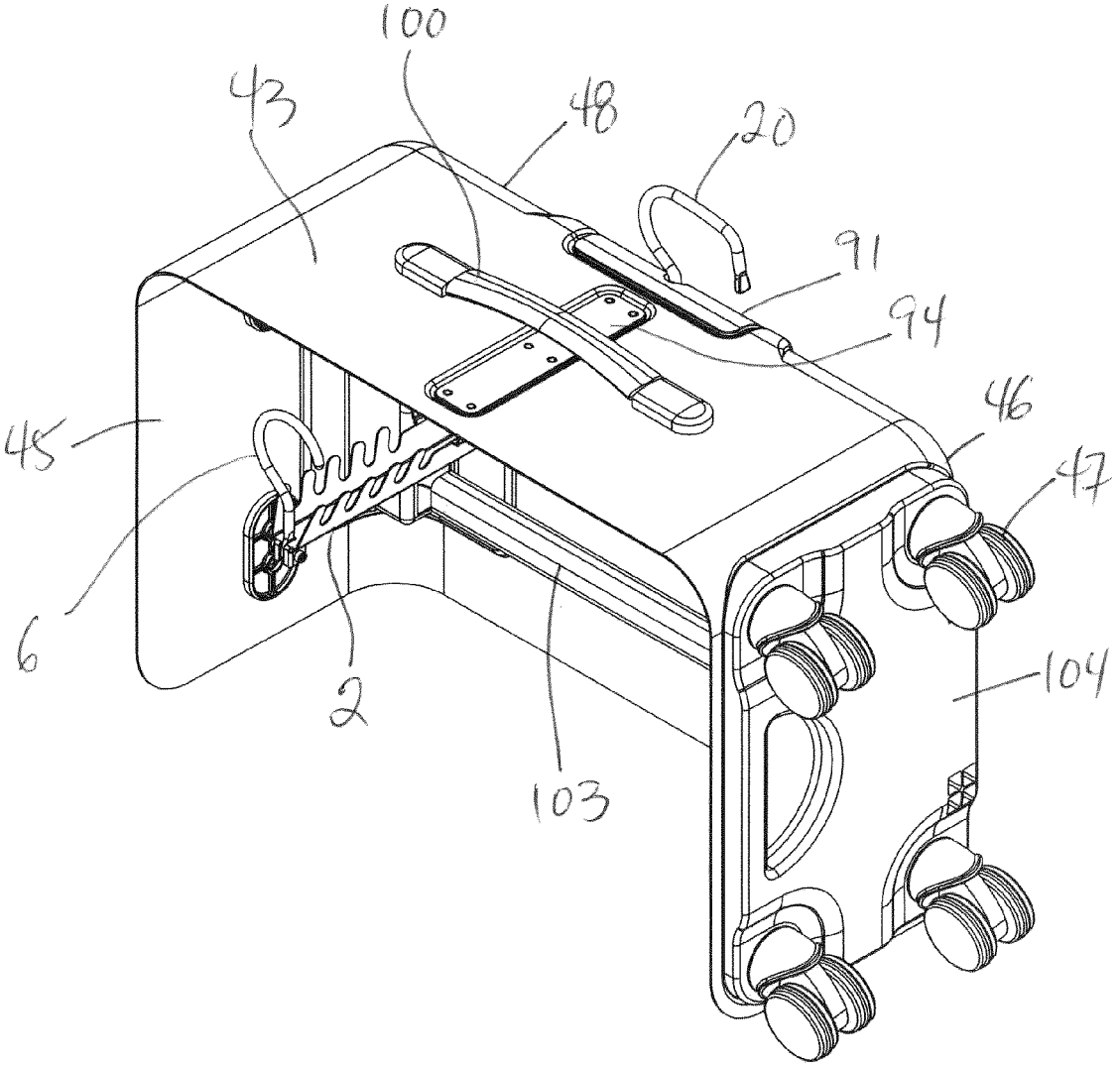
FIG. 86: A second isometric view of an embodiment of the garment hanger mechanism/system integrated into a travel bag according to the present disclosure configured as a slider system with a trough shaped member portion (closet mode, open).
Figure 87:
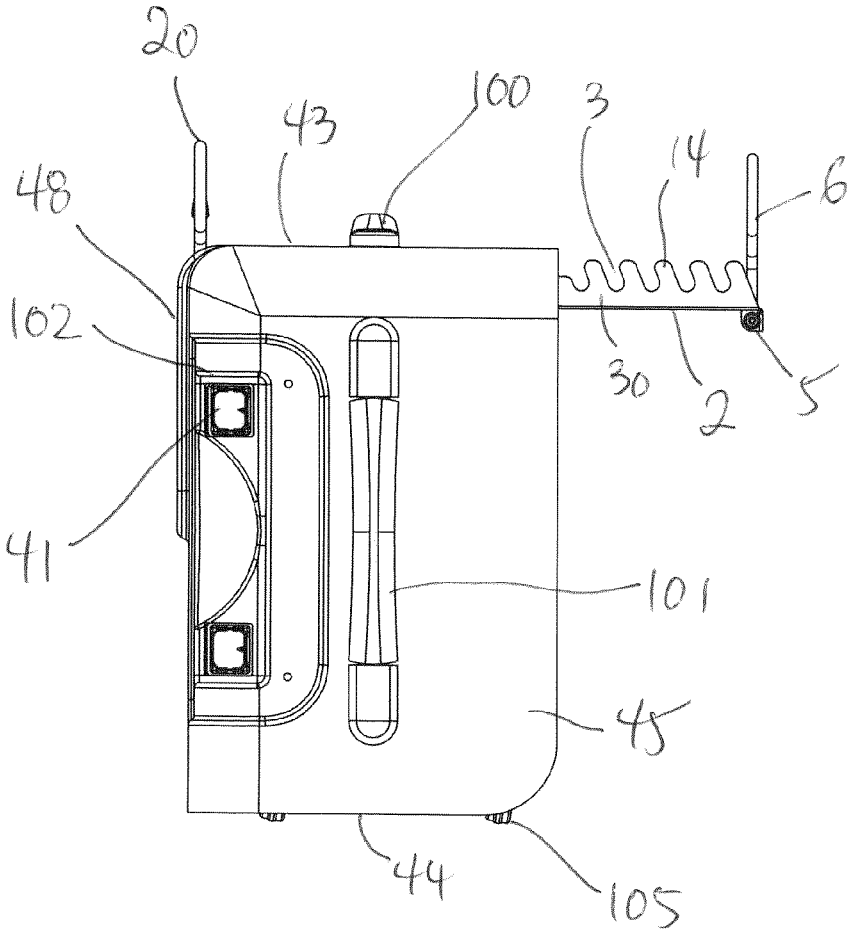
FIG. 87: A side view of an embodiment of the garment hanger mechanism/system integrated into a travel bag according to the present disclosure configured as a slider system with a trough shaped member portion (closet mode, open).
Figure 88:
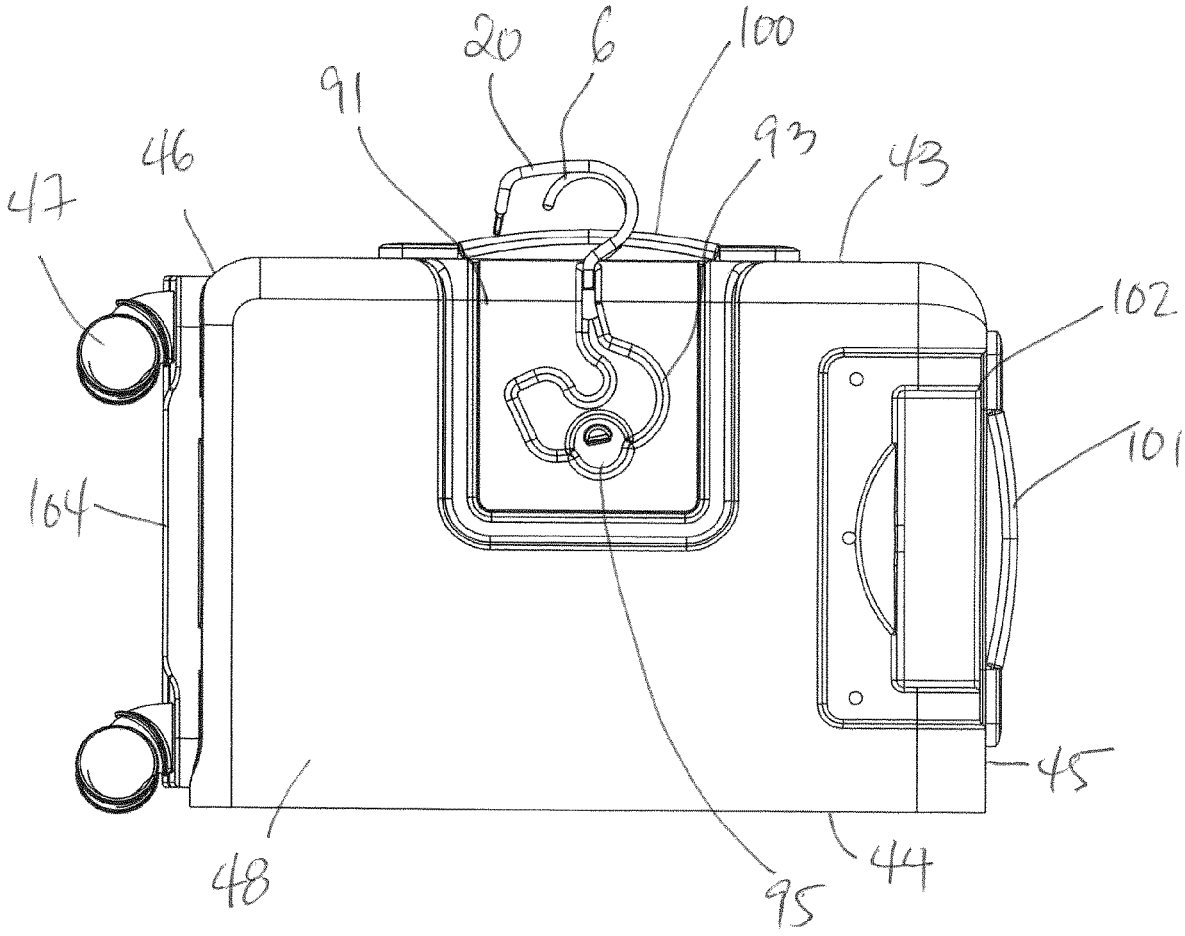
FIG. 88: A back view of an embodiment of the garment hanger mechanism/system integrated into a travel bag according to the present disclosure configured as a slider system with a trough shaped member portion (closet mode, open).
Figure 89:
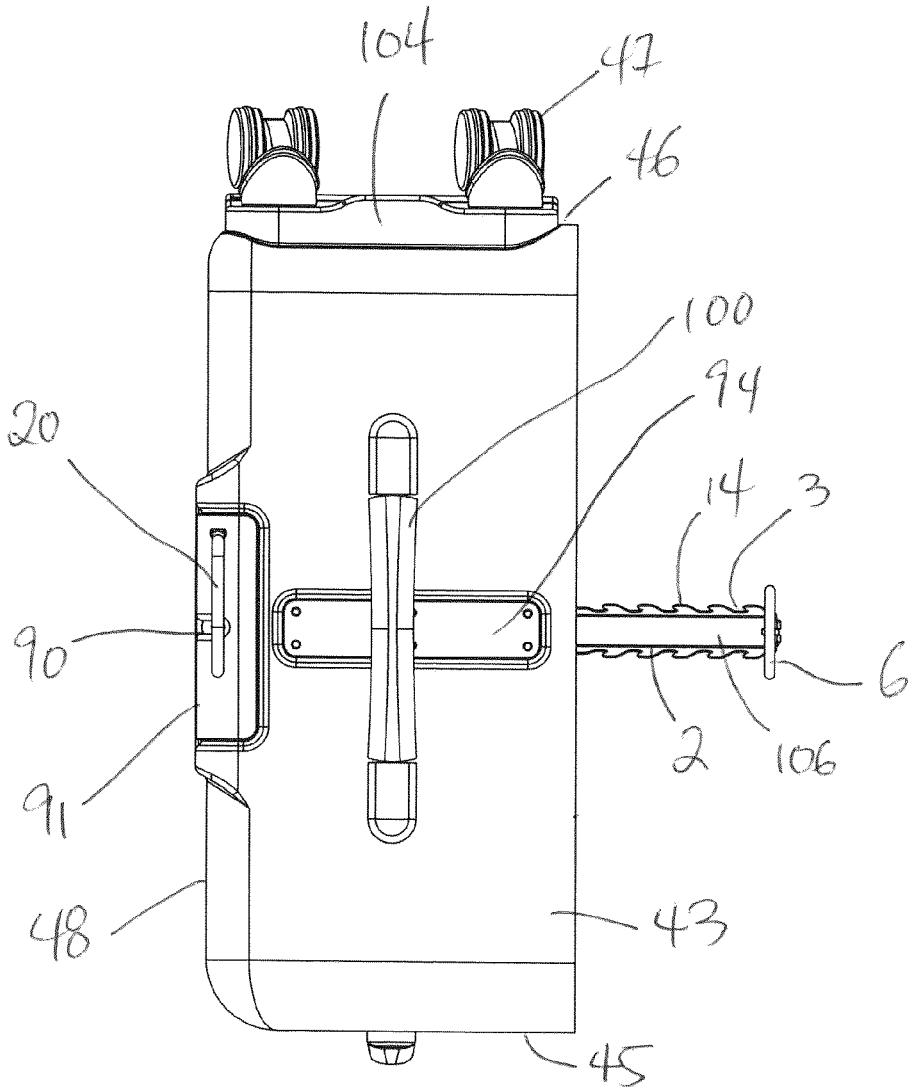
FIG. 89: A top view of an embodiment of the garment hanger mechanism/system integrated into a travel bag according to the present disclosure configured as a slider system with a trough shaped member portion (closet mode, open).
Figure 90:
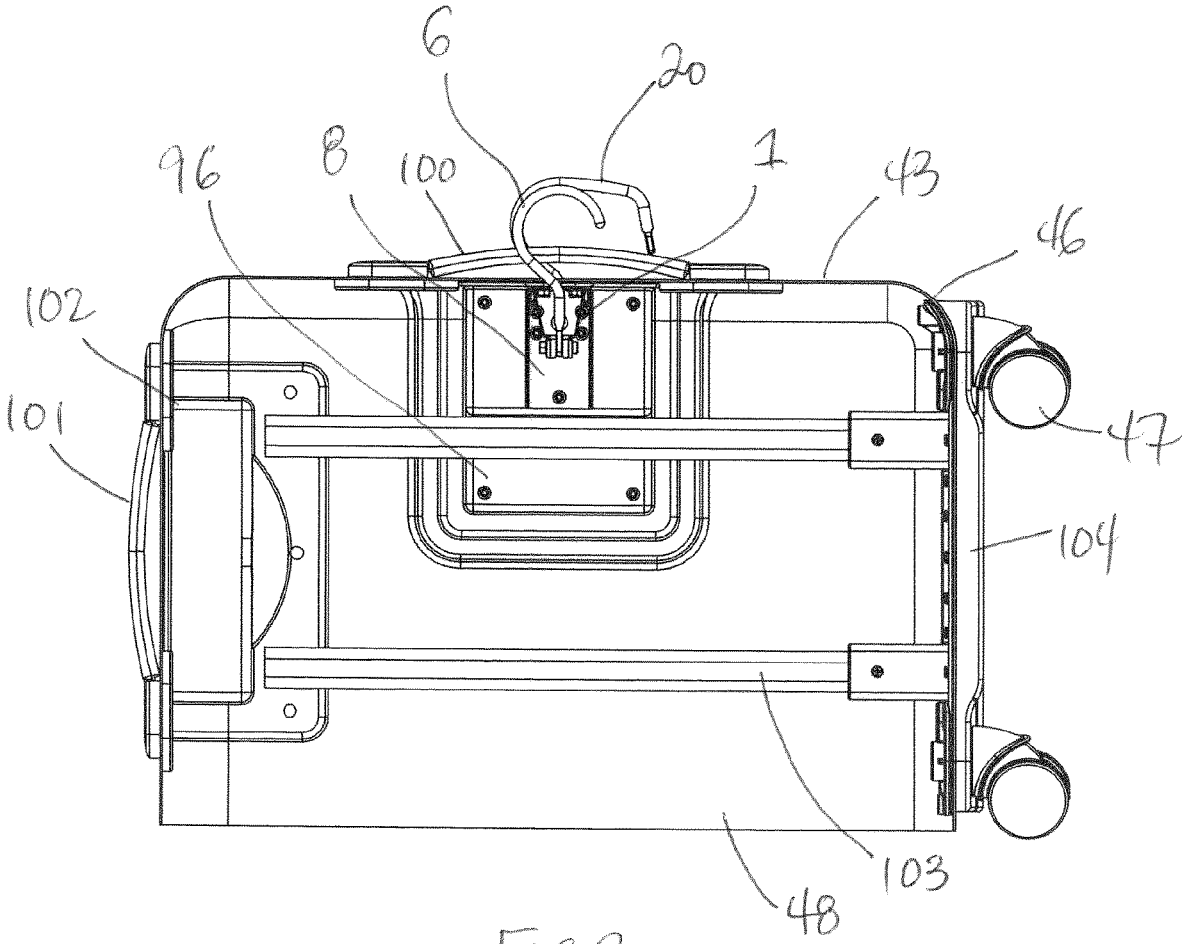
FIG. 90: A front view of an embodiment of the garment hanger mechanism/system integrated into a travel bag according to the present disclosure configured as a slider system with a trough shaped member portion (closet mode, open).
Figure 91:
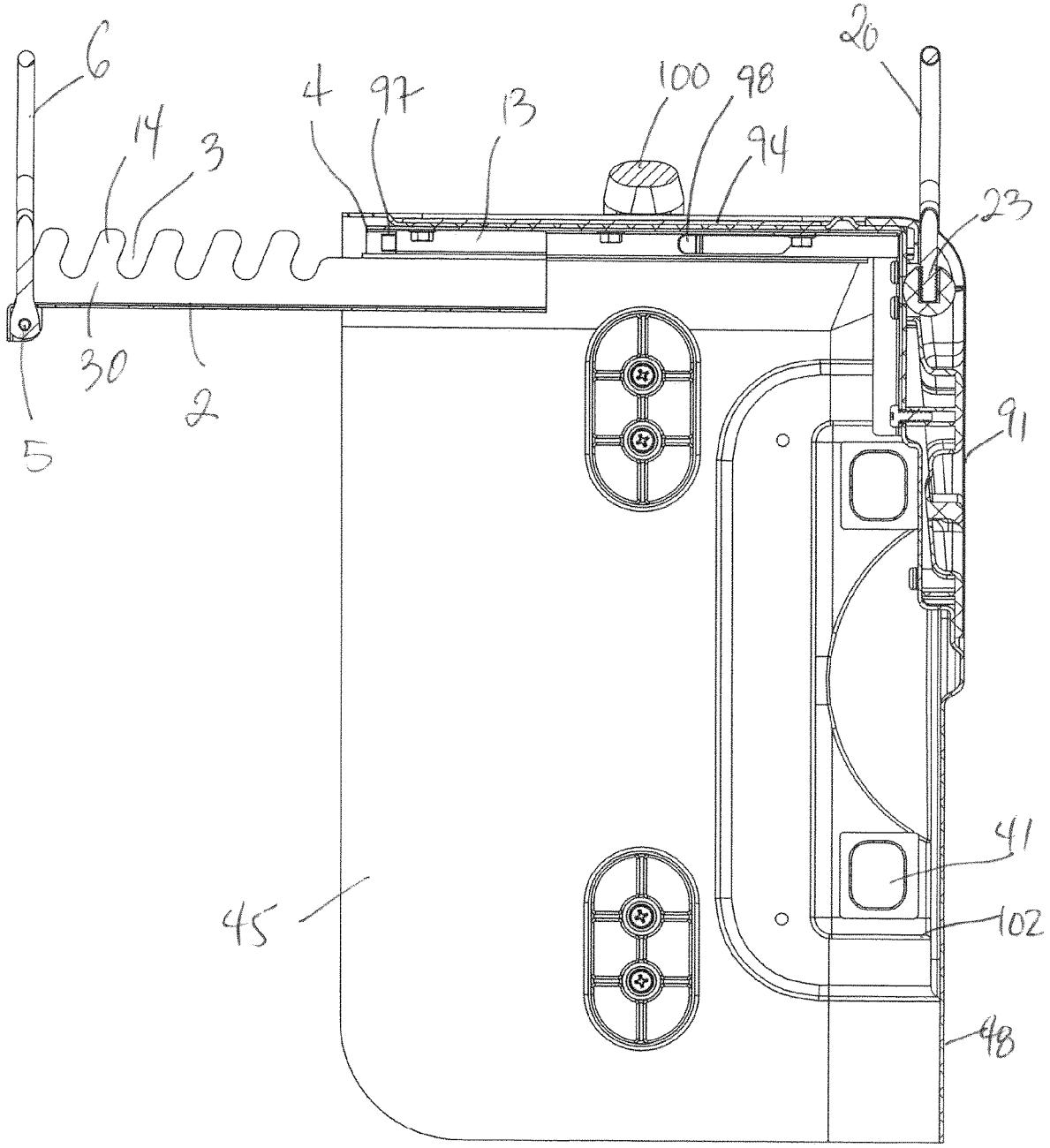
FIG. 91: A cross-section side view of an embodiment of the garment hanger mechanism/system integrated into a travel bag according to the present disclosure configured as a slider system with a trough shaped member portion (closet mode, open).
Figure 92:
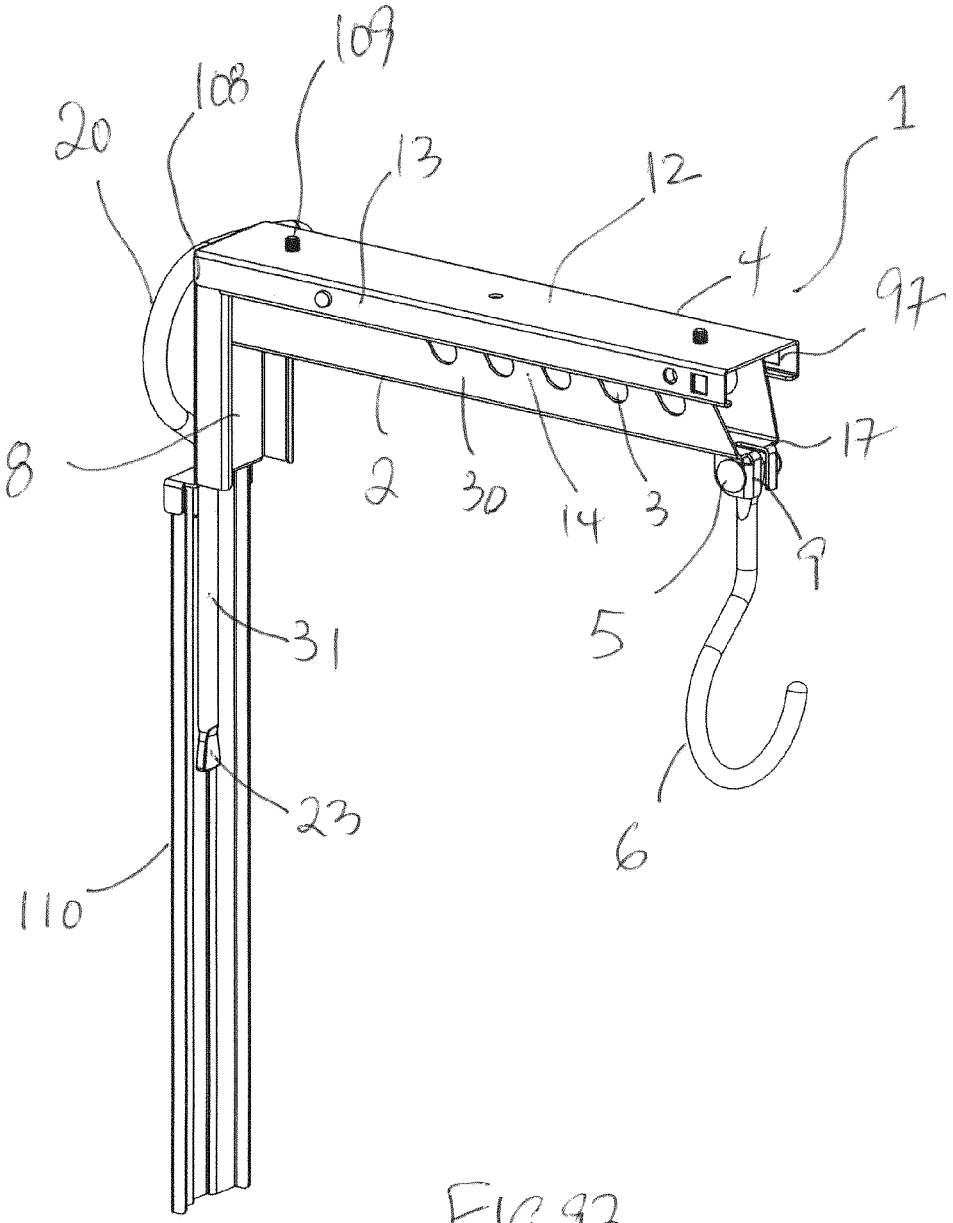
FIG. 92: A first isometric view of another embodiment of the garment hanger mechanism/system according to the present disclosure configured as a slider system with a trough shaped member portion (travel mode, closed).
Figure 93:
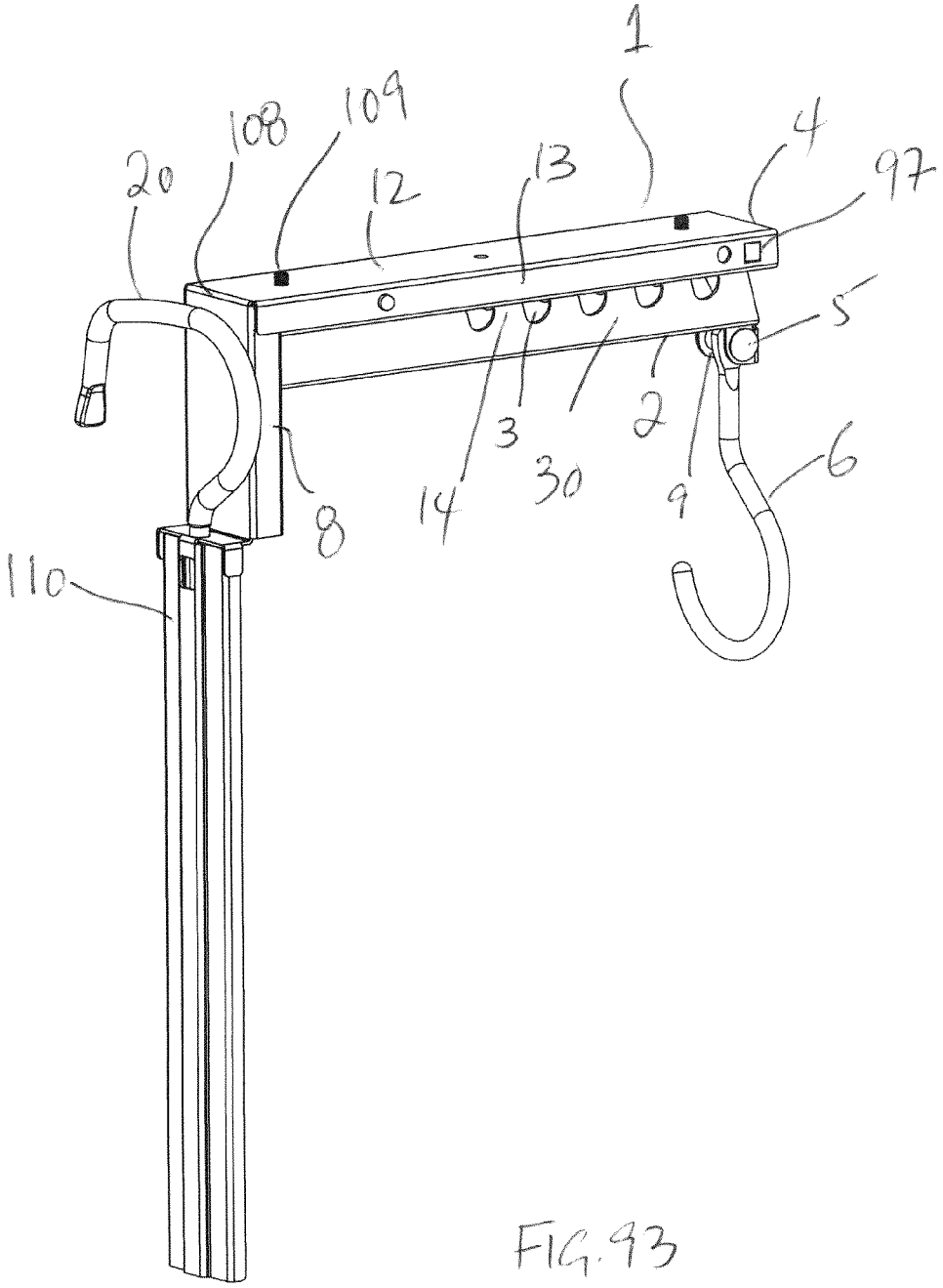
FIG. 93: A second isometric view of another embodiment of the garment hanger mechanism/system according to the present disclosure configured as a slider system with a trough shaped member portion (travel mode, closed).
Figure 94:
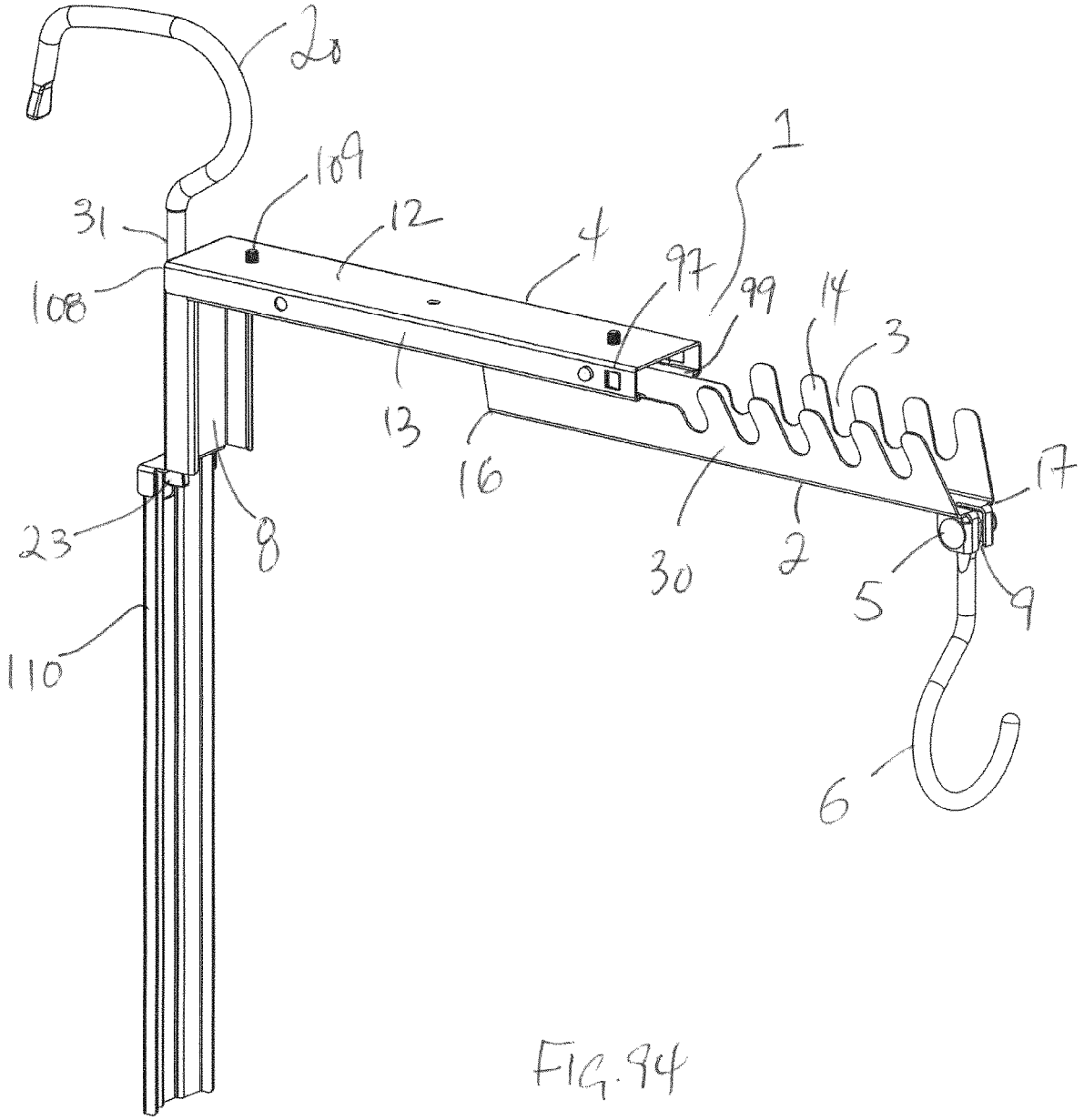
FIG. 94: A third isometric view of another embodiment of the garment hanger mechanism/system according to the present disclosure configured as a slider system with a trough shaped member portion (door mode, open).
Figure 95:
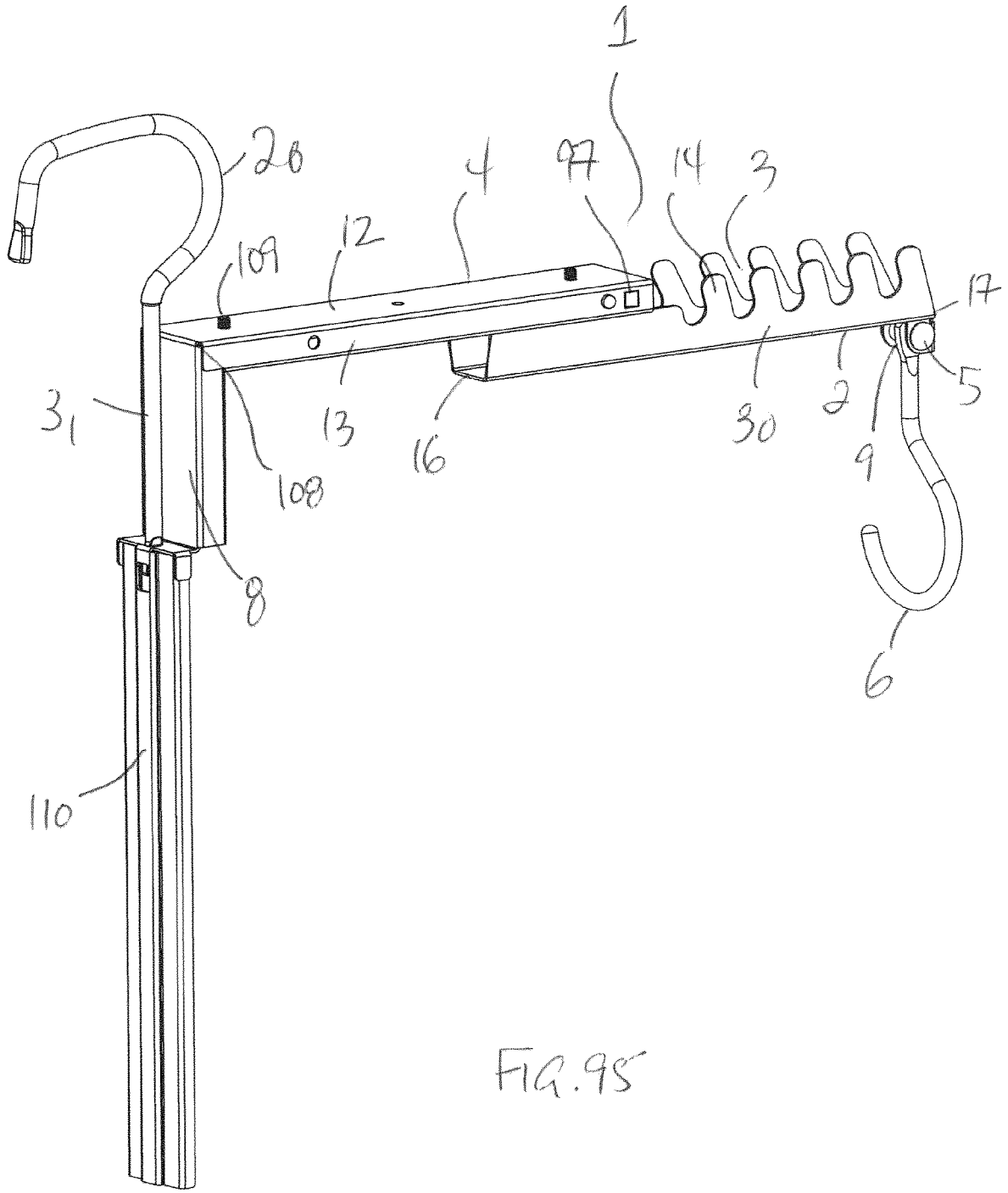
FIG. 95: A fourth isometric view of another embodiment of the garment hanger mechanism/system according to the present disclosure configured as a slider system with a trough shaped member portion (door mode, open).
Figure 96:
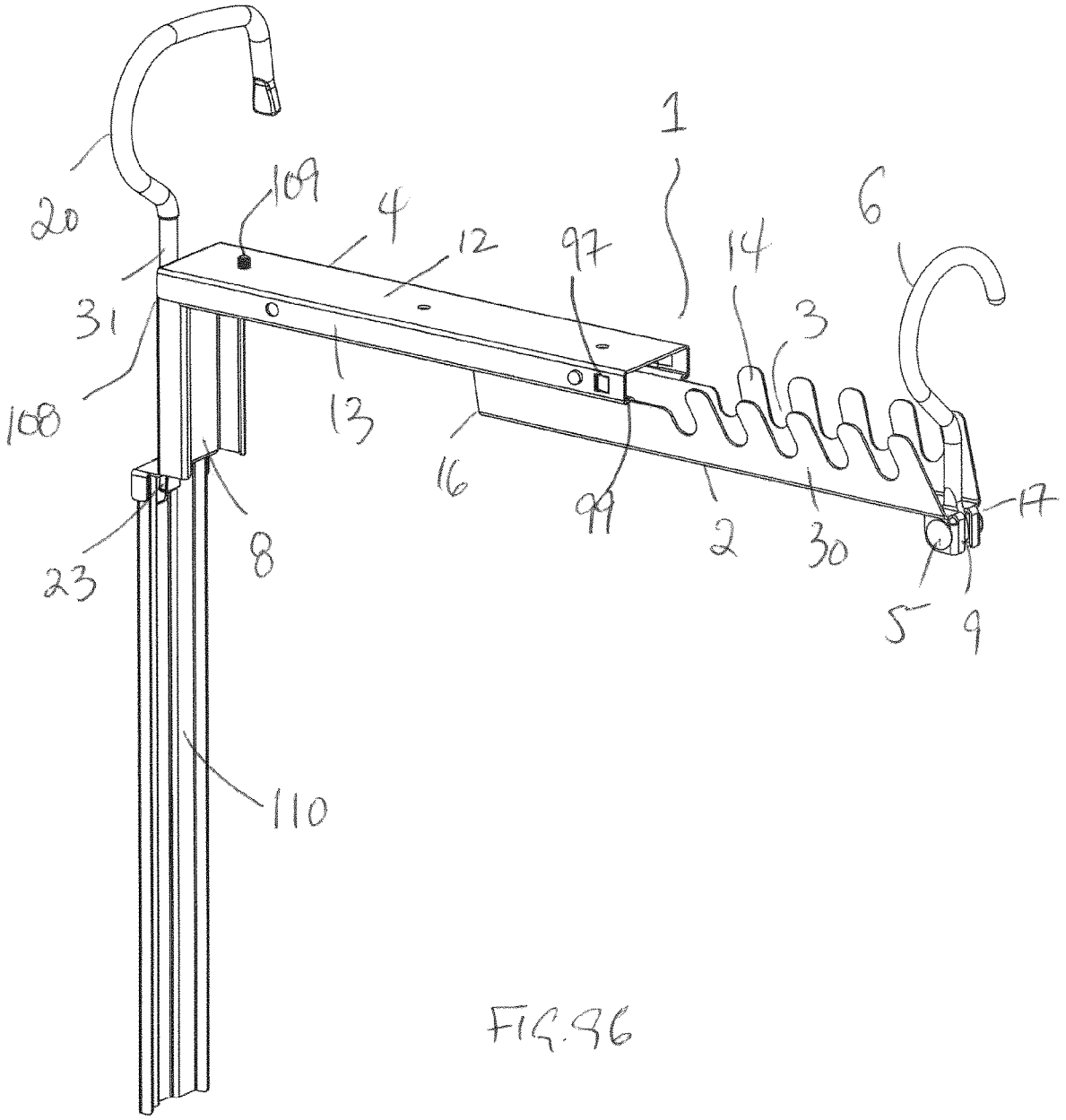
FIG. 96: A fifth isometric view of another embodiment of the garment hanger mechanism/system according to the present disclosure configured as a slider system with a trough shaped member portion (closet mode, open).
Figure 97:
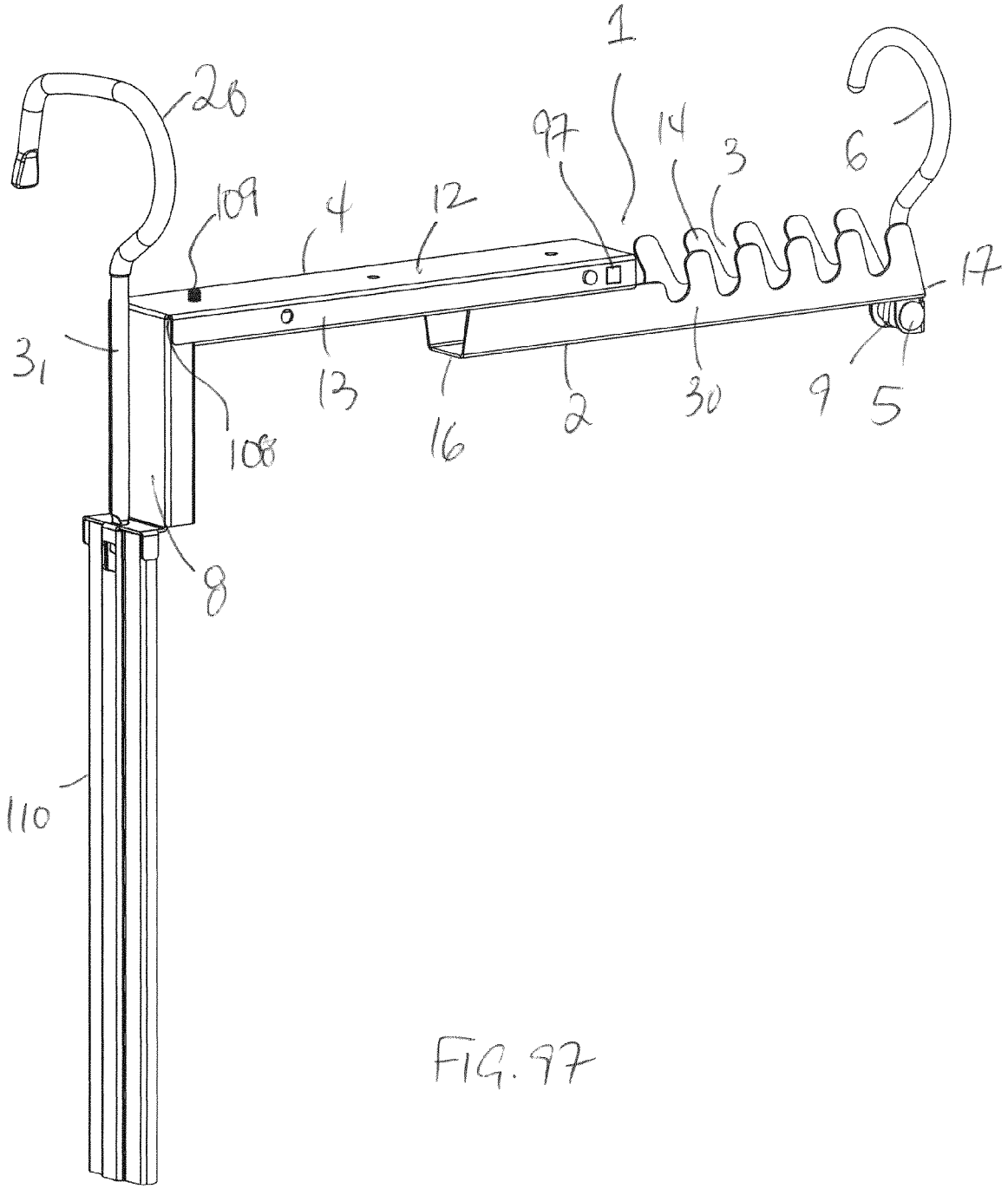
FIG. 97: A sixth isometric view of another embodiment of the garment hanger mechanism/system according to the present disclosure configured as a slider system with a trough shaped member portion (closet mode, open).
Figure 98:
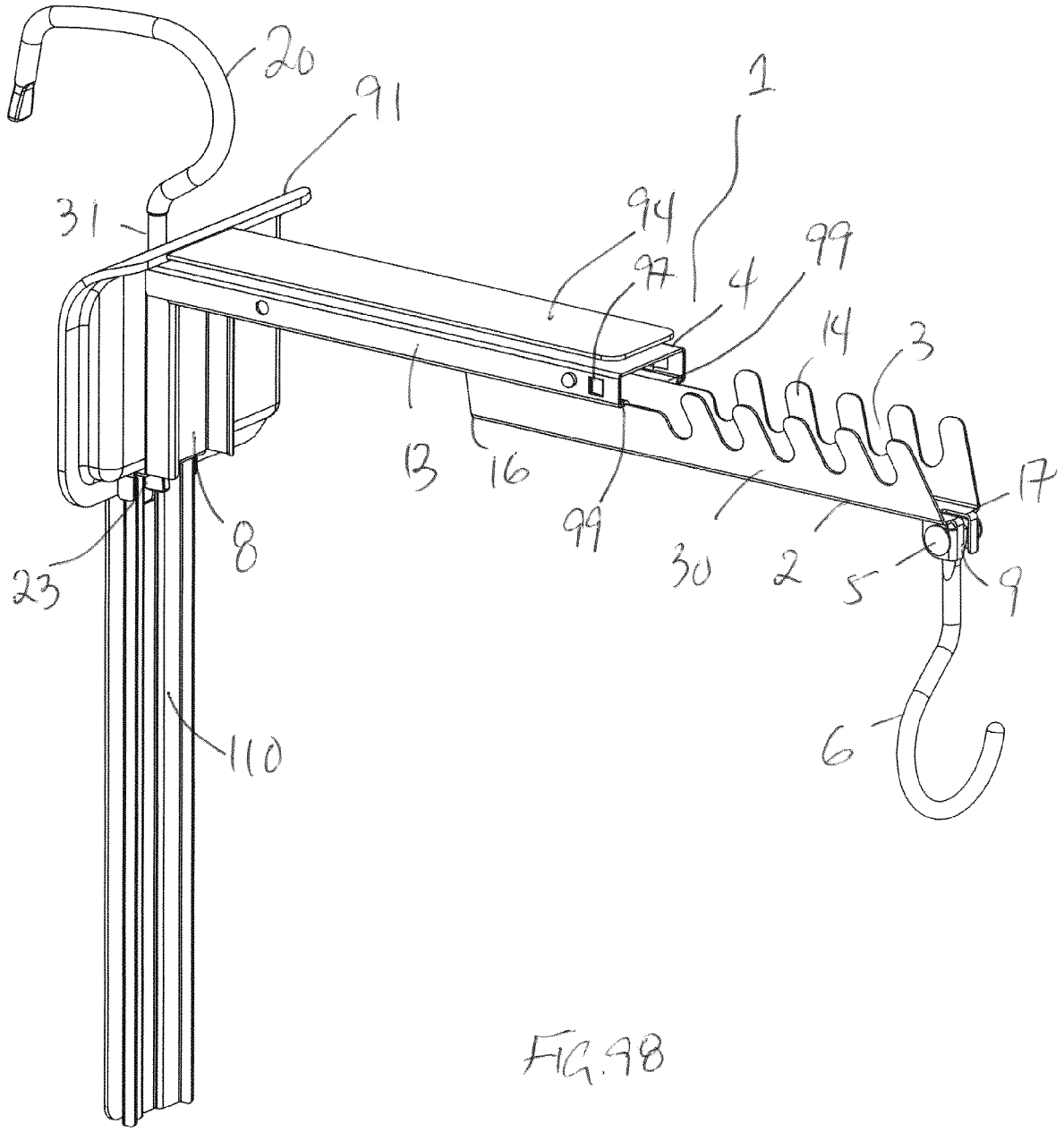
FIG. 98: A seventh isometric view of another embodiment of the garment hanger mechanism/system according to the present disclosure configured as a slider system with a trough shaped member portion, comprising an alternative stowing compartment for the bag hanging means (door mode, open).
Figure 99:
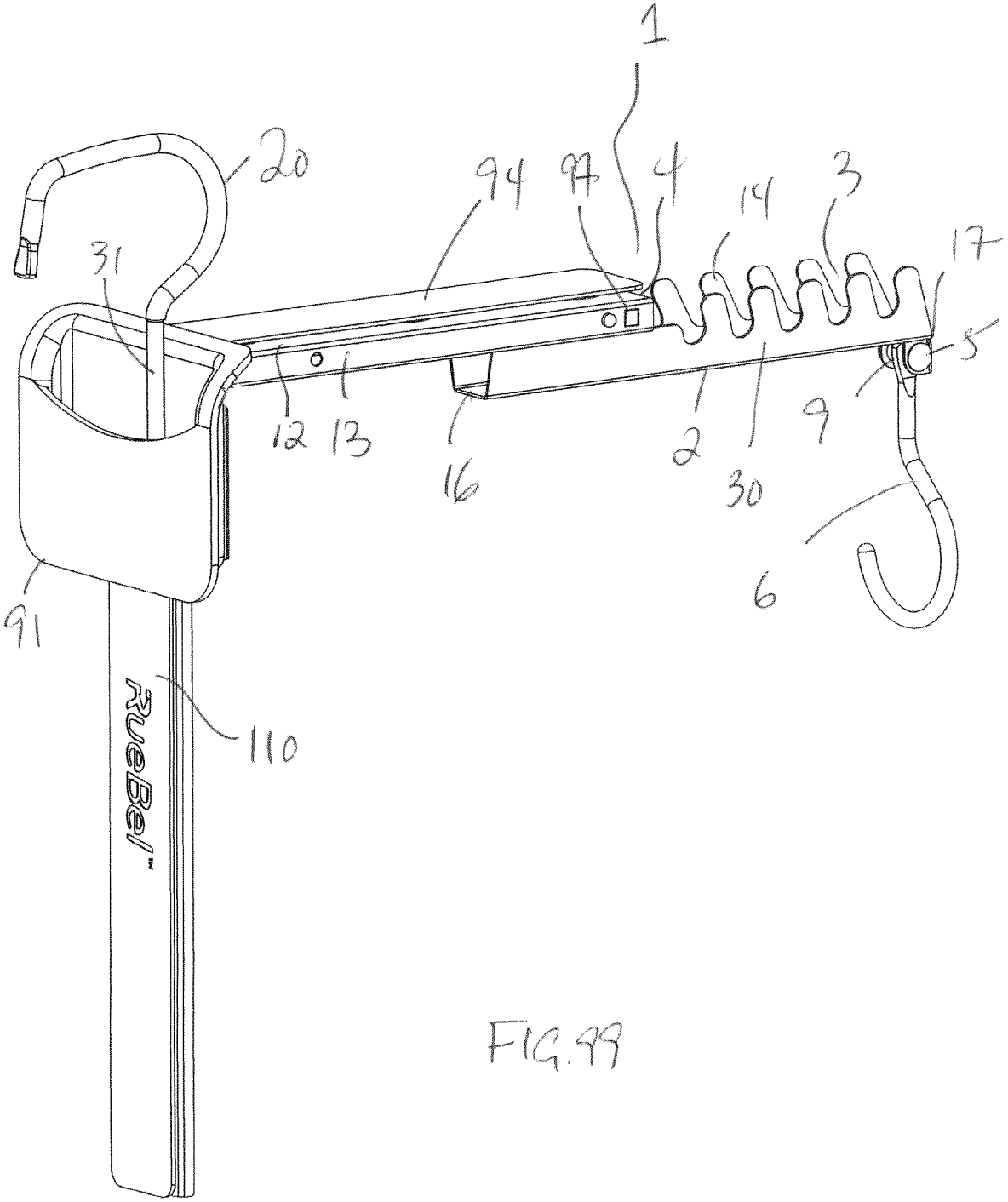
FIG. 99: An eighth isometric view of another embodiment of the garment hanger mechanism/system according to the present disclosure configured as a slider system with a trough shaped member portion, comprising an alternative stowing compartment for the bag hanging means (door mode, open).
Figure 100:
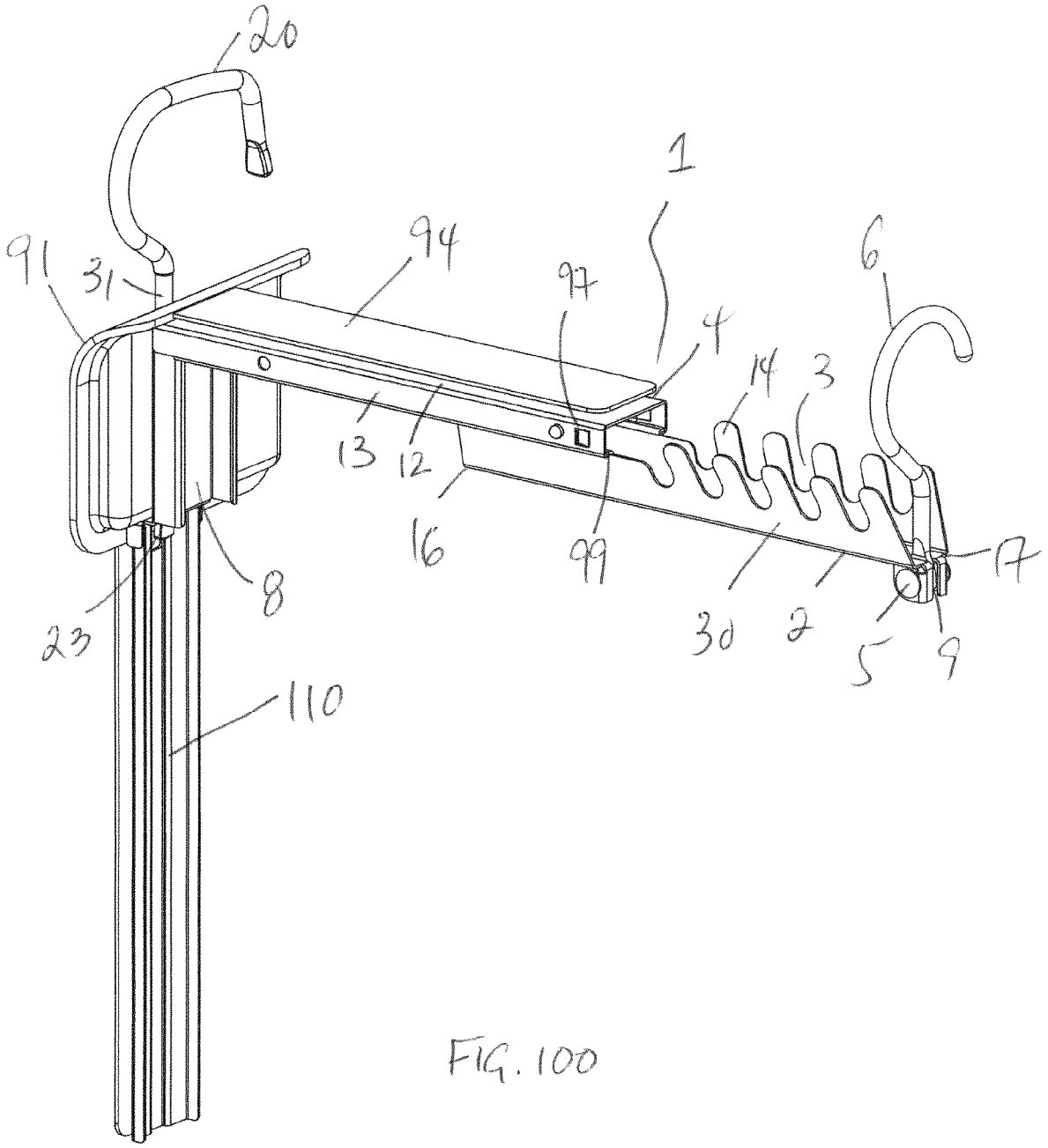
FIG. 100: A ninth isometric view of another embodiment of the garment hanger mechanism/system according to the present disclosure configured as a slider system with a trough shaped member portion, comprising an alternative stowing compartment for the bag hanging means (closet mode, open).
Figure 101:
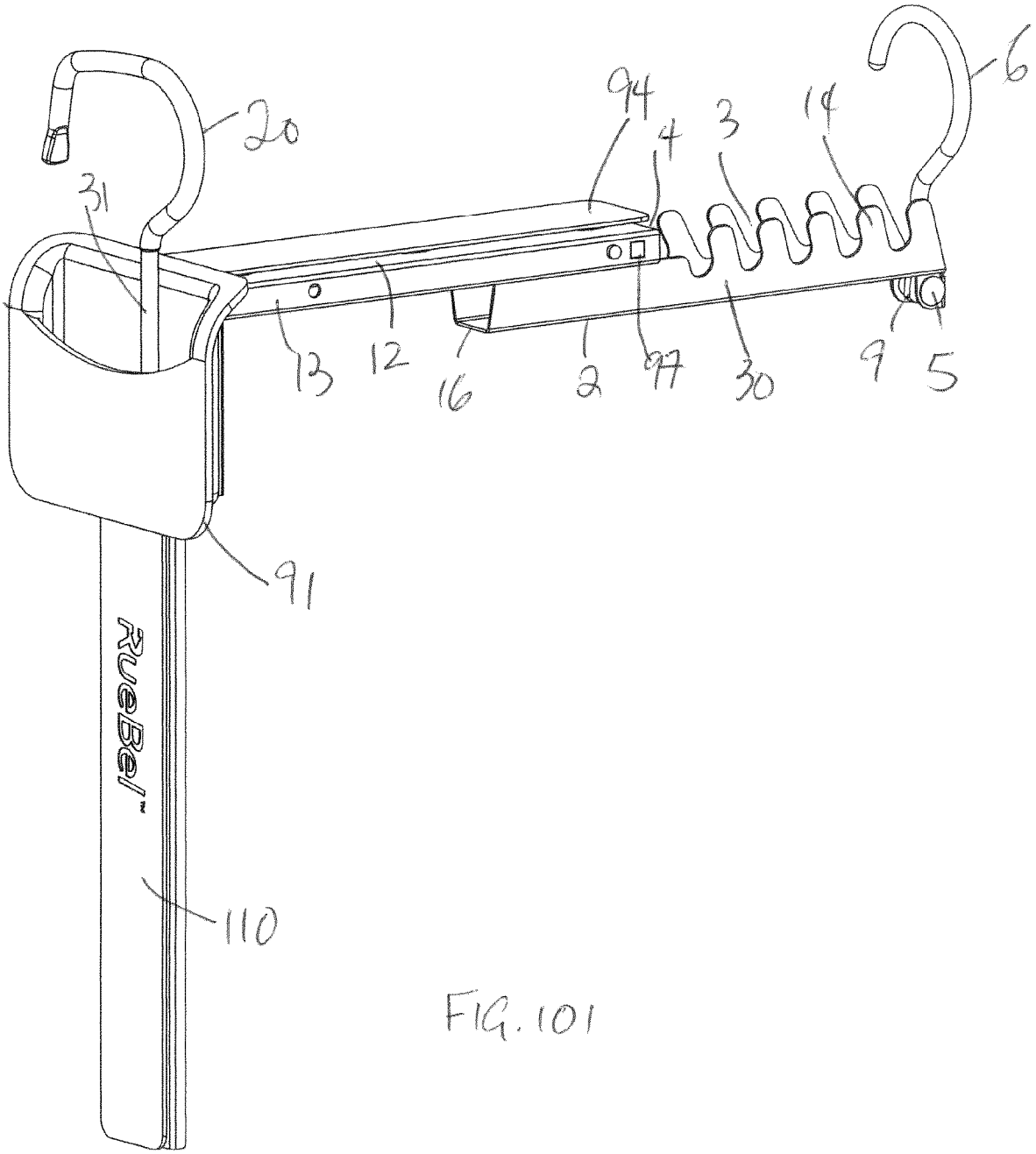
FIG. 101: A tenth isometric view of another embodiment of the garment hanger mechanism/system according to the present disclosure configured as a slider system with a trough shaped member portion, comprising an alternative stowing compartment for the bag hanging means (closet mode, open).

In an alternative embodiment the garment hanger member is attached through or integrated with the panel of a travel bag by being secured to a molded, multi-functional structure 91 as shown, for example, in FIGS. 45 to 58 and FIGS. 98-101. The structure 91 is molded to receive and stow on one side a bag hanging means 20 in the form of a hook, and receive on the other side a mounting plate/bracket 8 for the garment hanger member using screws, rivets, or bolts to secure the plate/bracket 8 to the molded structure 91 from the inside of the travel bag. In effect, once connected, the molded structure 91 and plate/bracket 8 sandwich a panel of the travel bag as shown in FIGS. 77 and 84.

In another embodiment, the garment hanger member can be articulated about an end attached to the panel of a travel bag from a packed to an unpacked position and vice versa. In a packed position, the garment hanger member is aligned parallel to, or along the surface of the panel. In an unpacked position, the garment hanger member extends away from, for example, in a substantially perpendicular orientation relative to the panel of the travel bag.

In still a further embodiment, the garment hanger member may comprise two member portions connected in series using pivoting or articulating means to allow the two member portions to fold in a side by side configuration, such that the openings of the recesses defined by the projections are effectively obstructed. In this way, each member portion functions as the securing means for hangers received in the recesses of the other member portion when the garment hanger mechanism is in a collapsed or packed (stowed) state within a travel bag.

Securing Means

The garment hanger mechanism comprises a securing means connectable or connected to the member portion of the garment hanger member. The securing means is configured to be selectively (mechanically) engaged with and disengaged from the member portion of the garment hanger member. When engaged, the securing means functions as an impediment or barrier over the openings of the recesses of the member portion to secure clothes hangers in said recesses. When the securing means is disengaged from the member portion, clothes hangers can be readily removed from the openings of the recesses.

The securing means may or may not function as a feature of the garment hanger member providing support functionalities and/or facilitating the attachment of the garment hanger member to the travel bag. In one embodiment, the securing means is permanently connected to the member portion of the garment hanger member when engaged and disengaged from securing clothes hangers in the recesses of the member portion. In another embodiment the securing means is connected to a mounting plate or a board used to attach the garment hanger member/mechanism to a panel of a travel bag. In still another embodiment the securing means is an accessory that can be completely disconnected from the garment hanger member and stored separately when the garment hanger member in an unpacked state.

In an embodiment the securing means is the hanging means used to hang the garment hanger member from a closet rod or clothes rack. In another embodiment the securing means is a bar that can be placed over the (openings of the) recesses of the member portion. In a further embodiment the securing means is a cover or lid which can be snapped on and off of the member portion.

In yet a further embodiment, projections defining and separating the recesses of the member portion extend upwards from the bottom and from one side of the member portion and form a lip that extends laterally across the width of to the other side of the member portion. In this instance, the securing means is provided as a spring loaded bar that can be snapped under the lip portions of said projections to secure hangers in the recesses of the member portion.

In yet another embodiment the securing means is a support arm slider rail as shown in FIGS. 3-23 which functions as a structural support for the member portion of the garment hanger member.

The member portion and support arm of the garment hanger member are configured to be retracted towards (engaged) and extended away (disengaged) from one another. When the garment hanger member is in an extended or expanded state, hanging garments may be easily accessed from the travel bag.

In one embodiment, the member portion retracts towards and extends away from the back side of the travel bag opposite from the where the travel bag is opened. This configuration facilitates the telescoping action of the member portion from a retracted (e.g. when packed) to an extended (e.g. when unpacked) position and vice versa. In the retracted position the support arm prevents the removal of clothes hangers from the spaced recesses of the member portion and in the extended position clothes hangers in the recesses of the member portion may be removed. In this manner, the support arm and member portion (hanger slider)

of the garment hanger member form a slider system. As described in the Examples, the slider rail of such a slider system may be locked into different positions relative to the hanger slider when retracted or extended relative to one another.

In an alternative embodiment of a slider system configuration, the support arm retracts towards and extends away from the point of attachment of the garment hanger member to the panel of the travel bag.

The slider rail of a garment hanging member according to the present disclosure may be attached to the travel bag at one end, at its top surface and in other embodiments at both an end and it top surface. As shown in FIGS. 77 and 84, this can be facilitated by different mounting structures such as structure 91, plate/bracket 8 and plate 94. As further shown in FIGS. 92 to 101, the fixation of one end of the garment hanger member to one panel and the top surface via screws 109 to another panel can be done to create a durable type of L-shaped support system 108.

Mechanism Hanging Means

A mechanism hanging means is connected to the (free) end of the garment hanger member opposite the end which is attachable to the panel of a travel bag. The mechanism hanging means is used for hanging the garment hanger member in a closet or from a clothes rack. In one embodiment the mechanism hanging means (e.g. a hook) can be articulated using suitable nut and bolt hardware from an inactive (packed) to an active (unpacked) position so that it can be used to hang the garment hanger member. In another embodiment the mechanism hanging means may be attachable and detachable from the rest of garment hanger member.

In one embodiment, the bag hanging means is a hook with a stem portion and hook portion. The stem and hook portions may be constructed as one continuous structure from suitable materials such as metals (e.g. steel rod/wire), resins and durable plastics. Alternatively, the stem and hook portions may be two connected structures such as a chain for the stem portion and metal wire for the hook portion.

Constructing a hook using two or more connecting structures provides various options for adjusting the effective hook length according to the desired application, e.g. hanging the garment hanger member at different distances below a closet rod. Similarly, the hook portion can be shaped to be more or less curved, squared off, etc., so that it can be used more securely with the structure from which the garment hanger member will be hung.

In one embodiment the mechanism hanging means may be deployed by interchangeably coupling different stem and hook portions with one another. In another embodiment, the mechanism hanging means may be attachable to the garment hanger member at different points (e.g. using a clip-in feature to the free end of the member portion or at a point midway along its length). In this way, all parts of the mechanism bag hanging means may also be detached from the garment hanger member and stowed in a compartment for travel.

In one embodiment the stem portion of the mechanism hanging means is a chain. In another embodiment, the stem portion of the mechanism hanging means is a substantially rigid rod. In still another embodiment the stem portion of the mechanism hanging means may be extended and secured at different points along its length in order to adjust the positioning of the garment hanger member relative to a closet rod or clothes rack. In yet another embodiment, the hook portion of the mechanism hanging means is connectable at different points along the length of the stem portion to adjust the positioning of the garment hanger member relative to a closet rod or clothes rack.

In one embodiment, the mechanism hanging means is permanently attached to the free end of the garment hanging member. The stem portion of the mechanism hanging means may be of a variable length, spanning a portion or, substantially, the full length of the garment hanger member when in a stowed position. In another embodiment (as exemplified in FIGS. 1 and 2) the end of the stem portion may have a bent portion 67 that is looped to pass through a channel formed at the free end of the garment hanger member through a channel or hole(s) to function as an articulating pin 68.

In a related embodiment the length of the stem portion 27 of the hook 6 is long enough to function as a bar-like securing means over recesses 3 of the member portion 2 when the hook 6 is in an inactive or stowed position. The hook portion 28 is clipped around a projection at the end 16 of the member portion 2 that is connected to the mounting plate 8 (see FIGS. 1A-1D). When the mechanism hanging means is in an active, unpacked or deployed position it is lifted away from the member portion of the garment hanger member and the barrier over the recesses is removed (see FIGS. 2A-2E).

Figure 102:
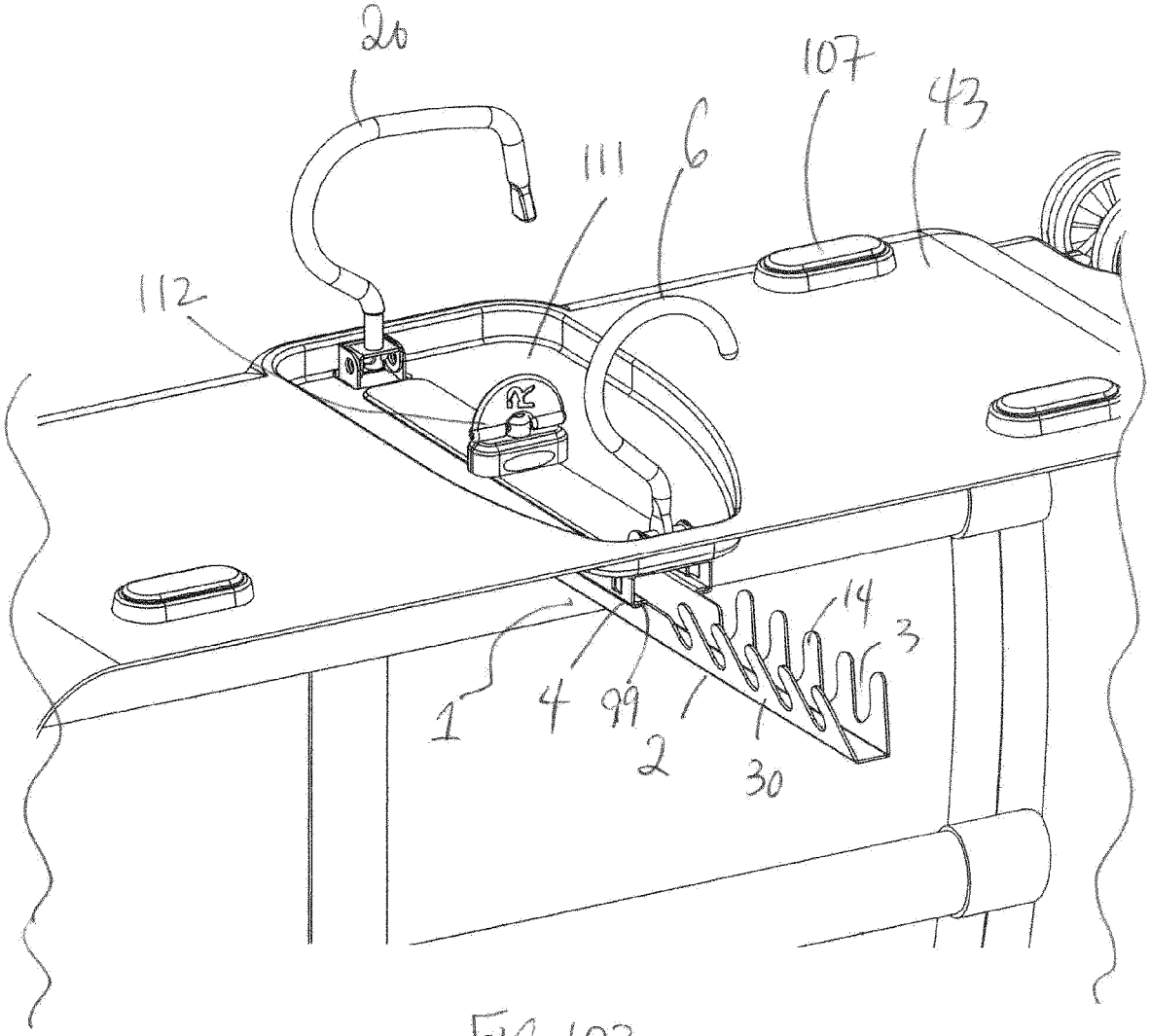
FIG. 102: A first isometric view of a further embodiment of the garment hanger mechanism/system integrated into a travel bag according to the present disclosure configured as a slider system with a trough shaped member portion, comprising an alternative stowing compartment for the bag hanging means and mechanism hanging means (closet mode, open).
Figure 104:
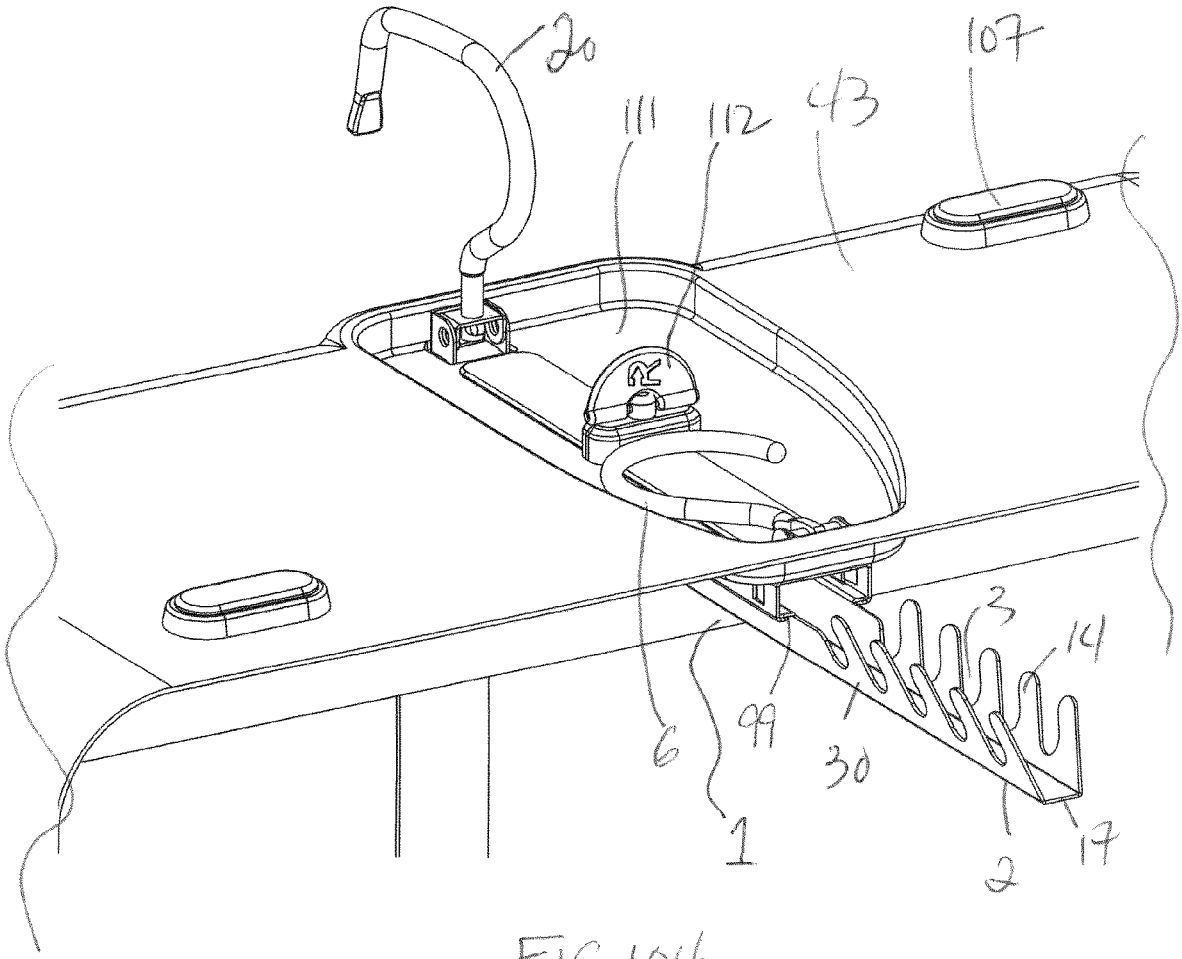
FIG. 104: A second isometric view of a further embodiment of the garment hanger mechanism/system integrated into a travel bag according to the present disclosure configured as a slider system with a trough shaped member portion, comprising an alternative stowing compartment for the bag hanging means and mechanism hanging means (door mode, open).

In another embodiment, as shown in FIGS. 102 and 104, the mechanism hanging means 6 can also be positioned at the free end of a slider rail 4 supporting the garment hanger mechanism 1 at a mid-point in its structure when hanger slider 2 is fully extended. In this configuration, the hanging means is stowed in a compartment 111 together with a bag hanging means 20. The two hooks can be secured in the compartment 111 with a rotating clip means 112.

Garment Hanger System

When the garment hanger mechanism is operatively combined with a travel bag hanging means, a garment hanger system is formed that can be integrated into a travel bag to allow the bag to function as a temporary (travel) closet for efficiently unpacking and accessing hanging apparel from the travel bag. Structural supports, such as one or more mounting and channel forming guide structures, facilitate the integration of the bag hanging means and garment hanger mechanism into a travel bag, for the bag to also function as a travel closet.

The positioning of the bag hanging means must be functionally close to the mechanism hanging means. Various relative positions for the two hanging means are contemplated to be within the scope of this disclosure, provided the two hanging means are in close enough proximity to one another based on their dimensions and individual constructions to support both a travel bag in a hanging position and a garment hanger mechanism integrated into the travel bag in a horizontal orientation when in an extended state. When the mechanism hanging means is attached to the garment hanger member/mechanism, the bag hanging means may or may not be attached to the same panel of the travel bag. In one embodiment, the bag hanging means is attached to the same panel of a travel bag as the garment hanging member. In another embodiment, the bag hanging means is attached to a different or distinct panel of a travel bag than the garment hanging member.

The bag hanging means will typically be in the form of a hook comprising a stem portion and hook portion. In one embodiment, the stem and hook portions are constructed as one continuous structure from suitable materials such as metals (e.g. steel rod/wire), resins and durable plastics. Alternatively, in another embodiment, the stem and hook portions are constructed of two connected structures such as a chain for the stem portion and metal wire for the hook portion.

Constructing a hook using two or more connecting structures provides various options for adjusting the effective hook length according to the desired application, e.g. hanging the bag from a door or from a closet rod. Similarly, the hook portion can be shaped to be more or less curved, squared off, etc., so that it can be used more securely with the structure from which the travel bag will be hung. For example, a hook such as the one depicted in FIGS. 13 to 23 with curved and squared off aspects to the hook portion design allows the travel bag to be hung securely from both a door and closet rod.

In one embodiment the hook used as a bag hanging means may be deployed by interchangeably coupling different stem and hook portions with one another. In another embodiment, the hook used as a bag hanging means may be attachable to a travel bag at different points (e.g. to an external or internal bag panel face depending on the desired application or format for hanging the travel bag). In this way, all parts of the hook used as a bag hanging means may also be detached from the travel bag and stowed in a compartment for travel.

In one embodiment the stem portion of the hook used as a bag hanging means is a chain. In another embodiment, the stem portion is a substantially rigid rod. In still another embodiment the stem portion may be extended and secured at different points along its length, in order to adjust the positioning of the travel bag relative to the top of a door or closet rod. In yet another embodiment, the hook portion of the hook used as a bag hanging means is connectable at different points along the length of the stem portion to adjust the positioning of the travel bag relative to the top of a door or closet rod.

The bag hanging means may be attached to the travel bag using a variety of structures, such as mounting plates, molded plastic compartments, guide rails, clips and the like. In one embodiment the bag hanging means is a hook mounted to the same board as the garment hanger mechanism (see FIGS. 24 to 27). In this configuration, the board functions as an interface between the bag hanging means and garment hanger mechanism. In one variation the bag hanging means is mounted on a face of the board opposite the face the garment hanger mechanism is mounted on. In another variation, the bag hanging means is mounted on the same face of the board as the garment hanger mechanism.

In another embodiment, the mounting structures for each of bag hanging and mechanism hanging means are attached to each other through a travel bag panel, which itself has some structural rigidity, as in the case or travel bag made of a harder shell design using polycarbonate or acrylonitrile butadiene styrene (ABS) material.

In yet another embodiment the bag hanging means is connected to the garment hanger member proximal to the board mounted end of the garment hanger member. The bag hanging means may be attached to the garment hanger member mounting plate, member portion or to a support arm.

In a further embodiment, as shown in FIGS. 92 to 101, the stem portion 31 of the bag hanging means 20 is housed in a channel formed by an extended encasement structure 110 positioned in tandem from the plate/bracket 8, which attaches the garment hanger member 1 to the housing structure 91 for the bag hanging means 20.

Travel Bag with Garment Hanger System and Applications

The garment hanger system of the present disclosure is integrated into a travel bag in order to provide various packing and unpacking functionalities and allow the travel bag to be converted into a travel closet. In general, travel bags suitable for integrating the garment hanger system are bags or cases that can be unfolded and folded from a closed to open state, and in which it is desirable to have garment hanging capabilities.

Travel Bag

A travel bag suitable for integrating the garment hanger mechanism/system of the present disclosure will be a bag that can be folded for travel and unfolded to a required degree to allow for the bag to be hung from a door or in a closet and provide for ready access to hung apparel. Suitable bags will generally have prismatic configurations when closed for travel.

In one embodiment, the garment hanger system is integrated into a foldable, multi-panel travel bag. The size of the travel bag when open must be small enough to freely hang from a standard door or in a closet without restrictions from the space available to access packed items (e.g. because of being too long or wide to prevent the bag from being completely extended or open). In one embodiment, the travel bag is designed such that when it is folded it meets the sizing specifications or limits for carry-on luggage set by airlines.

In another embodiment the folding panels of the travel bag are made of flexible fabric or materials. In this instance the panels must include semi-rigid or rigid elements to define distinct panels. In still another embodiment, the panels are made of semi-rigid or substantially rigid material to form a shell-like structure when folded. Materials that can be used to construct the bag panels or walls of the travel bag in this instance include, for example, ABS and polycarbonate. For both embodiments, two or more panels/walls may be fixed in a bent or angled position relative to one another in order to provide structural integrity and a prismatic shape to the travel bag when closed for travel.

As illustrated in FIGS. 28-34, when folded, a suitable travel bag will generally have an outer front 42, back 48, top 45, bottom 46 and side faces 43 and 44, with a number of features on, or accessible from the said outside faces, including for example, various zippered pockets 60 and other compartments 53; straps 50, 52; wheels 47; bumpers 51, 69, and a retractable/extendable handle 41.

Figure 35:
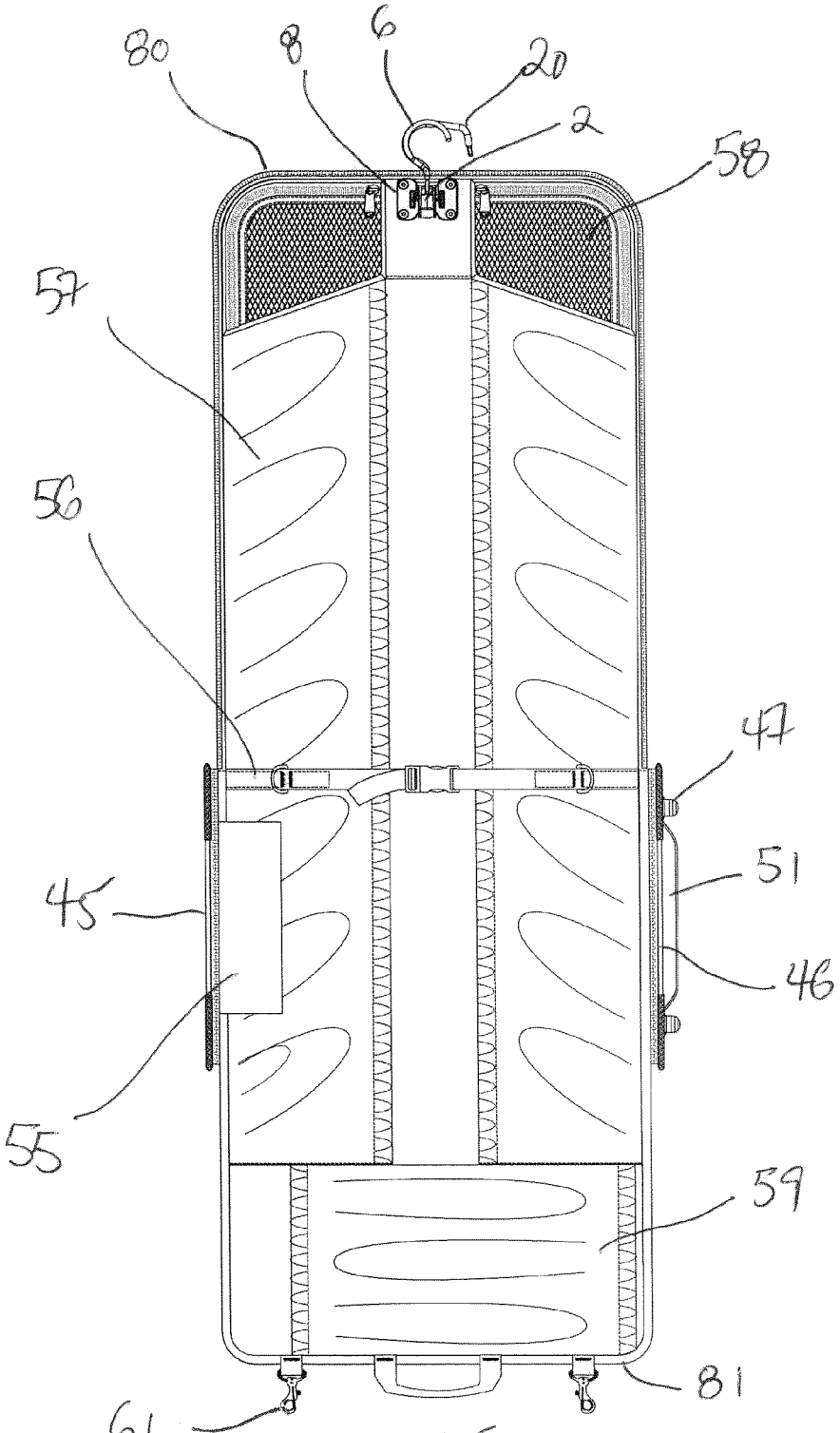
FIG. 35: A view of the inside of a multi-panel travel bag when unfolded or open, incorporating a garment hanger system according to the present disclosure, wherein the garment hanger mechanism is in an expanded state.
Figure 36:
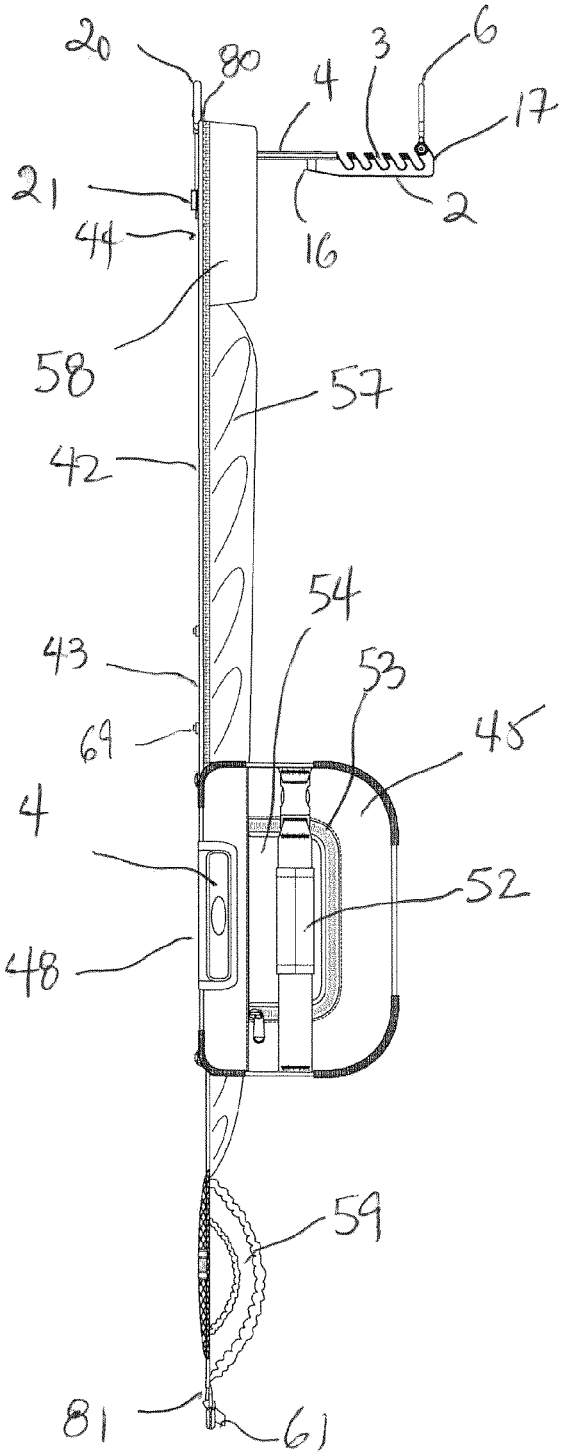
FIG. 36: A side view of a multi-panel travel bag when unfolded or open, incorporating a garment hanger system according to the present disclosure, wherein the garment hanger mechanism is in an expanded state.
Figure 37:
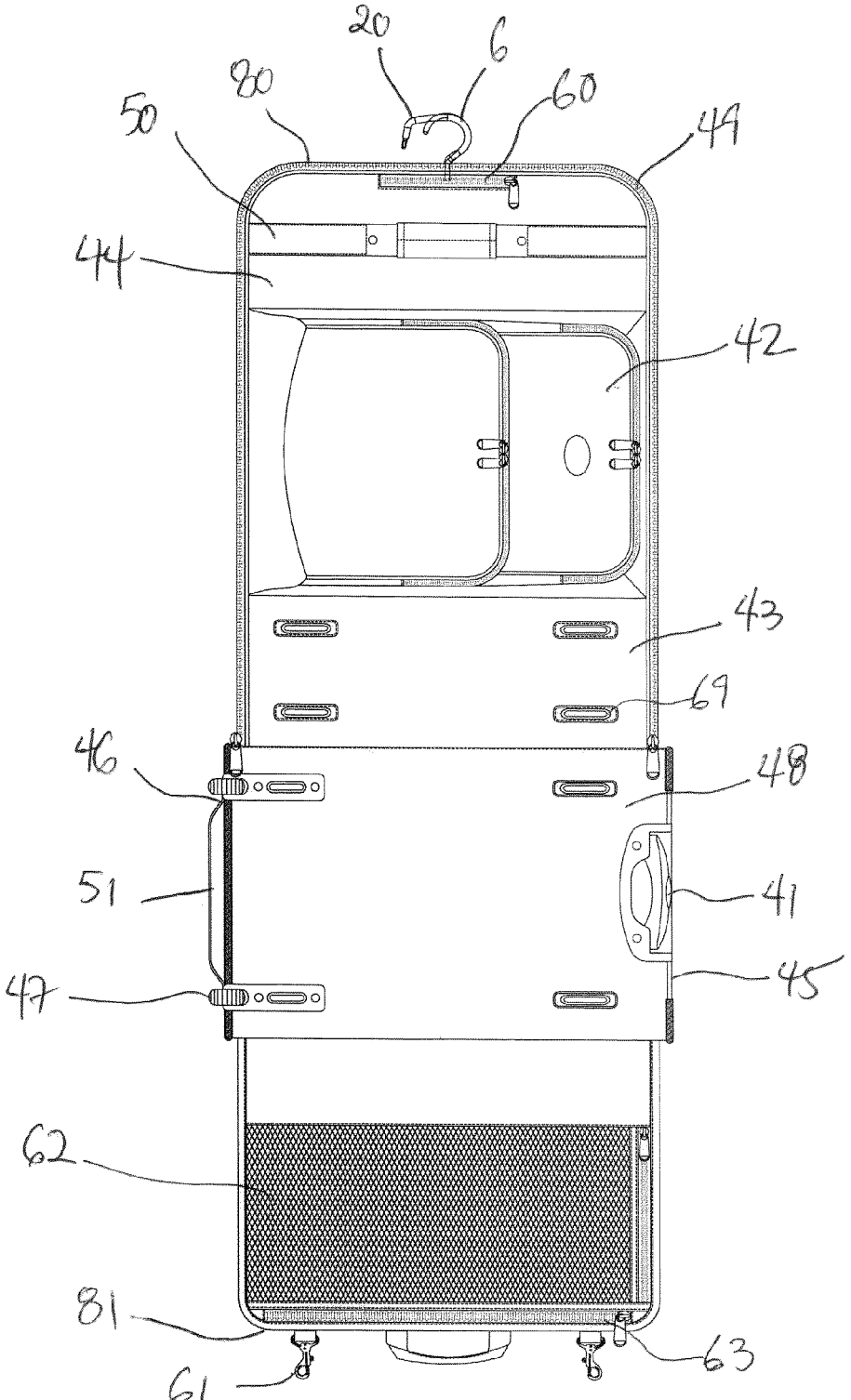
FIG. 37: A view of the outer faces of a multi-panel travel bag when unfolded or open, incorporating a garment hanger system according to the present disclosure, wherein the garment hanger mechanism is in an expanded state.
Figure 39:
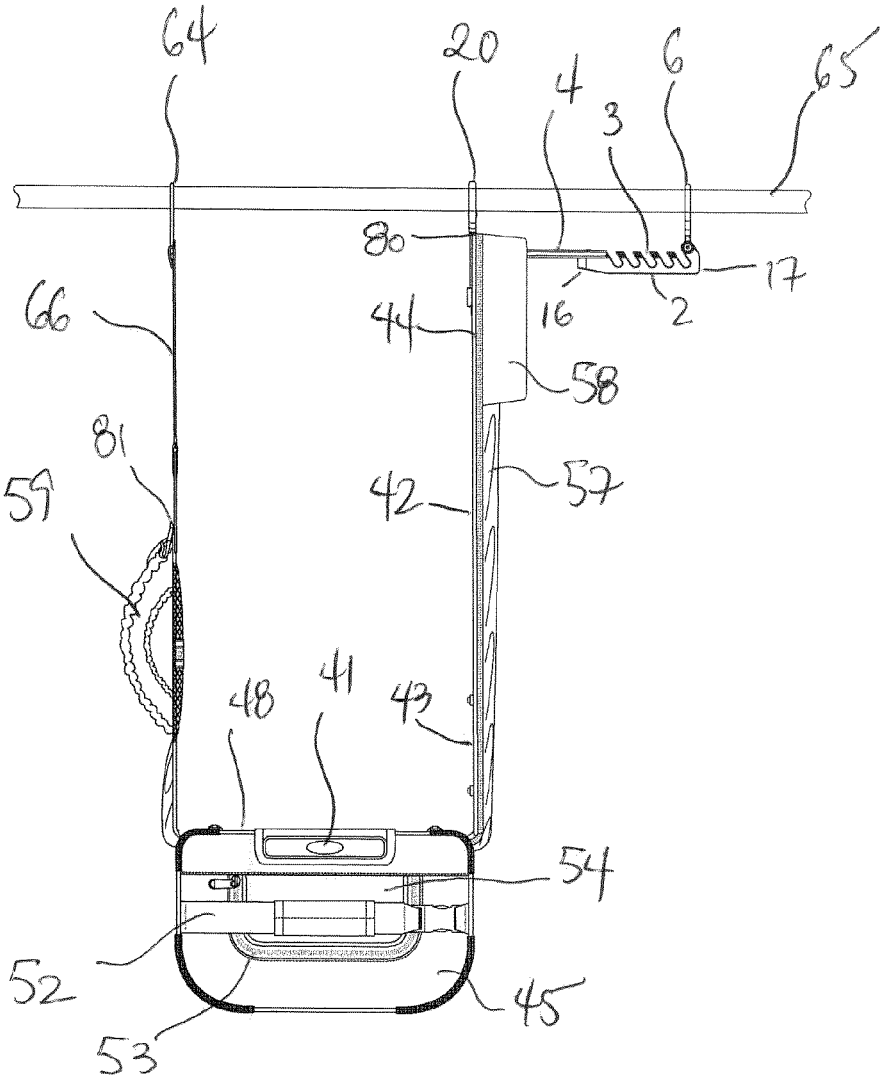
FIG. 39: A side view of a multi-panel travel bag when unfolded or open, and hanging from a closet rod.
Figure 40:
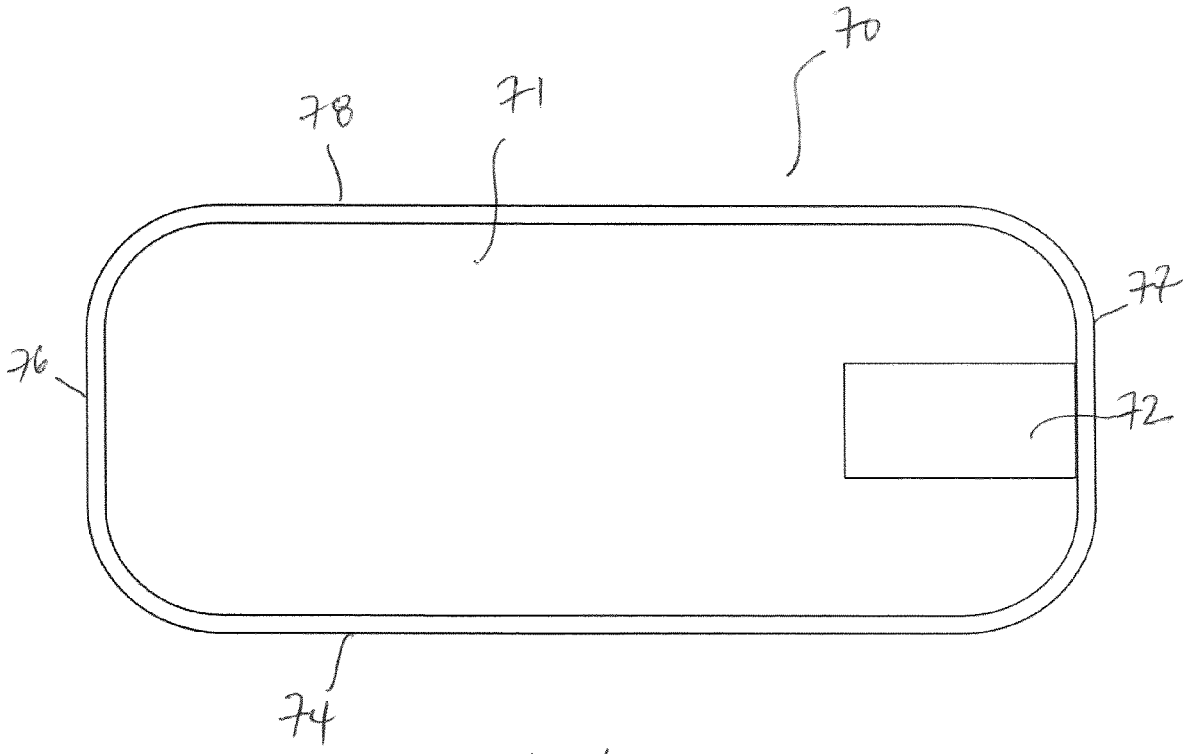
FIG. 40: A top view of cosmetic or personal toiletries case according to the present disclosure.
Figure 41:
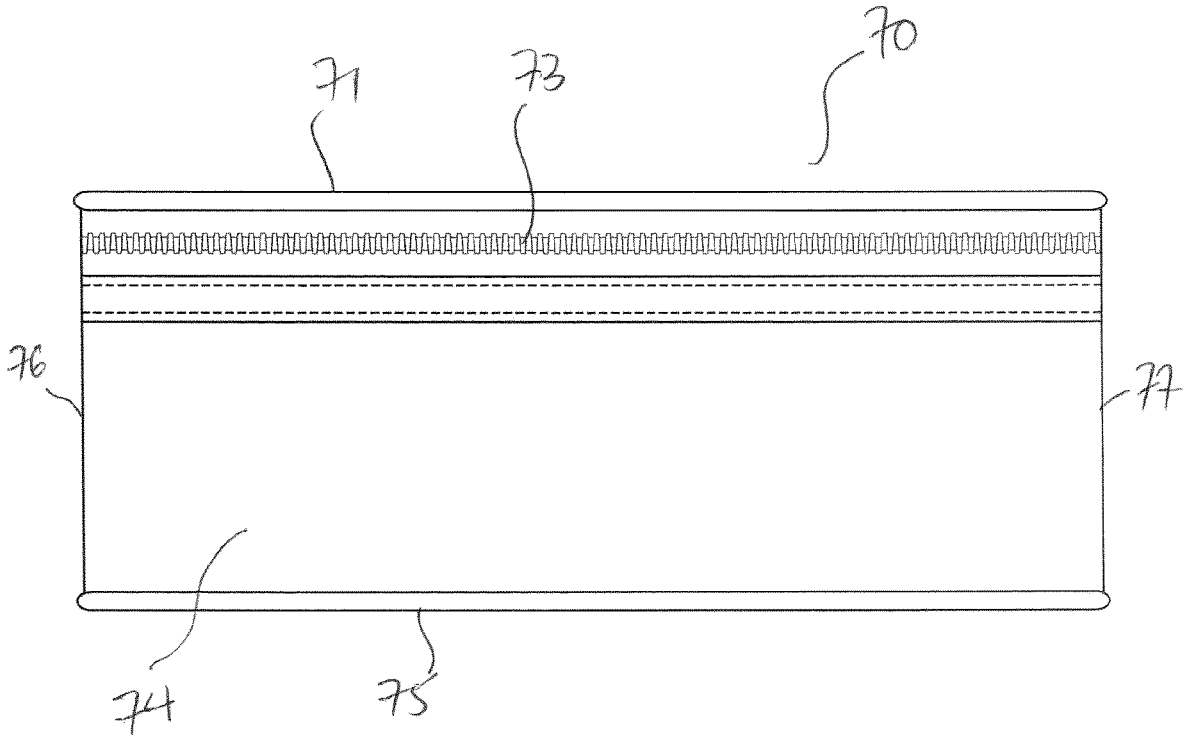
FIG. 41: A front view of cosmetic or personal toiletries case according to the present disclosure.
Figure 42:
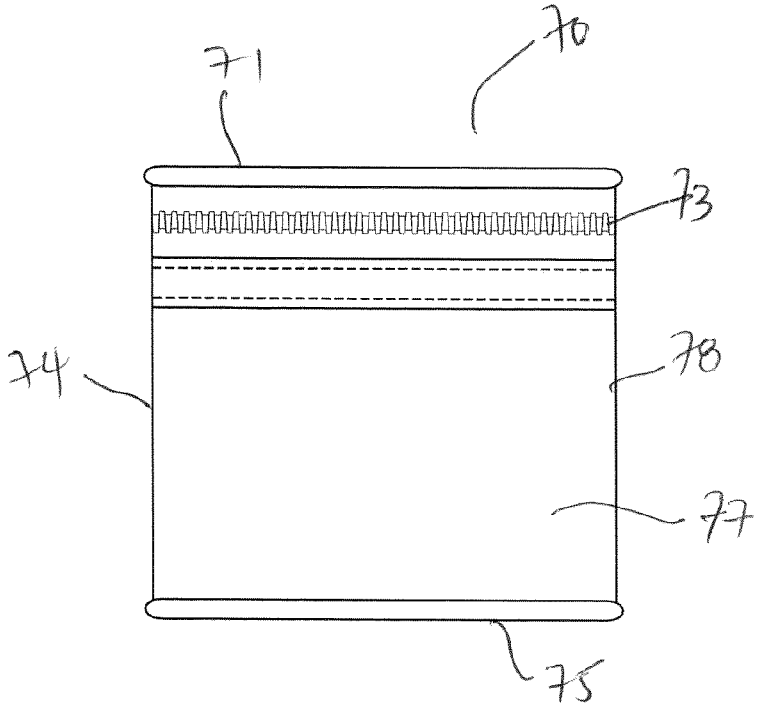
FIG. 42: A side view of cosmetic or personal toiletries case according to the present disclosure.
Figure 43:
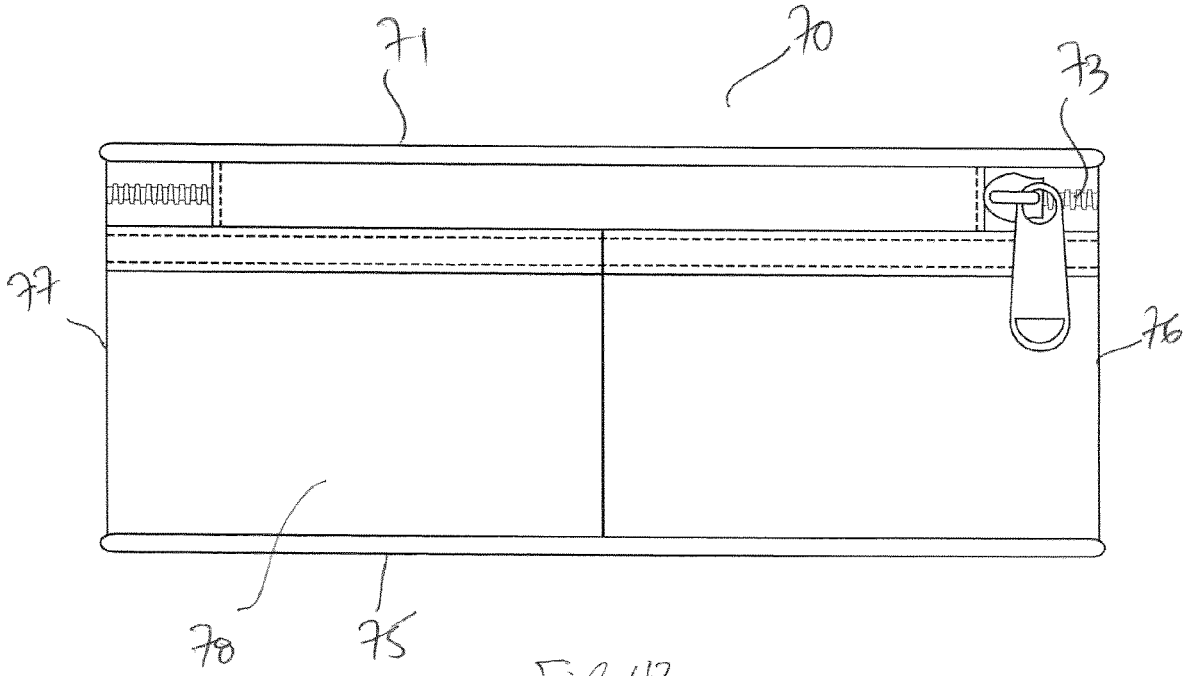
FIG. 43: A back view of cosmetic or personal toiletries case according to the present disclosure.
Figure 44:
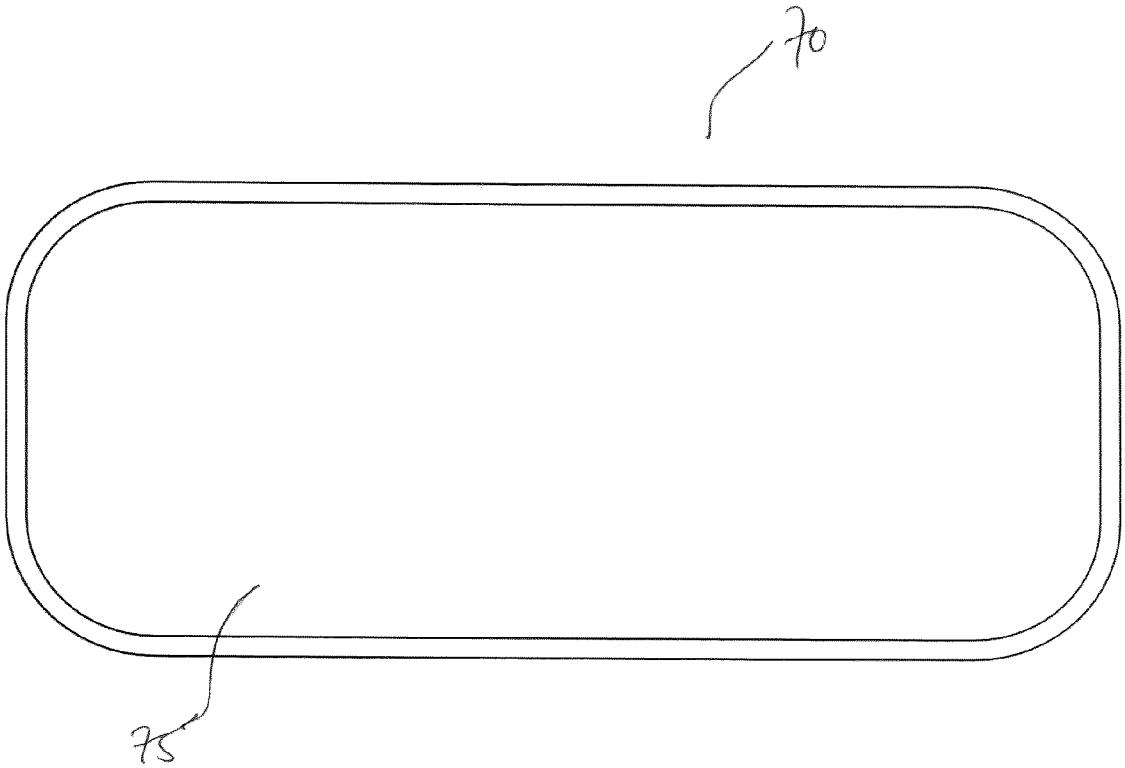
FIG. 44: A bottom view of cosmetic or personal toiletries case according to the present disclosure.

Removable storage and compartment accessories may also be provided with the travel bag. In one embodiment, a cosmetic or personal toiletries case may be provided as shown in FIGS. 40-41. In one configuration, the case can be designed to fit into compartment 55 of the travel bag shown in FIG. 35 and be accessible from the outer top face 45 of the travel bag from the compartment access point defined by the zipper 53 and panel 54 shown in FIGS. 32, 33 and 36. In another embodiment removable compartments may be attached to the inner panel faces of the travel bag using suitable means, such as Velcro™ strips (not shown). Compartments 58 in FIGS. 35, 36 and 39 may be designed to be removable in this manner.

Figure 28:
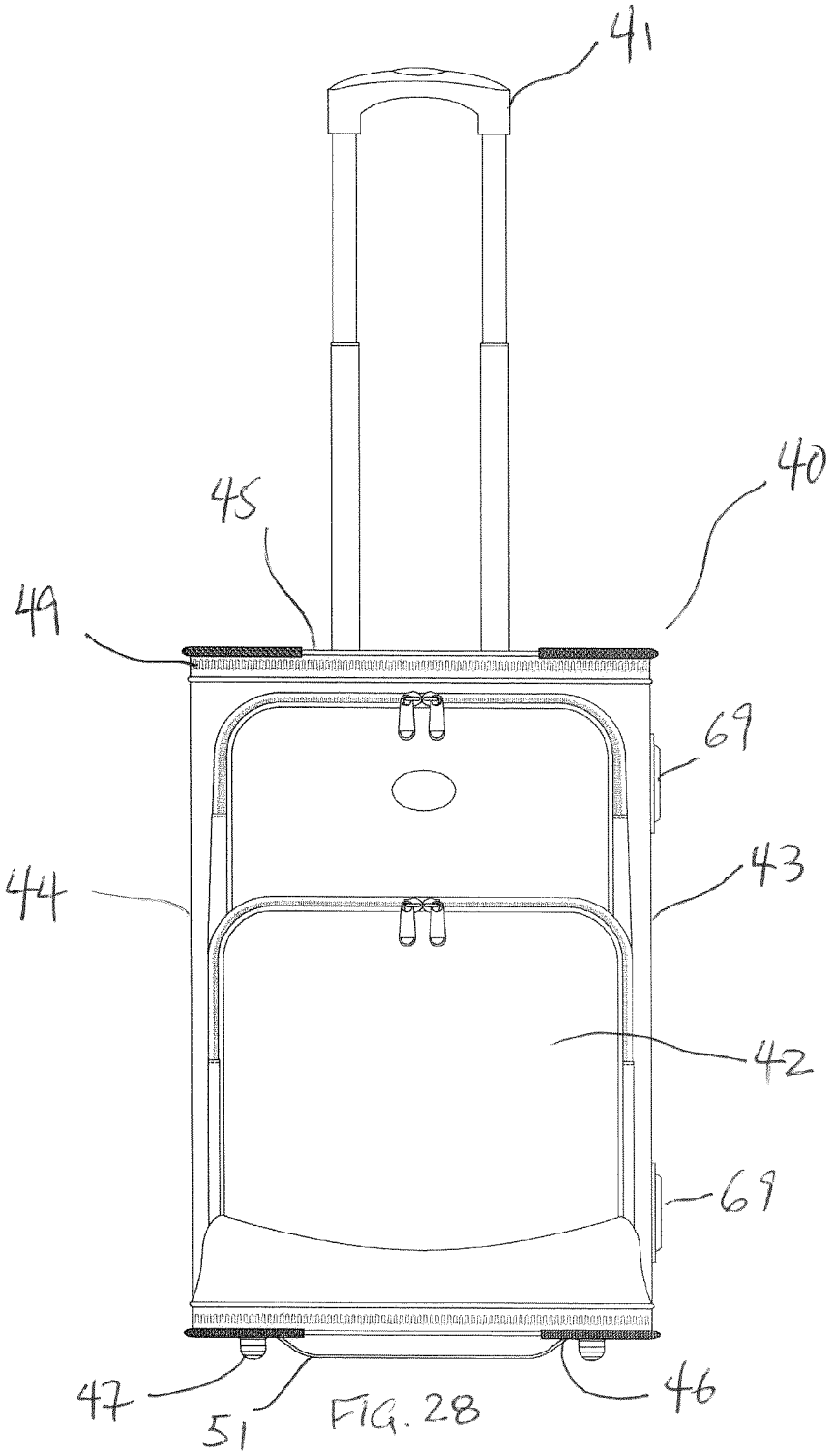
FIG. 28: A front view of a travel bag suitable for incorporating a garment hanger system according to the present disclosure with the bag handle extended.
Figure 29:
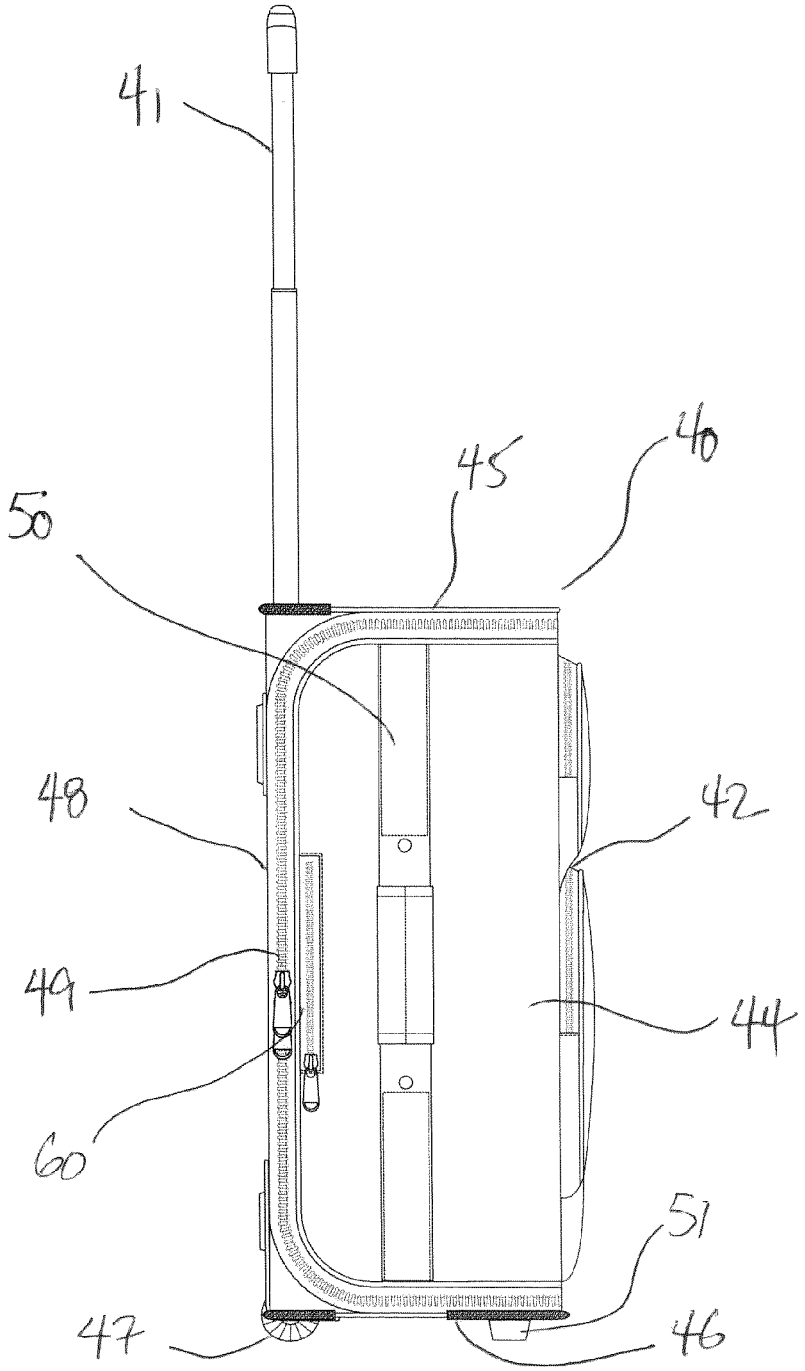
FIG. 29: A left side view of a travel bag suitable for incorporating a garment hanger system according to the present disclosure with the bag handle extended.
Figure 30:
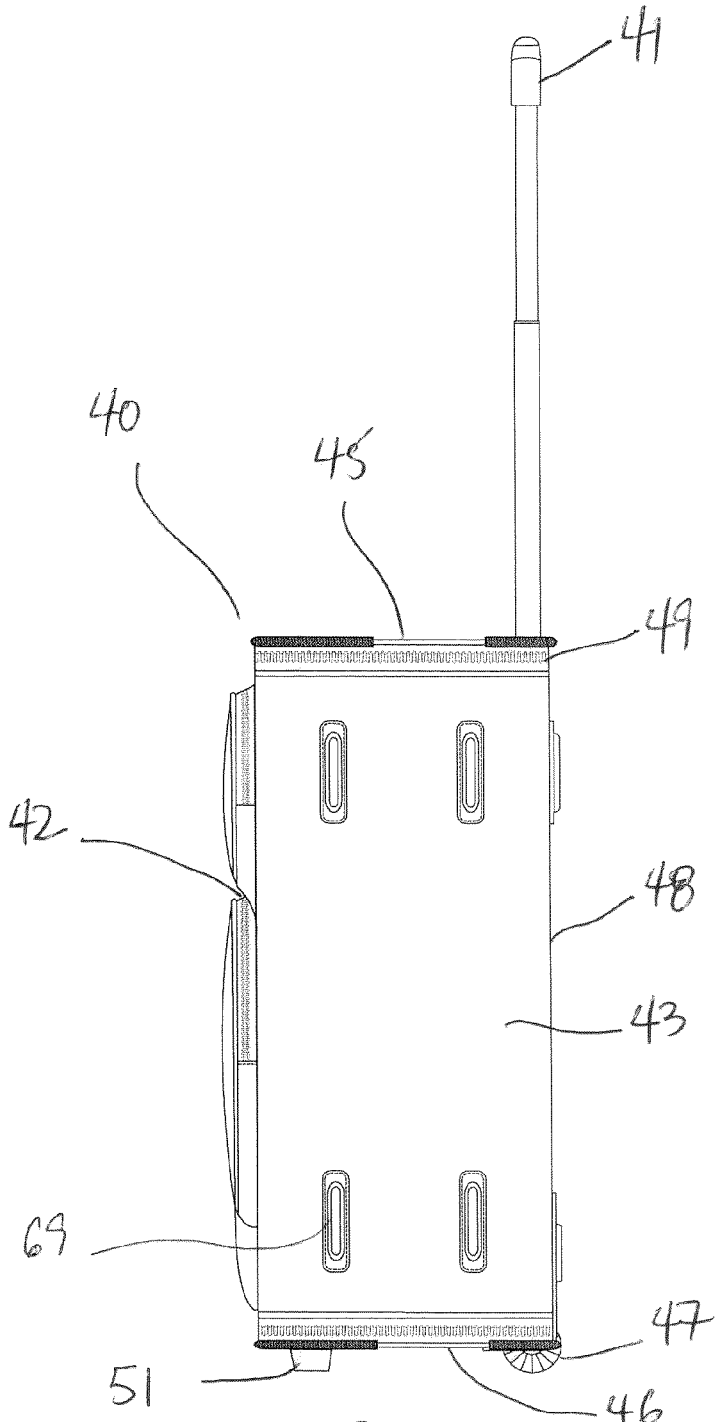
FIG. 30: A right side view of a folded or closed multi-panel travel bag suitable for incorporating a garment hanger system according to the present disclosure with the bag handle extended.
Figure 31:
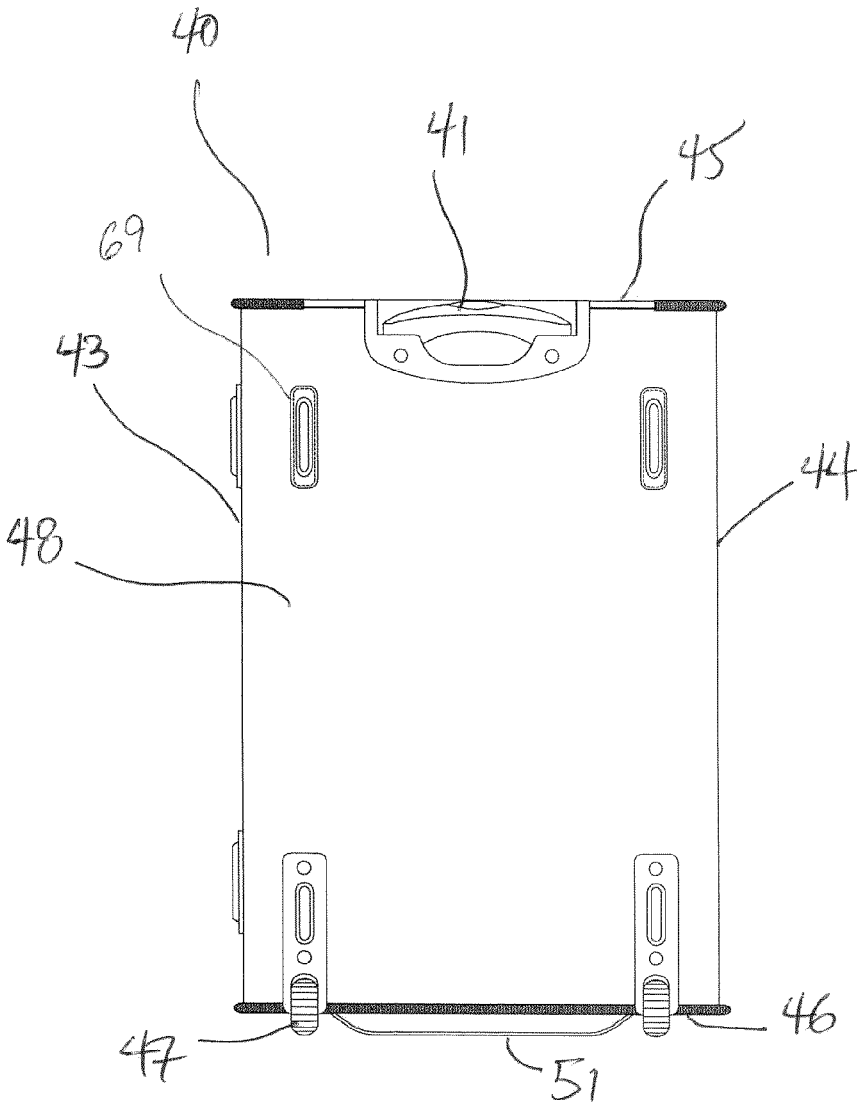
FIG. 31: A back side view of a folded or closed multi-panel travel bag suitable for incorporating a garment hanger system according to the present disclosure with the bag handle retracted/lowered.
Figure 32:
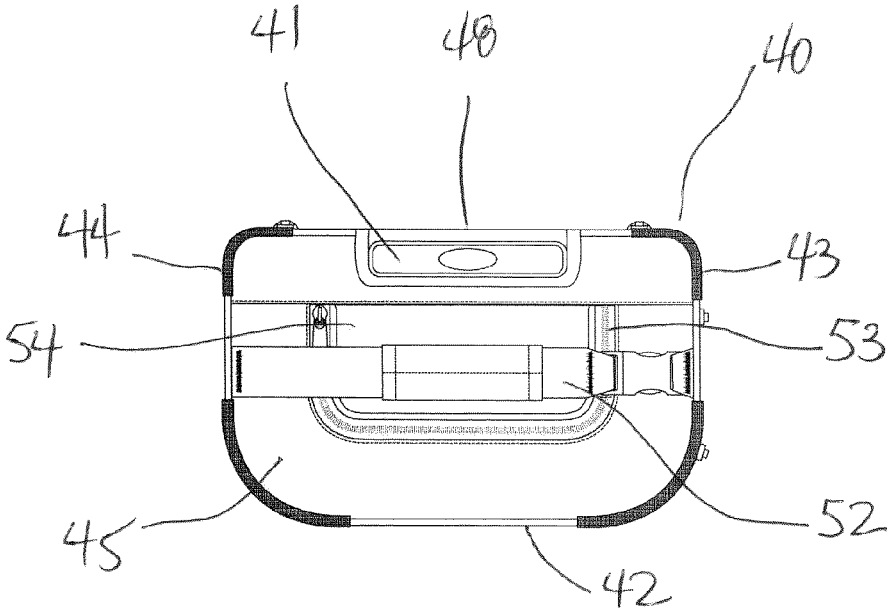
FIG. 32: A top side view of a folded or closed multi-panel travel bag suitable for incorporating a garment hanger system according to the present disclosure with the bag handle retracted/lowered and carrying strap closed.
Figure 33:
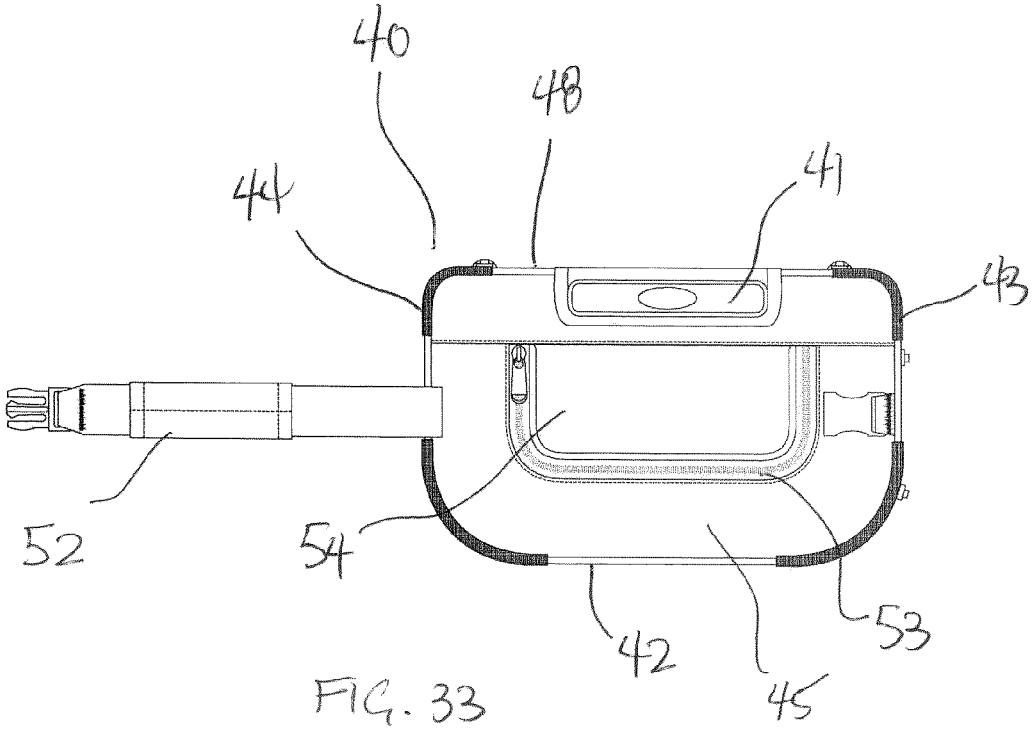
FIG. 33: A top side view of a folded or closed multi-panel travel bag suitable for incorporating a garment hanger system according to the present disclosure with the bag handle retracted/lowered and carrying strap open.
Figure 34:
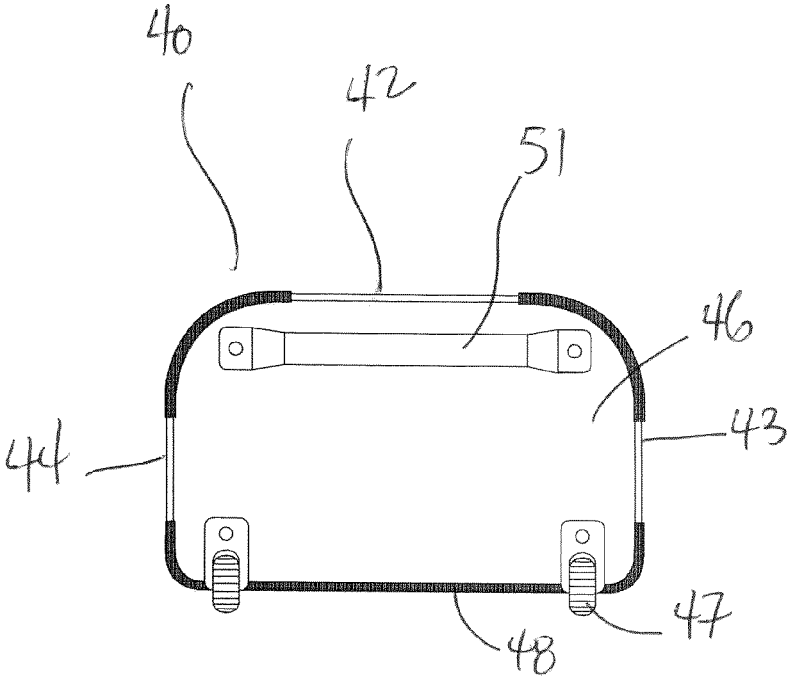
FIG. 34: A bottom side view of a folded or closed multi-panel travel bag suitable for incorporating a garment hanger system according to the present disclosure.

In one embodiment, two or more of the outer front, back and side faces of the travel bag are defined by a single panel when folded. In a related embodiment, the front and side faces are defined by a single panel, which when folded can be closed with a zipper 49 or other closure means as shown in FIGS. 28-30.

As illustrated in FIGS. 35-39, when unfolded, a suitable travel bag will have multi-purpose inner storage options, for example, various inner pockets, panels and compartments 55, 57, 58, 59, and 62. Straps 56 and latching means 61 are exemplary means used to facilitate the orderly folding of the bag for use in travel mode. To provide sufficient space or hanging length for hung garments to be packed neatly the winged compartments 57 may extend behind the shoe compartment 59.

Proximal to one end 80 of the unfolded travel bag the garment hanger system can be integrated into the bag by mounting it on a board (see FIGS. 25-27) within a panel of the travel bag. Use of a mounting board for the garment hanger mechanism and bag hanging means operatively connects these elements to form the garment hanger system. Depending on the design of the garment hanger system, the garment hanger mechanism and bag hanging means may or may not be integrated into the same travel bag panel or mounted on the same board. In one embodiment, the garment hanger mechanism and bag hanging means are mounted on opposite faces of the same board. In another embodiment, the garment hanger mechanism and bag hanging means are mounted on the same face of the board.

In a further embodiment, the mounting plates 8 and 22 (see FIG. 24) used to mount the garment hanger mechanism and bag hanging means, respectively, to a board are aligned on the board so that when both the mechanism hanging means and bag hanging means are extended or in an active position for use, the garment hanger member is positioned below and in a substantially parallel alignment relative to the closet (rack) rod.

Travel Closet

As exemplified in FIGS. 35-39, when a travel bag with a garment hanger system is unfolded, the bag hanging means 20 can be used to hang the travel bag and the mechanism hanging means 6 can be used to hang the garment hanger member from a closet rod or clothes rack. In this manner clothes hangers hanging within the spaced recesses of the member portion 2 of the garment hanger member can be effectively hung in a closet or from a clothes rack without having to be removed from garment hanger member, thereby transforming the travel bag into a temporary travel closet. Additional bag hanging means may be incorporated into the bag to provide for further hanging options and travel closet configurations.

The various pockets and compartments on the inner faces of the travel bag panel(s) can be configured so as to also make all other apparel, accessories and personal care items readily accessible without having to unpack those items from the travel bag.

Figure 38:
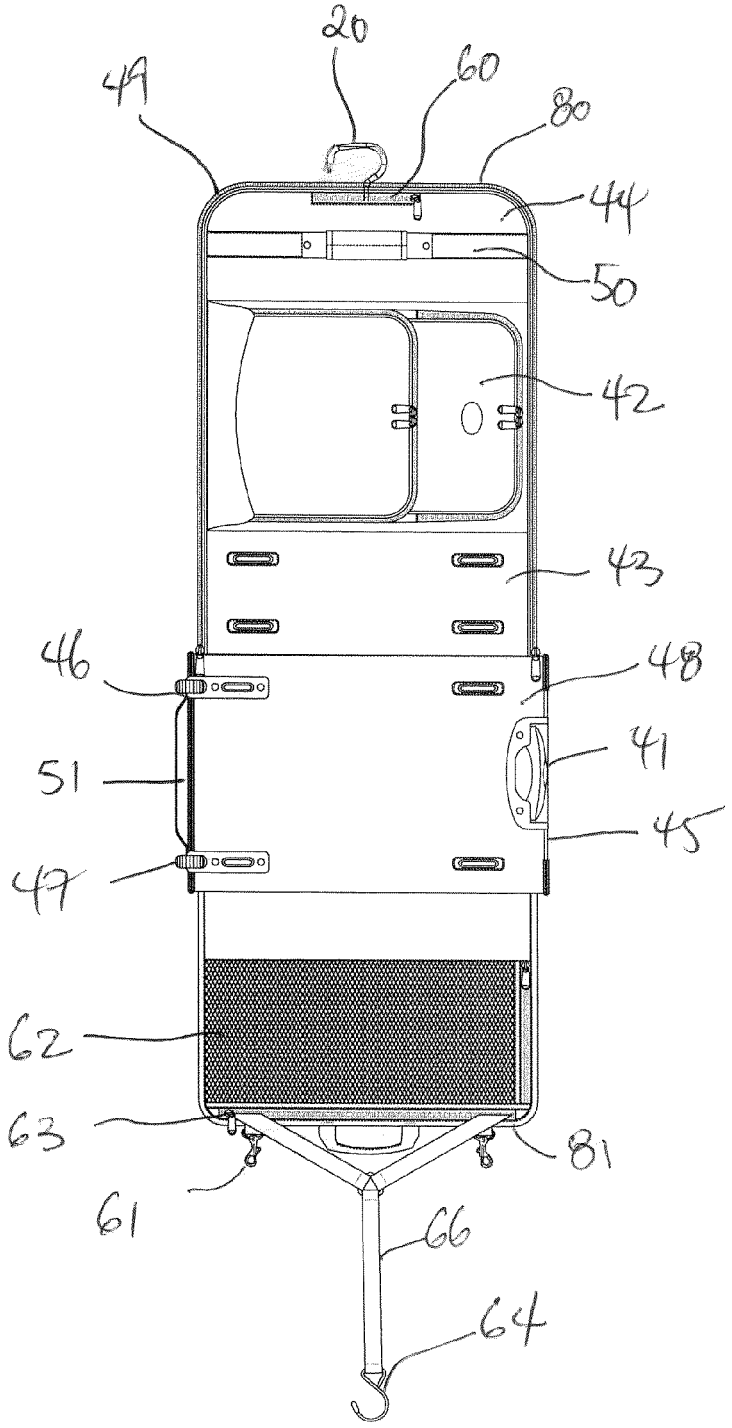
FIG. 38: A view of the outer faces of a multi-panel travel bag when unfolded or open, incorporating a garment hanger system, including a third hanging means according to the present disclosure, wherein the garment hanger mechanism is in an expanded state.

In one embodiment, a shelving functionality can be incorporated in the travel closet by flipping backwards and hanging the free end 81 of the travel bag opposite the end 80 hung using the bag hanging means (hook 20). As shown in FIGS. 38 and 39, an additional strap 66 and hanging means 64 can be configured and stored in zippered compartment 63 for this purpose. When the free end 81 of the unfolded travel bag is also hung from a closet rod or clothes rack, a shelf is formed by the panel defining the outer back face 48 of the travel bag.

To gain a better understanding of the invention described herein, the following examples are set forth. It will be understood that these examples are intended to describe illustrative embodiments of the invention and are not intended to limit the scope of the invention in any way.

EXAMPLES

The following example(s) illustrate the application of an embodiment of the garment hanger mechanism and system integrated into a travel bag according to the present disclosure.

Example 1: Supported Garment Hanger Mechanism and System for Foldable, Multi-Panel, Substantially Prismatic Travel Bags In one exemplary embodiment supported, garment hanger mechanisms and systems for a substantially prismatic travel bag are provided as illustrated in FIGS. 5-27.

Garment Hanger Mechanism

With reference to FIGS. 5-12, the garment hanger mechanism of the garment hanger system is illustrated including a garment hanger member 1 configured as a slider system. The garment hanger member 1 comprises a hanger slider 2 (member portion) with recesses 3 delineated by spaced member projections or protrusions 14, which extend laterally at the top away from, or perpendicular to the plane of the side walls 30 of the member portion to form projection overhangs 15. The projection overhangs 15 can be engaged by a support arm 4 (securing means) comprising a top 12 and sides 13. The support arm 4 functions as a guide or slider rail for the hanger slider 2. The sides 13 of the support arm 4 are configured to wrap around the projection overhangs 15 of the hanger slider 2, such that the hanger slider 2 can slide in and out from underneath the support arm 4.

Figures 4A, 4B, 4C:
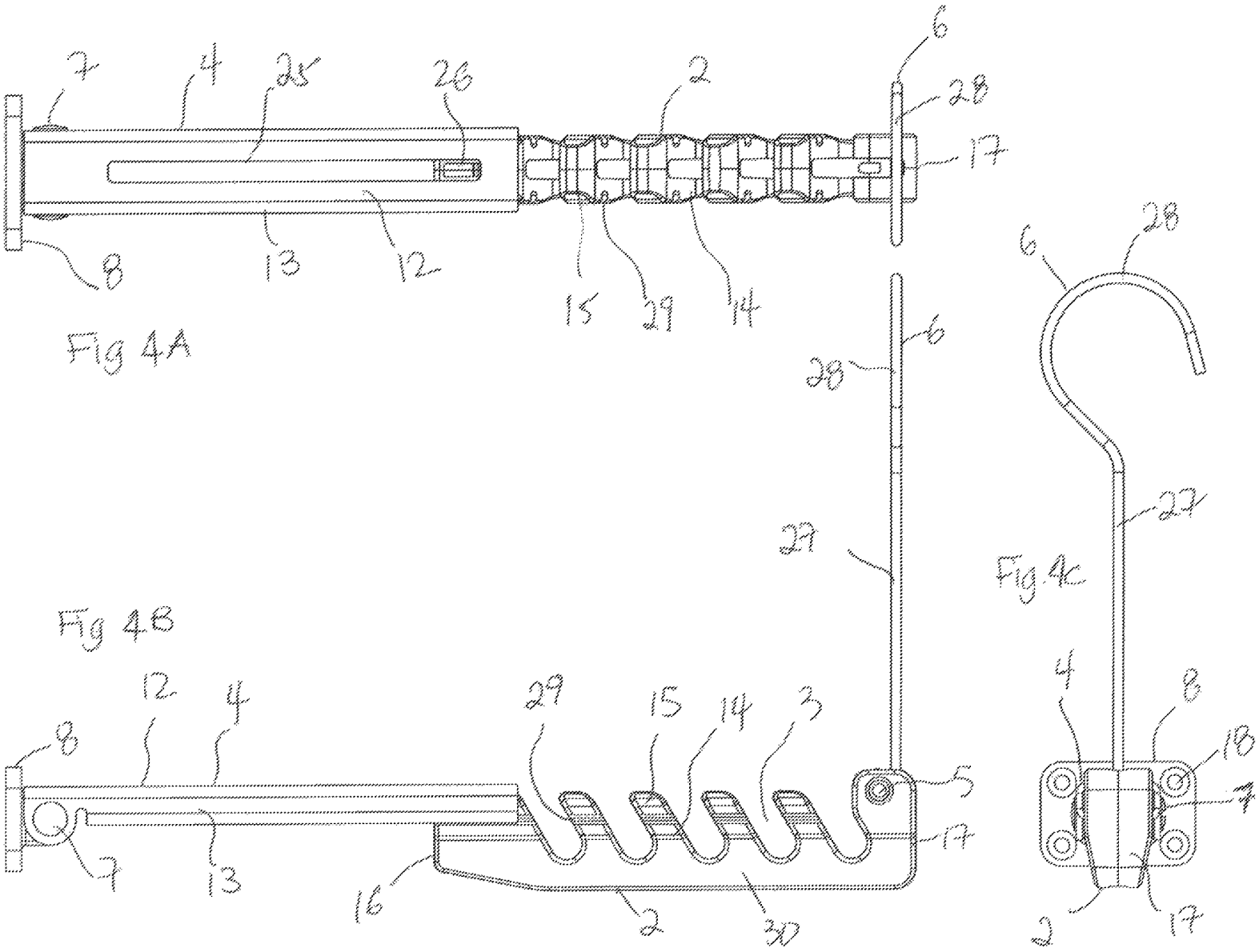
FIG. 4A-4C: Various views of another embodiment of a garment hanger mechanism according to the present disclosure in an expanded state where A=top, B—side and C=front views of the garment hanger mechanism.
Figure 5:
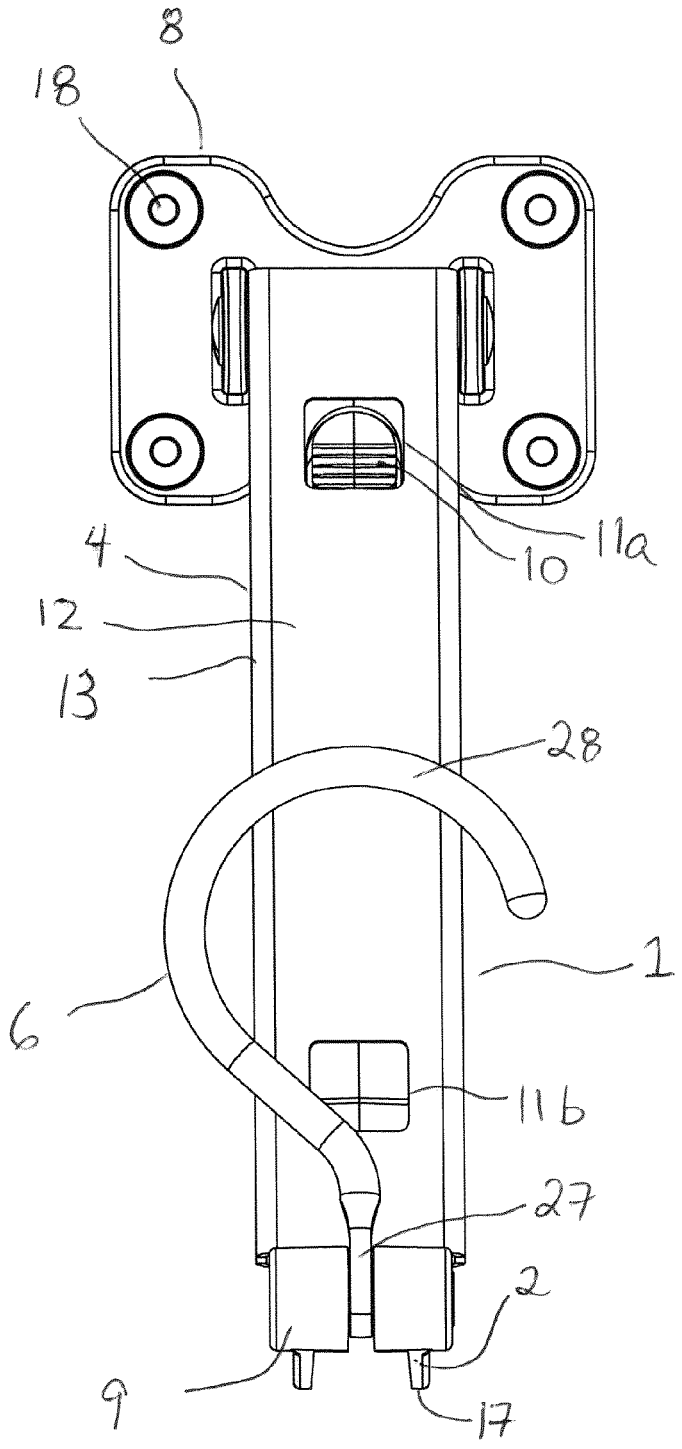
FIG. 5: A front view of an embodiment of a supported garment hanger mechanism in a collapsed state according to the present disclosure.
Figure 6:
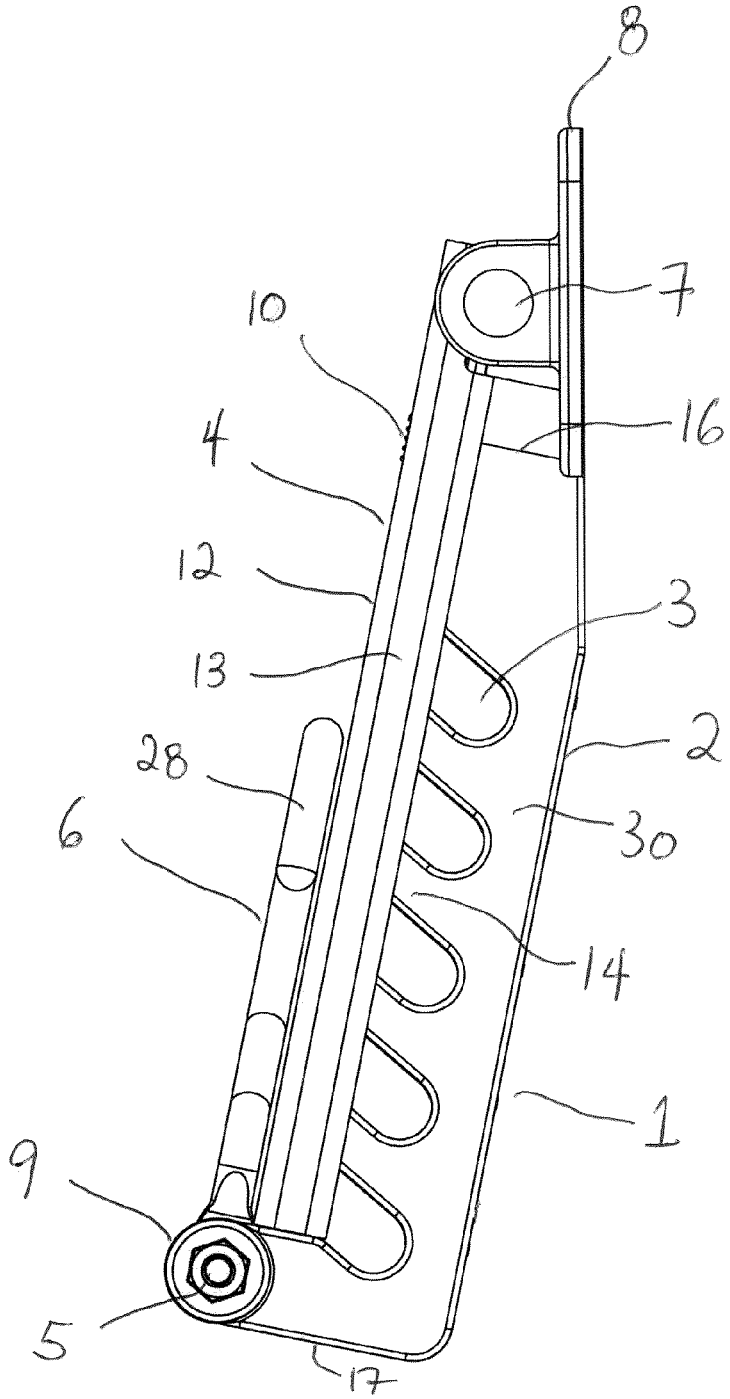
FIG. 6: A side view of an embodiment of a supported garment hanger mechanism in a collapsed state according to the present disclosure.
Figure 7:
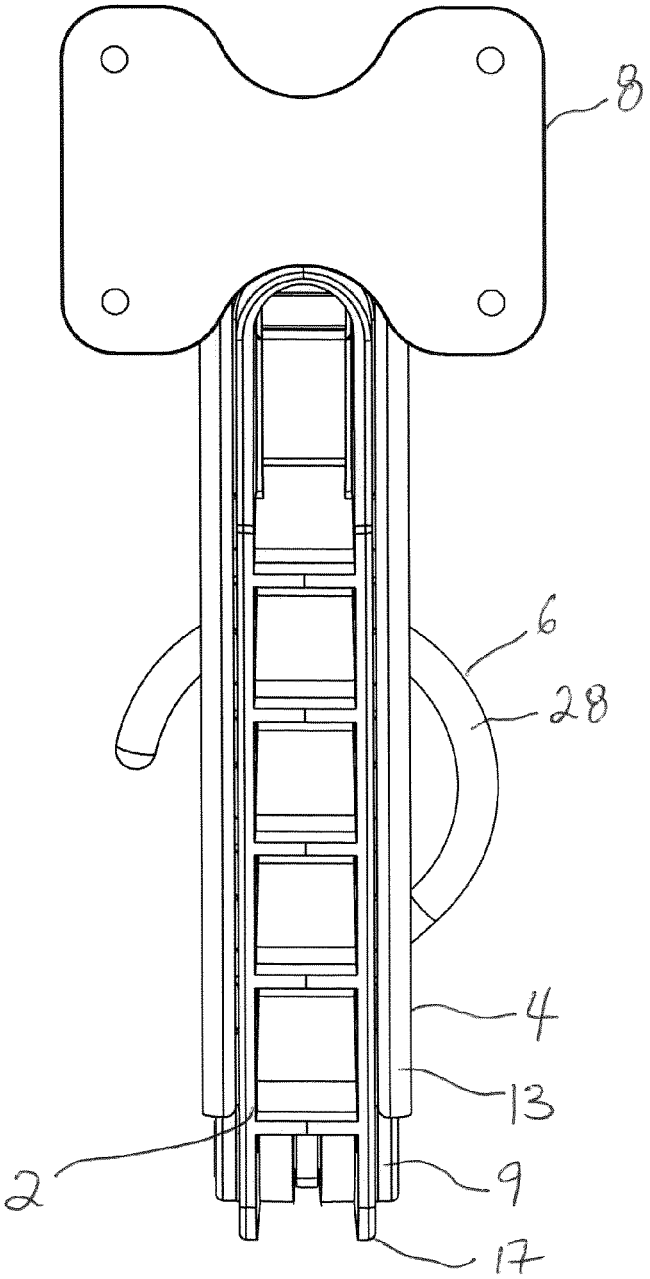
FIG. 7: A back view of an embodiment of a supported garment hanger mechanism in a collapsed state according to the present disclosure.
Figure 8:
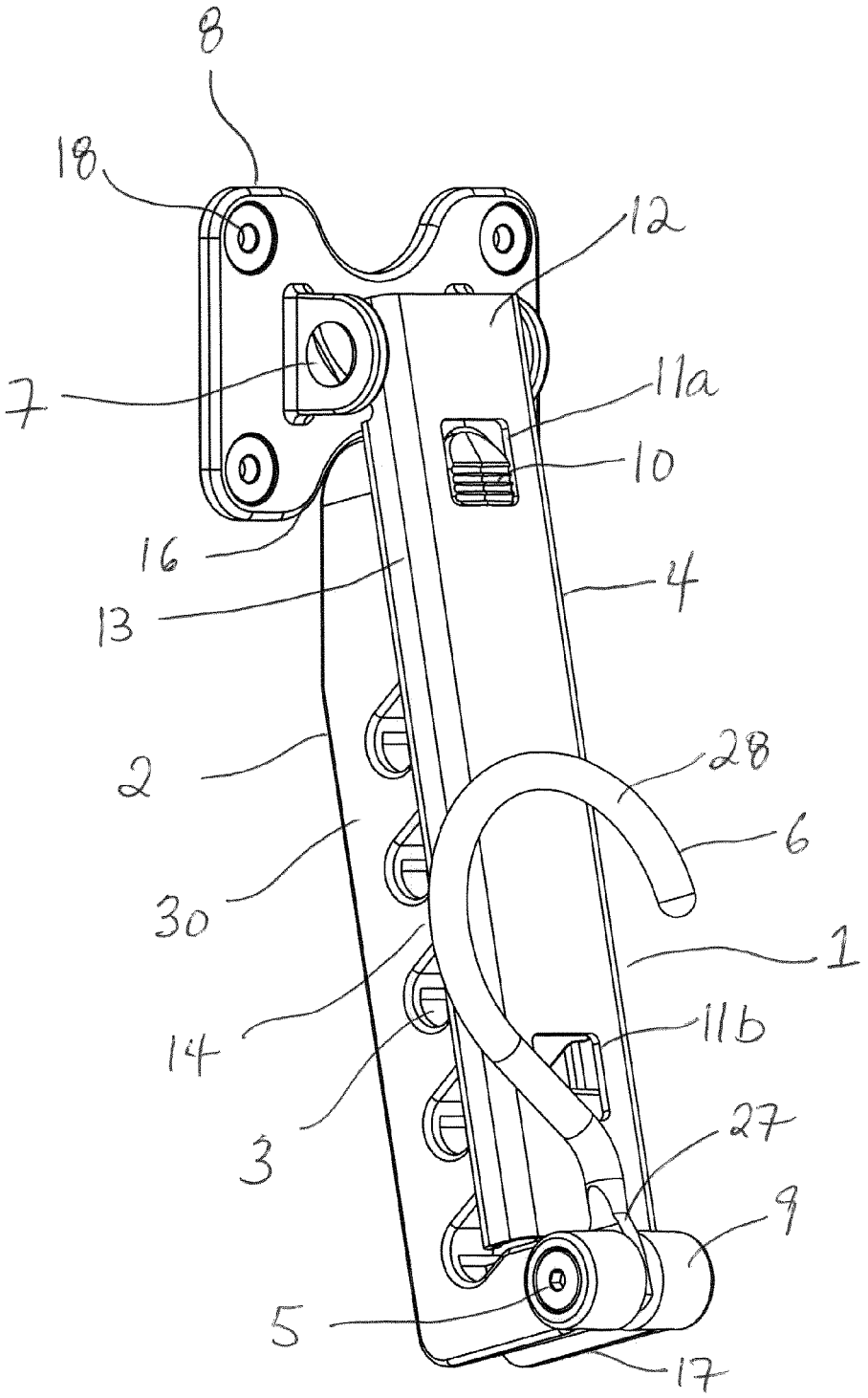
FIG. 8: An isometric view of an embodiment of a supported garment hanger mechanism in a collapsed state according to the present disclosure.
Figure 9:
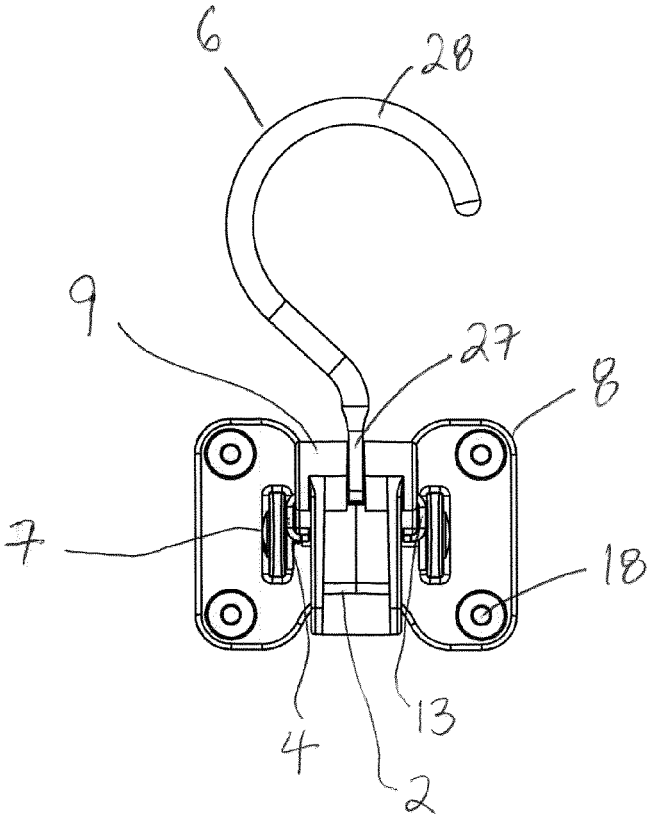
FIG. 9: A front view of an embodiment of a supported garment hanger mechanism in an expanded state with a mounting plate according to the present disclosure.
Figure 10:
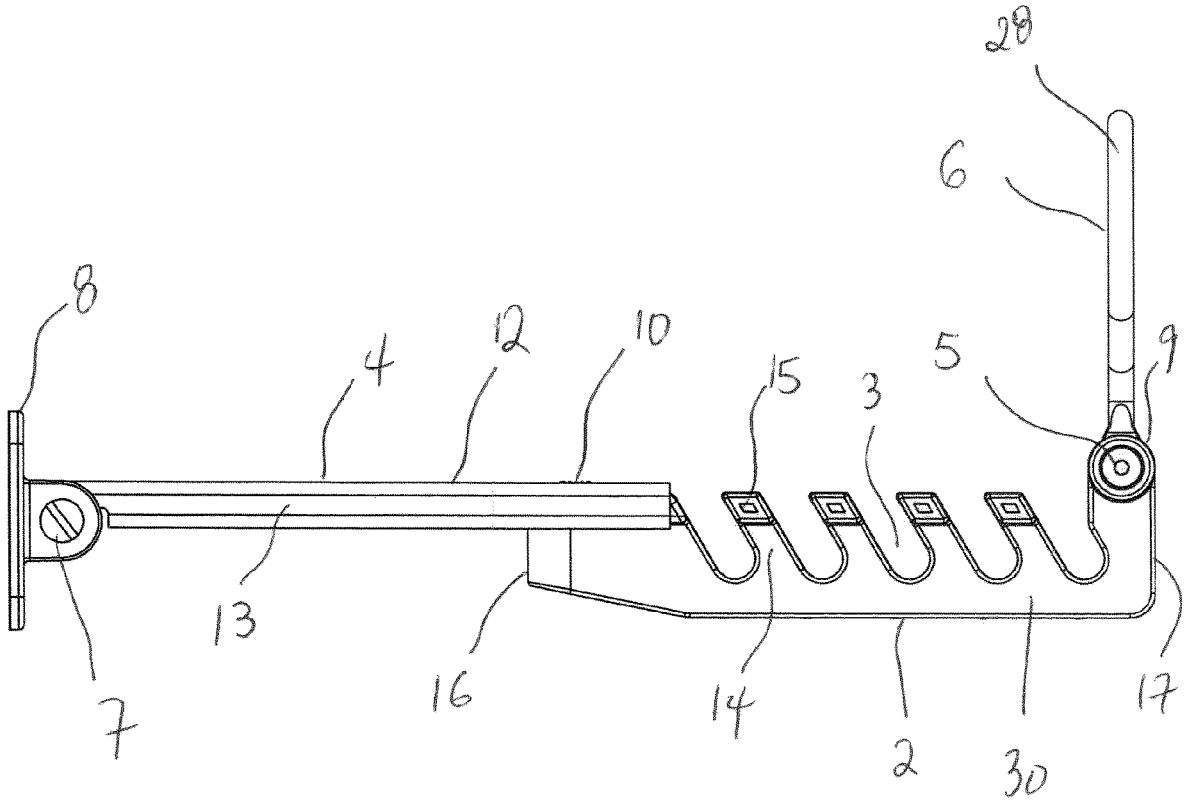
FIG. 10: A side view of an embodiment of a supported garment hanger mechanism in an expanded state with a mounting plate according to the present disclosure.
Figure 11:
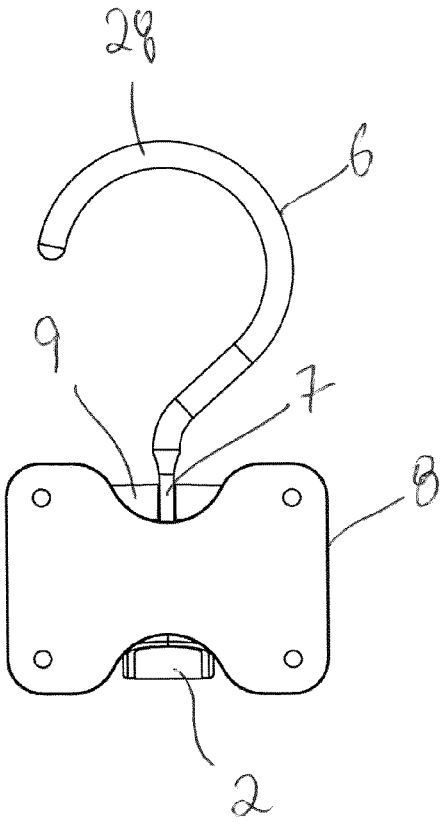
FIG. 11: A back view of an embodiment of a supported garment hanger mechanism in an expanded state with a mounting plate according to the present disclosure.
Figure 12:
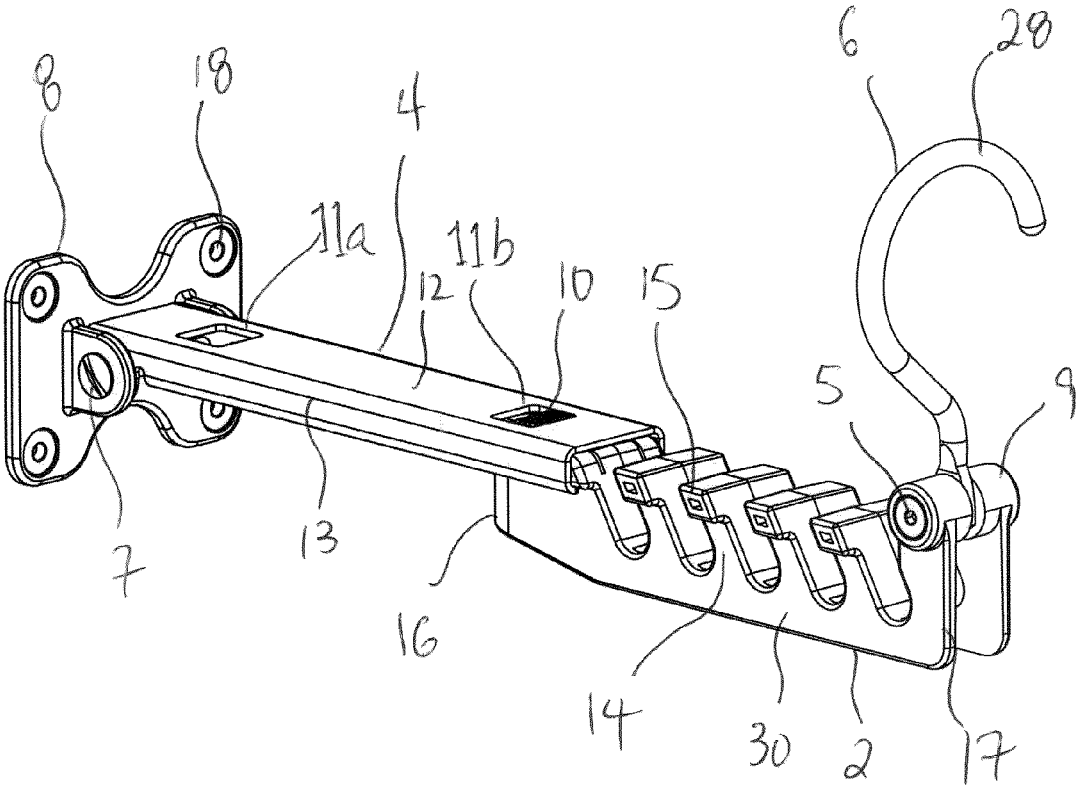
FIG. 12: An isometric of an embodiment of a supported garment hanger mechanism in an expanded state with a mounting plate according to the present disclosure.
Figure 13:
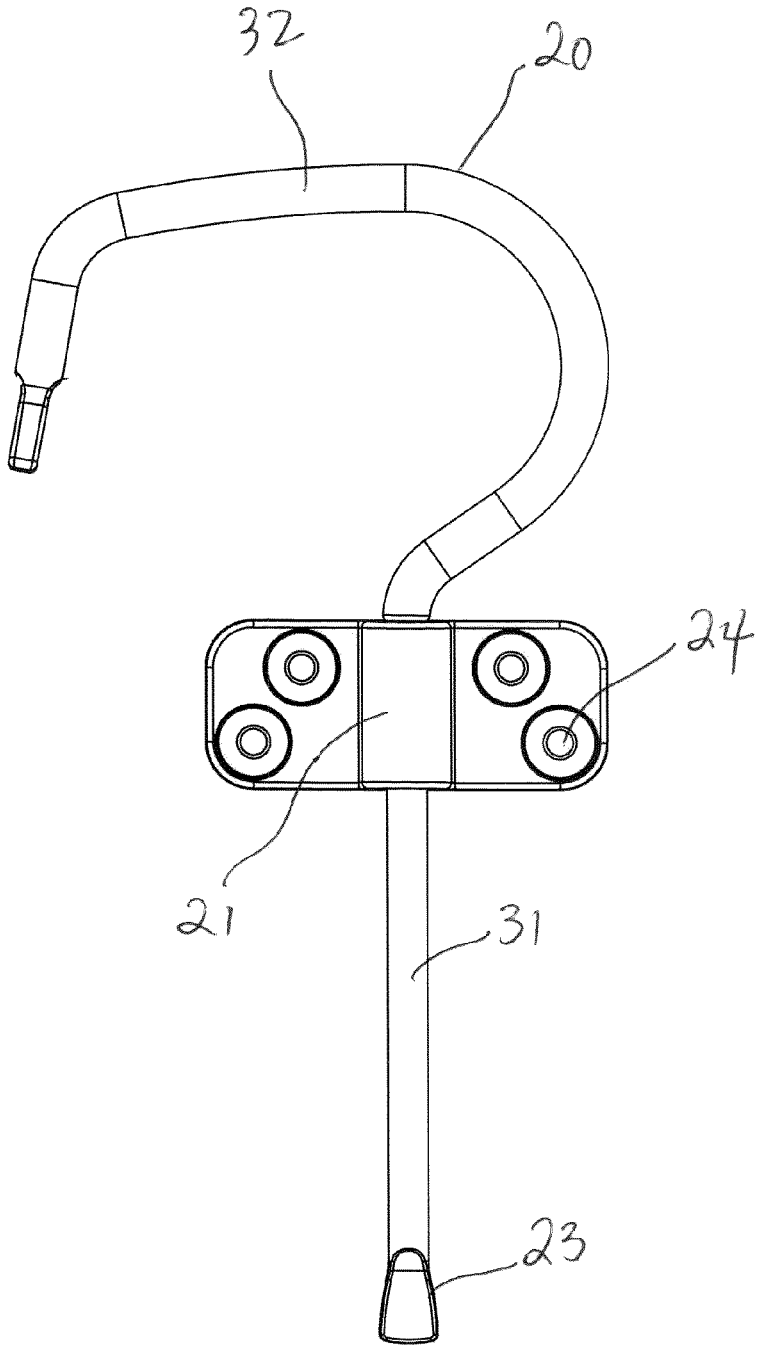
FIG. 13: A right side view of an embodiment of a travel bag hanging means of a garment hanger system with mounting plates according to the present disclosure in a lowered state.
Figure 14:
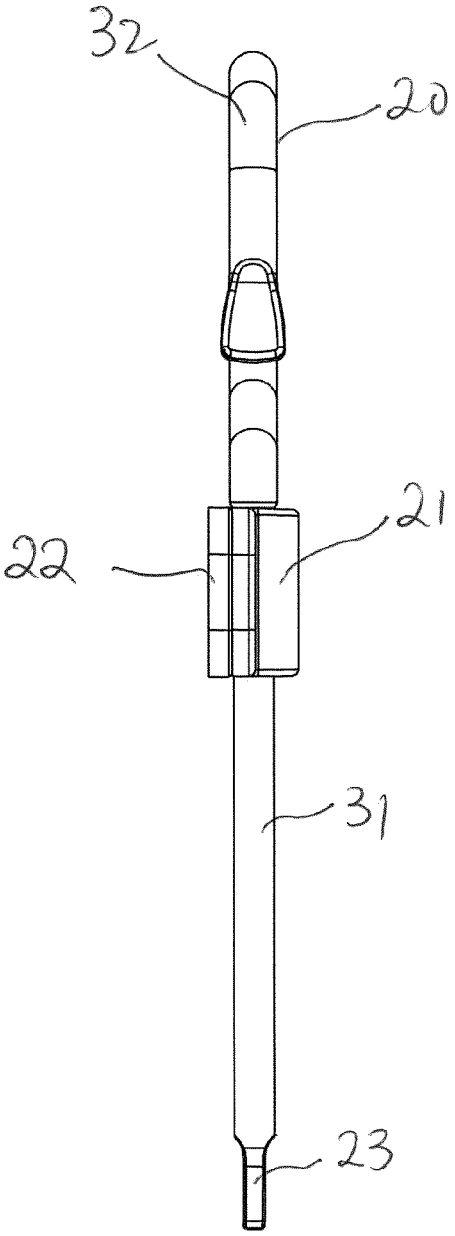
FIG. 14: A front view of an embodiment of a travel bag hanging means of a garment hanger system with mounting plates according to the present disclosure in a lowered state.
Figure 15:
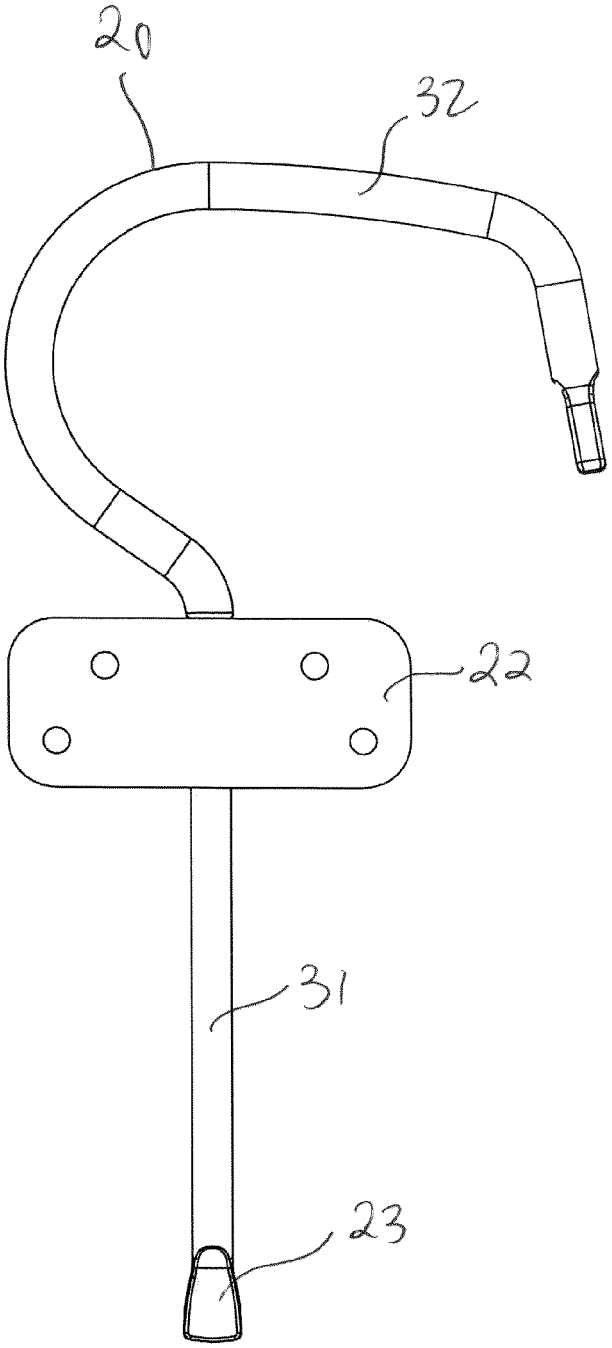
FIG. 15: A left side view of an embodiment of a travel bag hanging means of a garment hanger system with mounting plates according to the present disclosure in a lowered state.
Figure 16:
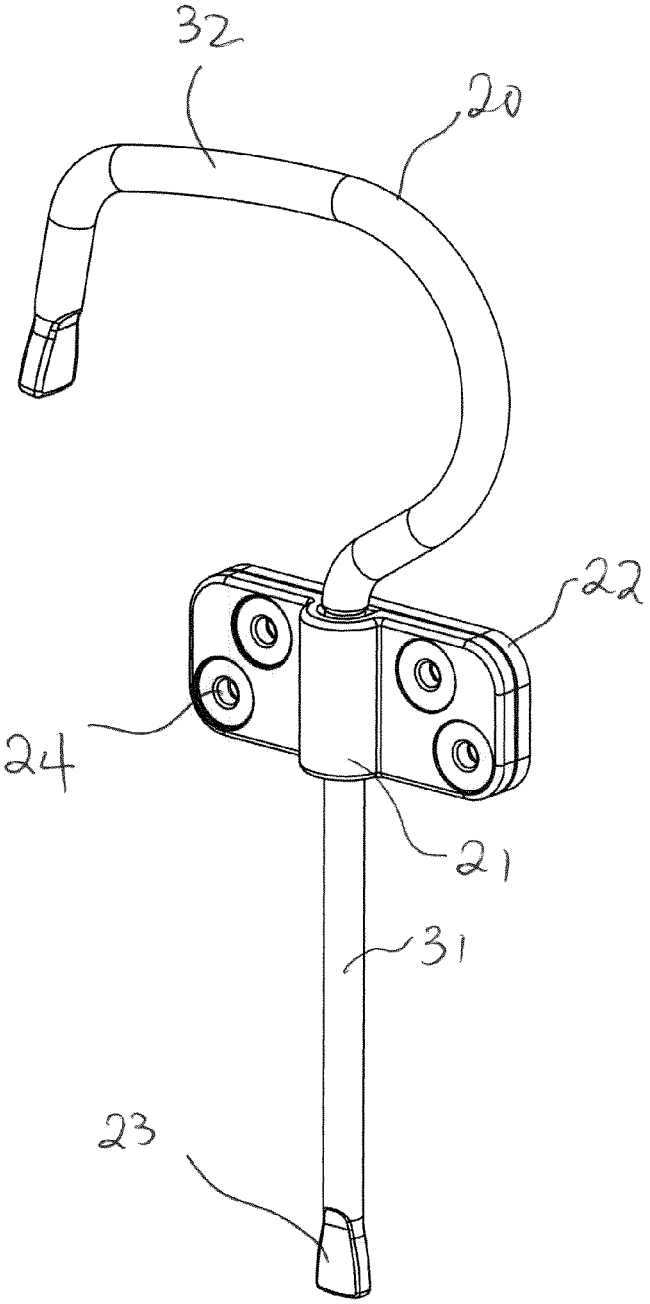
FIG. 16: An isometric view of an embodiment of a travel bag hanging means of a garment hanger system with mounting plates according to the present disclosure in a lowered state.
Figure 17:
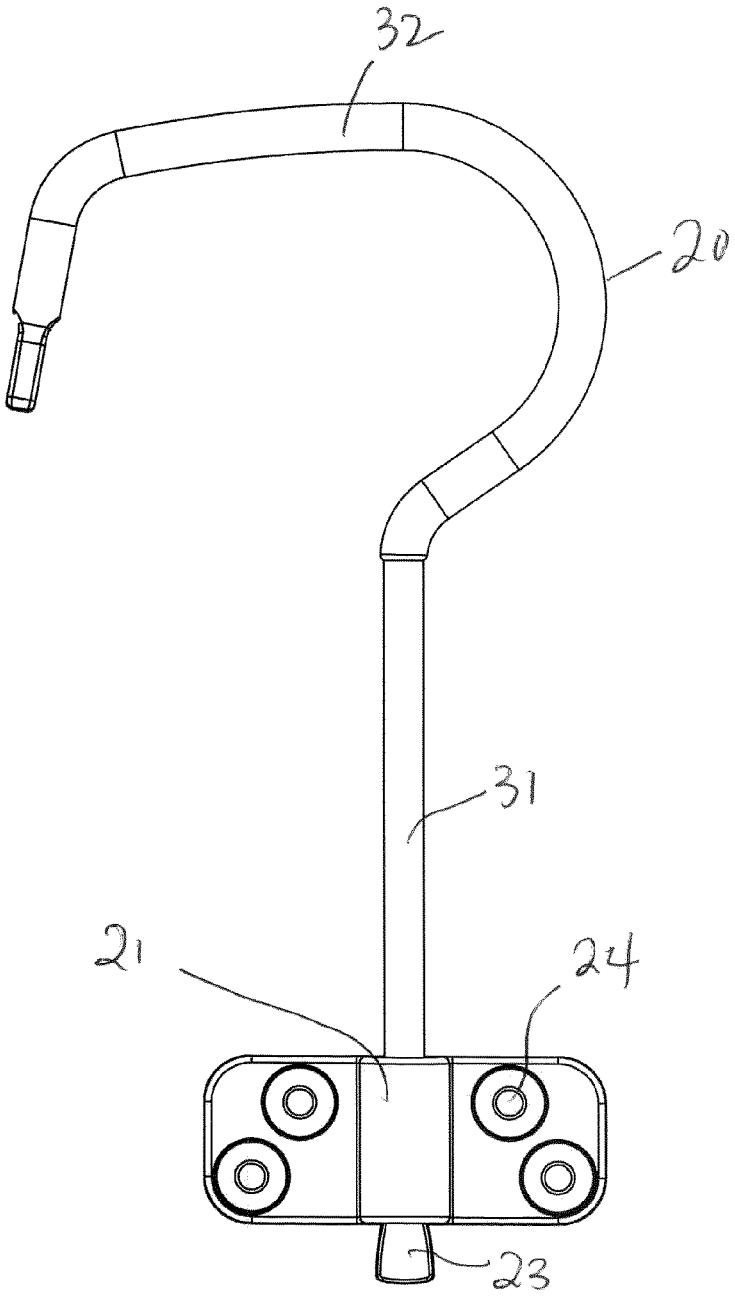
FIG. 17: A right side view of an embodiment of a travel bag hanging means of a garment hanger system with mounting plates according to the present disclosure. in an extended state.
Figure 18:
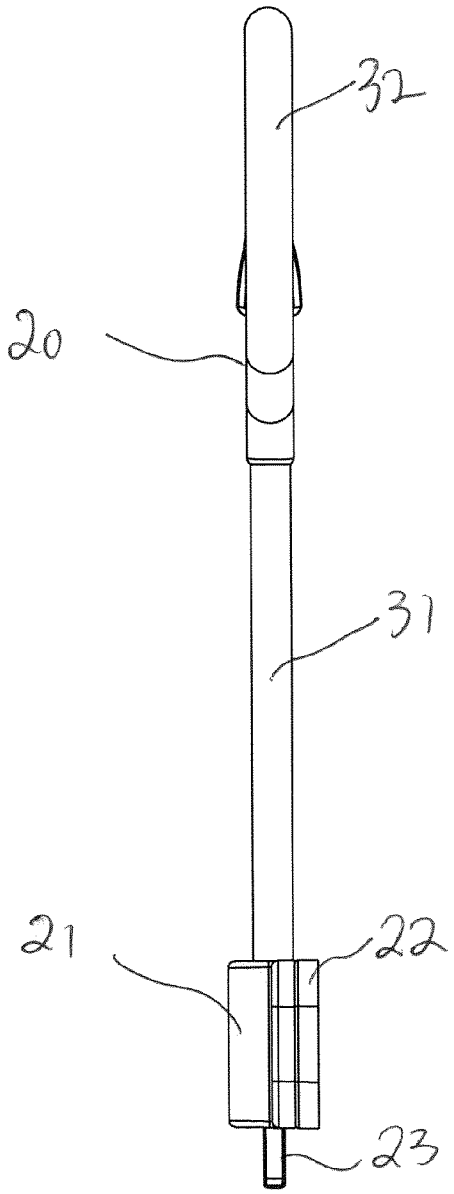
FIG. 18: A back side view of an embodiment of a travel bag hanging means of a garment hanger system with mounting plates according to the present disclosure. in an extended state.
Figure 19:
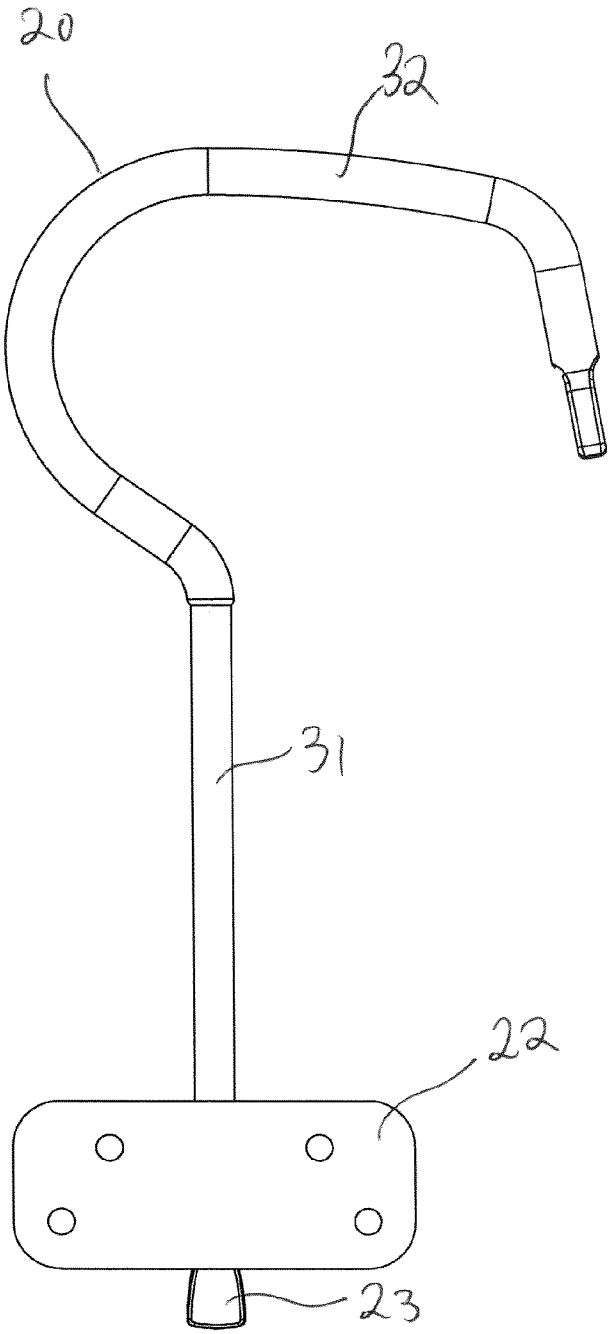
FIG. 19: A left side view of an embodiment of a travel bag hanging means of a garment hanger system with mounting plates according to the present disclosure. in an extended state.
Figure 20:
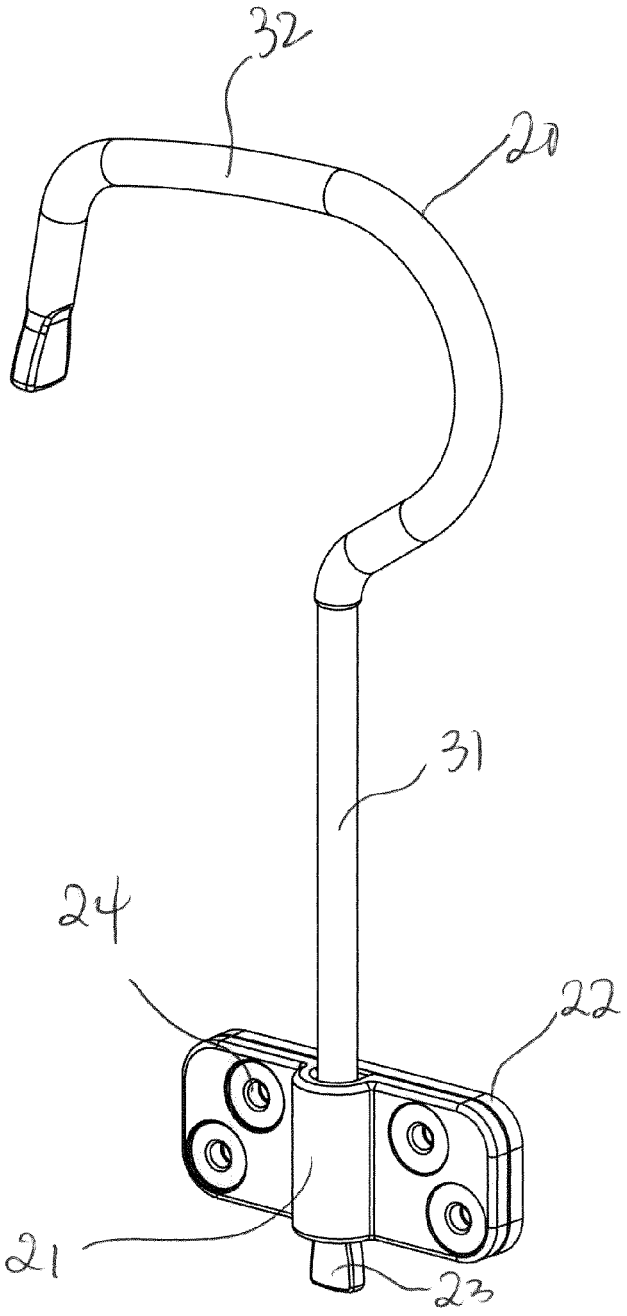
FIG. 20: An isometric view of an embodiment of a travel bag hanging means of a garment hanger system with mounting plates according to the present disclosure in a lowered state.
Figure 21:
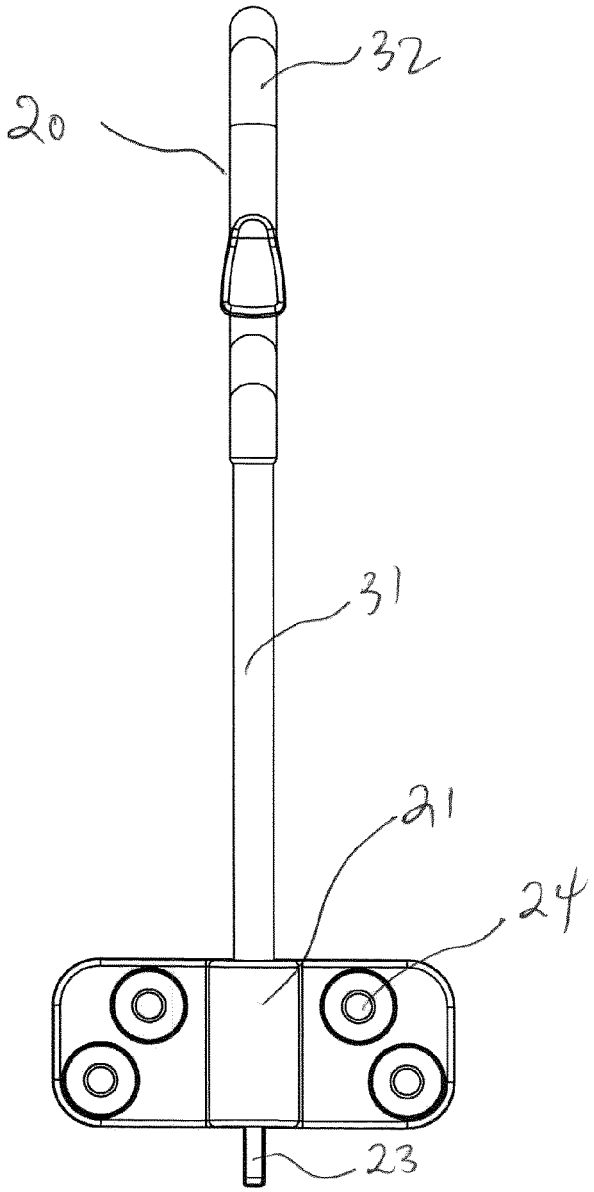
FIG. 21: A front view of an embodiment of a travel bag hanging means of a garment hanger system according to the present disclosure pivoted to a position perpendicular to the mounting plates in an extended state for hanging the travel bag.
Figure 22:
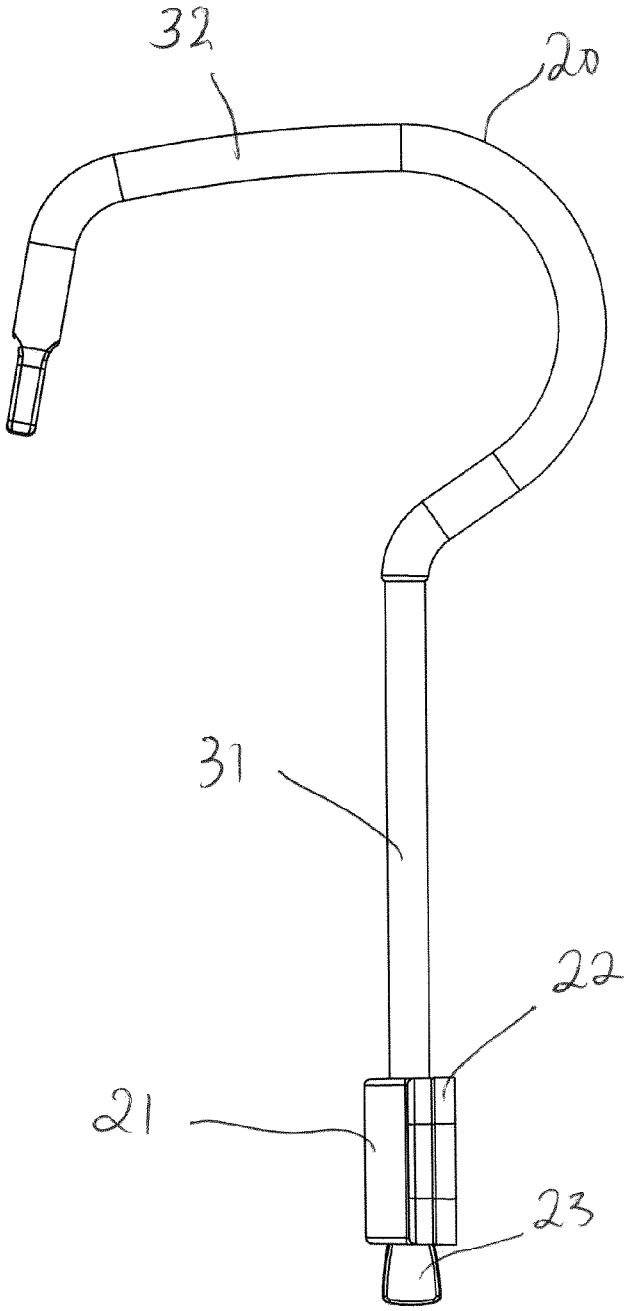
FIG. 22: A right side view of an embodiment of a travel bag hanging means of a garment hanger system according to the present disclosure pivoted to a position perpendicular to the mounting plates in an extended state for hanging the travel bag.
Figure 23:
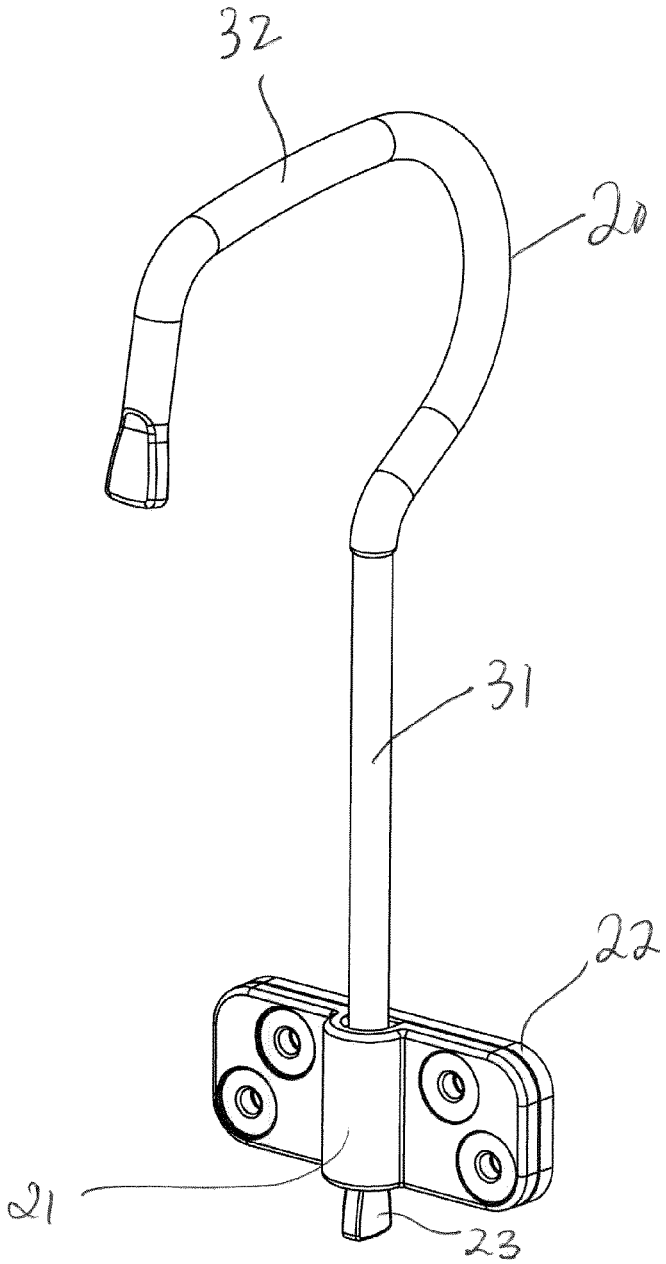
FIG. 23: An isometric front view of an embodiment of a travel bag hanging means of a garment hanger system according to the present disclosure pivoted to a position perpendicular to the mounting plates in an extended state for hanging the travel bag.

In an alternative embodiment as shown in FIG. 4, the protrusion overhangs 15 define a grooved path 29 on each side 30 of the hanger slider 2.

When the hanger slider 2 is fully or partially engaged with the support arm 4, recesses 3 of the hanger slider 2 are covered by the top 12 of the support arm 4 and any clothes hangers resting in the recesses 3 are thereby secured in the hanger slider 2 of the garment hanger member 1. Once the hanger slider 2 is fully engaged with the support arm 4, a catch release button 10 proximal to one end 16 of the hanger slider 2 engages with and extends through an opening 11*a* proximal to one end of the top 12 of the support arm 4 and locks the hanger slider 2 underneath the support arm 4 in a fully engaged (retracted) state. The button 10 can be depressed to release the hanger slider 2 and allow it to be extended outwards from under the support arm 4. Once the hanger slider 2 is in the fully disengaged (extended) state relative to the support arm 4, the button 10 is released into an opening 11*b* proximal to the other end of the top 12 of the support 4 arm. In this manner, the garment hanger member can be locked in a fully extended state where the recesses 3 of the hanger slider 2 are no longer covered by the top 12 of the support arm 4, and any clothes hangers resting in the recesses 3 can be removed from the hanger slider 2 of the garment hanger member 1.

In one embodiment the top of the catch release button is angled by about 5° so as to securely lock the hanger slider and support arm (slider rail) relative to one another. In another embodiment (not shown), the button may include a protruding fin portion on top that engages and runs through a slit or narrow channel etched into the face or underside of the slider rail which slides over the button between the two locking position openings.

Figure 24:
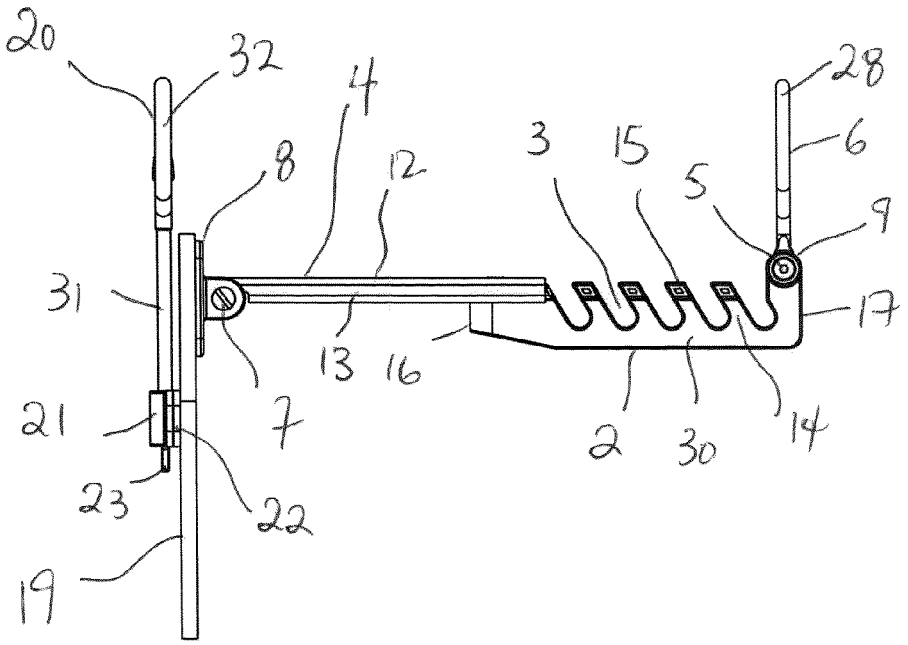
FIG. 24: A side view of a garment hanger system according to the present disclosure, mounted on a board, wherein the garment hanger mechanism is in an expanded state.
Figure 25:
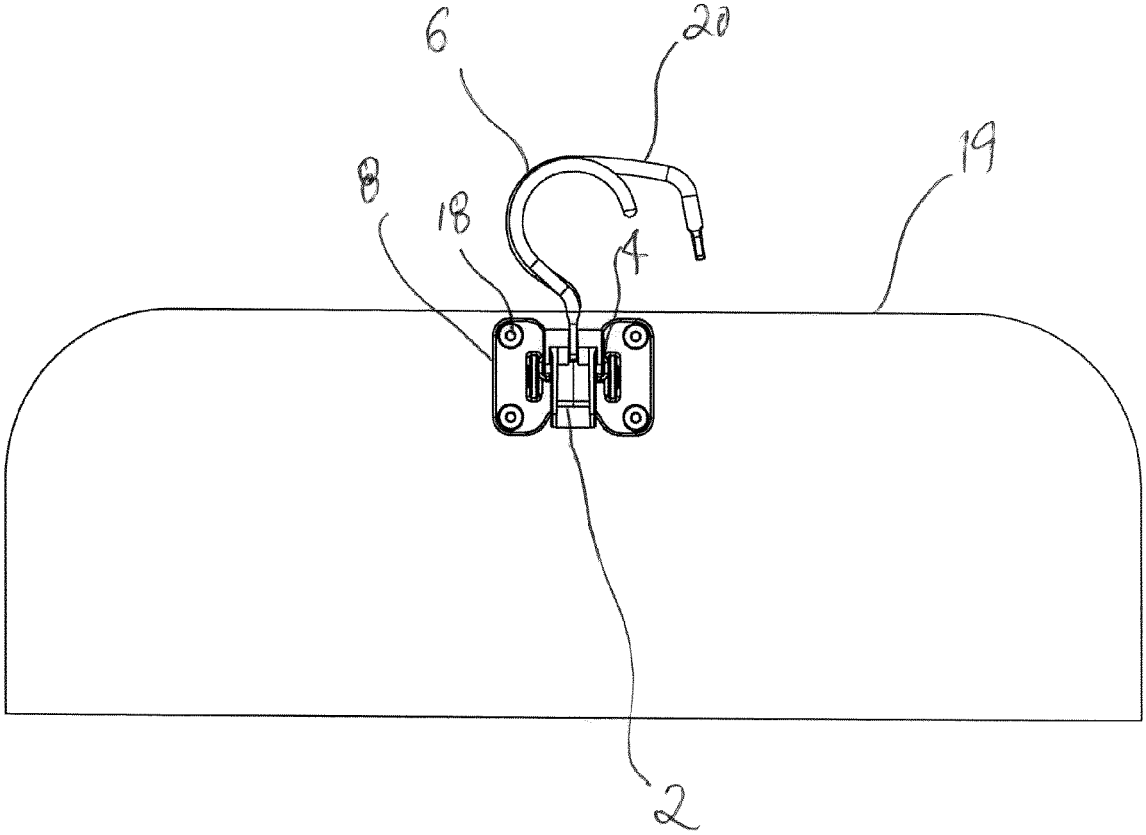
FIG. 25: A front view of a garment hanger system according to the present disclosure, mounted on a board, wherein the garment hanger mechanism is in an expanded state.
Figure 26:
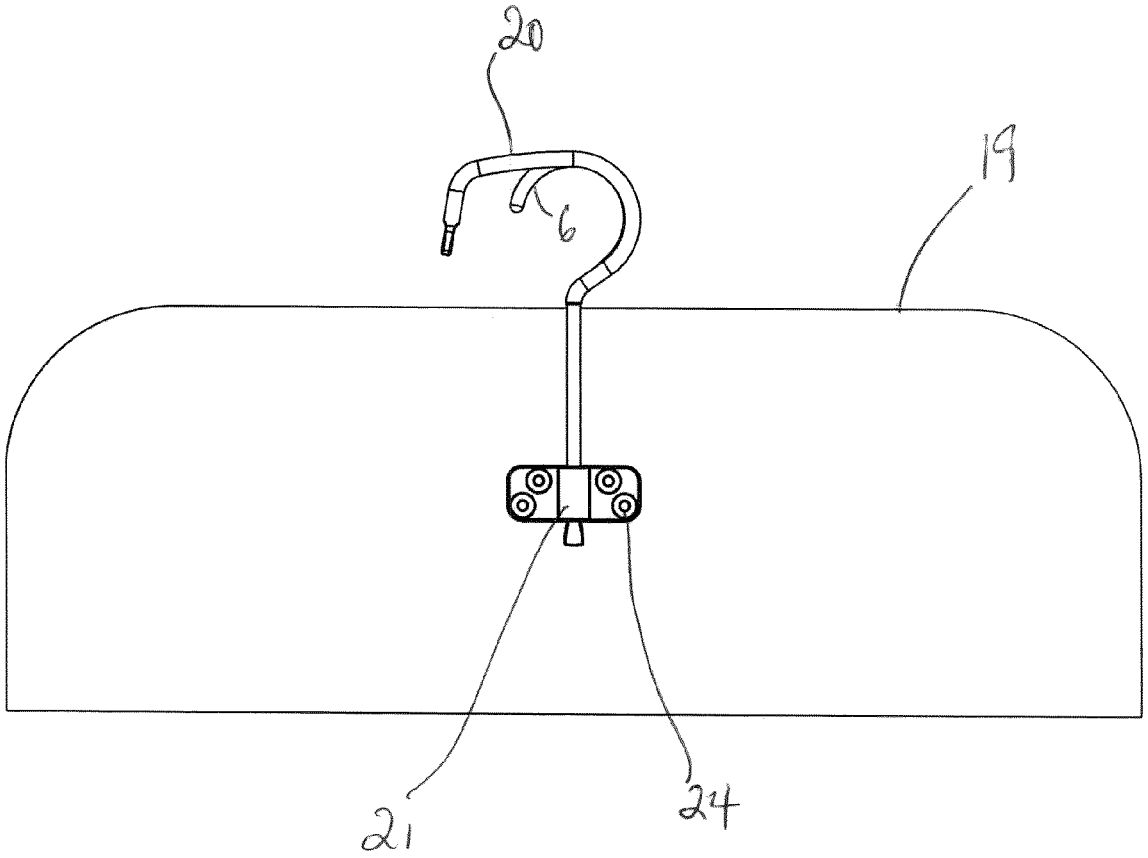
FIG. 26: A back view of a garment hanger system according to the present disclosure, mounted on a board, wherein the garment hanger mechanism is in an expanded state.
Figure 27:
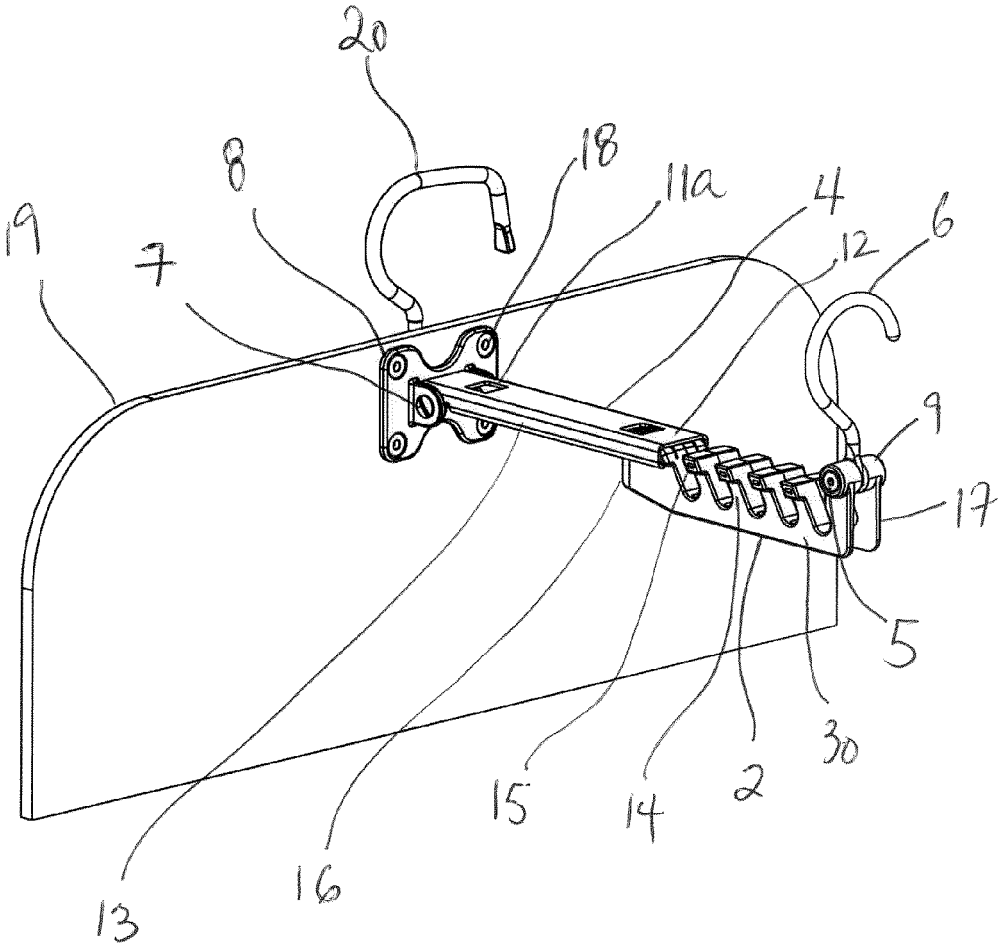
FIG. 27: An isometric view of a garment hanger system according to the present disclosure, mounted on a board, wherein the garment hanger mechanism is in an expanded state.

As shown in FIGS. 24, 25 and 27, the support arm 4 may be connected to a board 19 using the mounting plate pivot 8 and applying screws, rivets, or bolts through holes 18. A pivot (Chicago) bolt 7 with a spring lock washer for tensioning connects the support arm 4 so that it can be articulated to move the garment hanger member 1 from a packed to an unpacked position. The board 19 and garment hanger member 1 are in this way integrated into the panel of a travel bag. The securing means (support arm) 4 can be made of stainless steel (e.g. 16 gauge) and remains operatively connected at all times to the member portion (hanger slider)

2 of the garment hanger member 1, so that it can function as a structural support when the hanger slider 2 is retracted and extended.

Figure 3C:
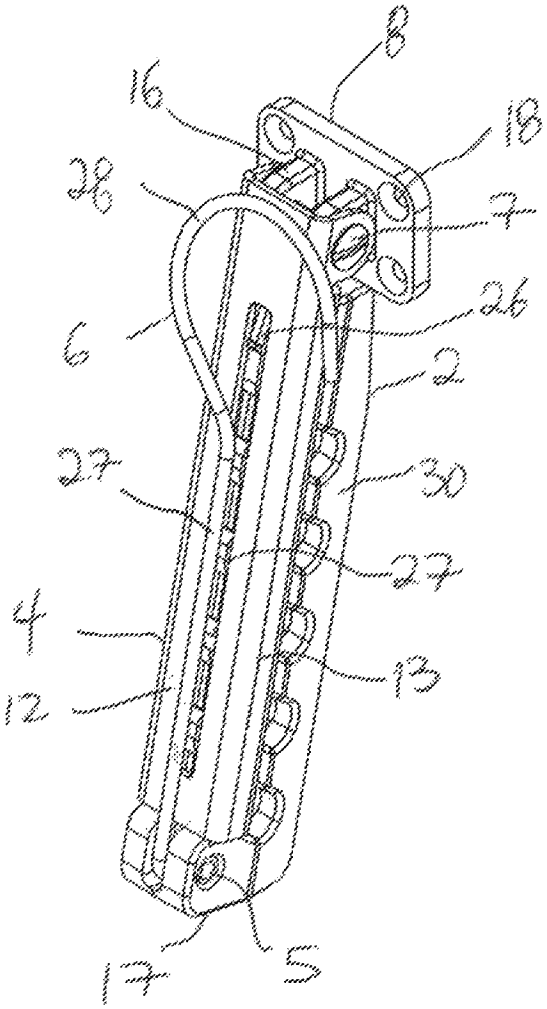
FIG. 3A-3C: Various views of another embodiment of a garment hanger mechanism according to the present disclosure in a collapsed state where A=side, B=front and C=isometric views of the garment hanger mechanism.
Figure 3B:
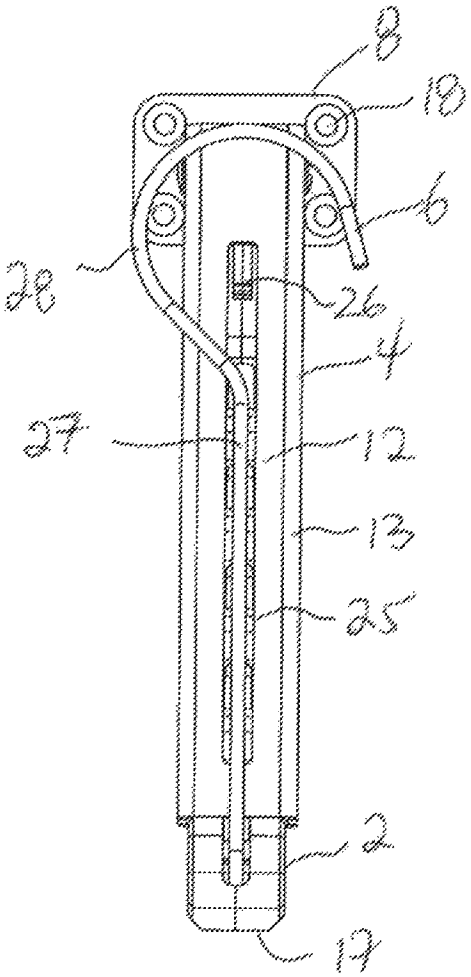
Figure 3A:
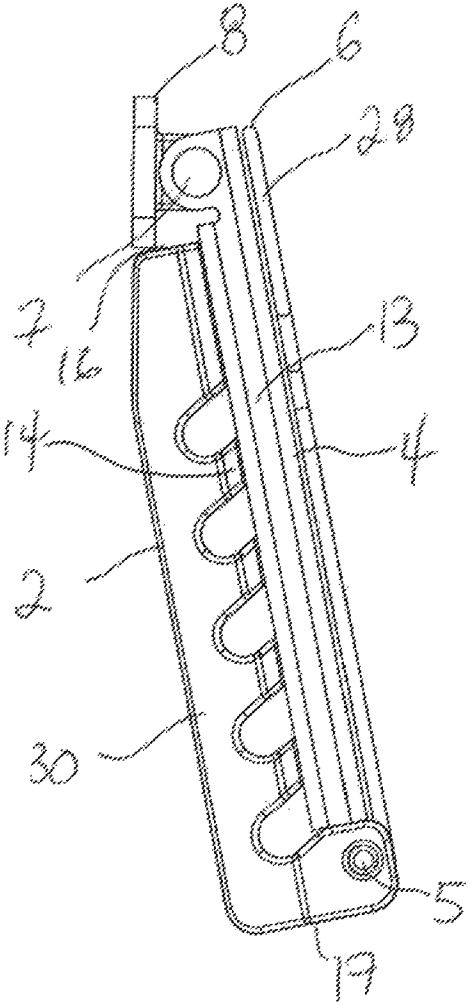

In an alternative embodiment of a supported garment hanger mechanism shown in FIGS. 3 and 4, an opening 25 which extends substantially along the length of the top 12 of the support arm 4 and proximal to the end 16 the hanger slider 2 has an elevated portion (stopper means) 26 which fits within the opening 25 and prevents the hanger slider 2 from being disconnected from the support arm 4 when fully extended outwards from underneath it.

At the end 17 of the hanger slider 2, which is not attached to the support arm 4, a hook 6 (mechanism hanging means) is connected to the hanger slider 2 using a shoulder machine screw 5 with a spring lock washer for tensioning and hex nut 9. This allows the hook 6 to be articulated from an inactive to an active position. The hook 6 can be made of 4 gauge steel wire rod. In an inactive position the hook 6 is parallel to and rests over the top 12 of the support arm 4 when the hanging slider 2 is retracted underneath the support arm 4 to facilitate collapsing and packing the garment hanger member 1 (and therefore the mechanism) with clothes hangers and apparel within a folded (closed) travel bag. In an active position, the hook 6 is perpendicular to the top 12 of the support arm 4 to facilitate hanging the garment hanger member 1 (and therefore the mechanism) with clothes hangers and apparel in a closet or from a clothes rack when a travel bag is unfolded (open).

In an alternative exemplary embodiment, shown in FIGS. 3 and 4, the length of the stem portion 27 of the hook 6 can be elongated such that the hook portion 28 rests on the top 12 of the support arm 4 beyond the opening 25 provided for stopping or locking the hanger slider 2 into a retracted or extended position, and relative to the support arm 4.

A lip or tab (not shown) can be provided in the top 12 of the support arm 4 so that the hook portion 28 of the hanging means (hook 6) can be clipped and secured in an inactive position.

As illustrated in the figures, the garment hanger mechanism can be used in both collapsed (FIGS. 5-8) and expanded states (FIGS. 9-12). A collapsed state may be reflective of the garment hanger member (and mechanism) in a packed position within a folded (closed) travel bag, and may be maintained when the travel bag is unfolded and hung using a bag hanging means. In one embodiment of a collapsed state, the hanger slider 2 of the garment hanger member is retracted underneath (engaged) with the support arm 4 and in a vertical orientation. In another embodiment of a collapsed state, the garment hanger member is articulated about 90° to a horizontal orientation, perpendicular to the panel of the travel bag.

An expanded state may be reflective of the garment hanger member (and mechanism) in an unpacked position to allow for the removal of hangers when a travel bag is unfolded (open), hanging in a closet, on a clothing rack (see FIG. 39), or from a door. In the unpacked position, the hanger slider 2 and support arm 4 have been separated or extended away from another such that the hanger slider 2 is disengaged from underneath the support arm 4 of the garment hanger member 1.

When in an expanded state, the garment hanger member may remain in a vertical orientation or may be articulated about 90° (degrees) to a horizontal orientation. In one embodiment, the garment hanger member may be articulated at its point of attachment to the board insert within a panel of the travel bag.

In yet another embodiment, the garment hanger member may be locked in a vertical or horizontal orientation relative to the unfolded travel bag hanging in a closet, on a clothing rack, or from a door. For example, when the hanger slider of the garment hanger member is locked in a horizontal orientation relative to the door from which the travel bag is hung clothing can be accessed in the same manner as when the garment hanger member is hung in a closet using the additional support provided by the mechanism hanging means attached to garment hanging member.

Garment Hanger System

With reference to FIGS. 13-27, a garment hanger system is formed by the cooperative application of a bag hanging means with a garment hanger mechanism.

An embodiment of the bag hanging means is illustrated in FIGS. 13-23. The means is essentially an elongated bag hook 20 made of bent wire rod steel (4 gauge) with a stem portion 31 and hook portion 32 sandwiched between two plates 21 and 22. The hook may have scratch resistant rubber coating. The end 23 of the stem portion 27 prevents the bag hook 20 from falling out from in between the two plates when extended upwards to an active position, while the hook portion 32 prevents the hook 20 from slipping through the plates when lowered to an inactive position.

With reference to FIGS. 24-27, the front 21 and back 22 plates are mounted onto a board 19 on a face opposite the face onto which the garment hanger mechanism is mounted. The mounted garment hanger system is integrated into a travel bag by enveloping the board into a panel of a travel bag and then mounting the bag hanging means and garment hanger mechanism (see FIGS. 35, 36 and 39). The bag hook 20 can further be mounted in a zippered pocket such that when it is in an inactive position lowered between the front 21 and back 22 plates, it can be safely secured by closing the zipper 60 (see FIGS. 29 and 37).

The channel formed between the front 21 and back 22 plates for receiving the stem portion 31 of the hook 20 allows the hook 20 to be pivoted for use in different orientations and accordingly for different applications. When the plane of the hook portion 32 is aligned with the plane of the plates 21 and 22 the hook 20 can be used to hang a travel bag from a closet rod or clothes rack. In this application, the hanger slider 2 could be extended to expand the garment hanger member 1 and use the hook 6 to hang the member from the closet rod or clothes rack.

When the bag hook 20 is pivoted to a position perpendicular to the plane of the front 21 and back 22 mounting plates with the hook portion 32 position over and facing beyond the back plate 22 (see FIGS. 21-23), the bag hook 20 can be used to hang the travel bag from the top of a door. In one embodiment of this application, the hanger slider 2 could remain in a retracted and collapsed state securing any clothes hangers in the recesses 3 underneath the top 12 of the support arm (slider rail) 4 and be extended as needed to remove clothes hangers from the hanger slider 2.

Figure 45:
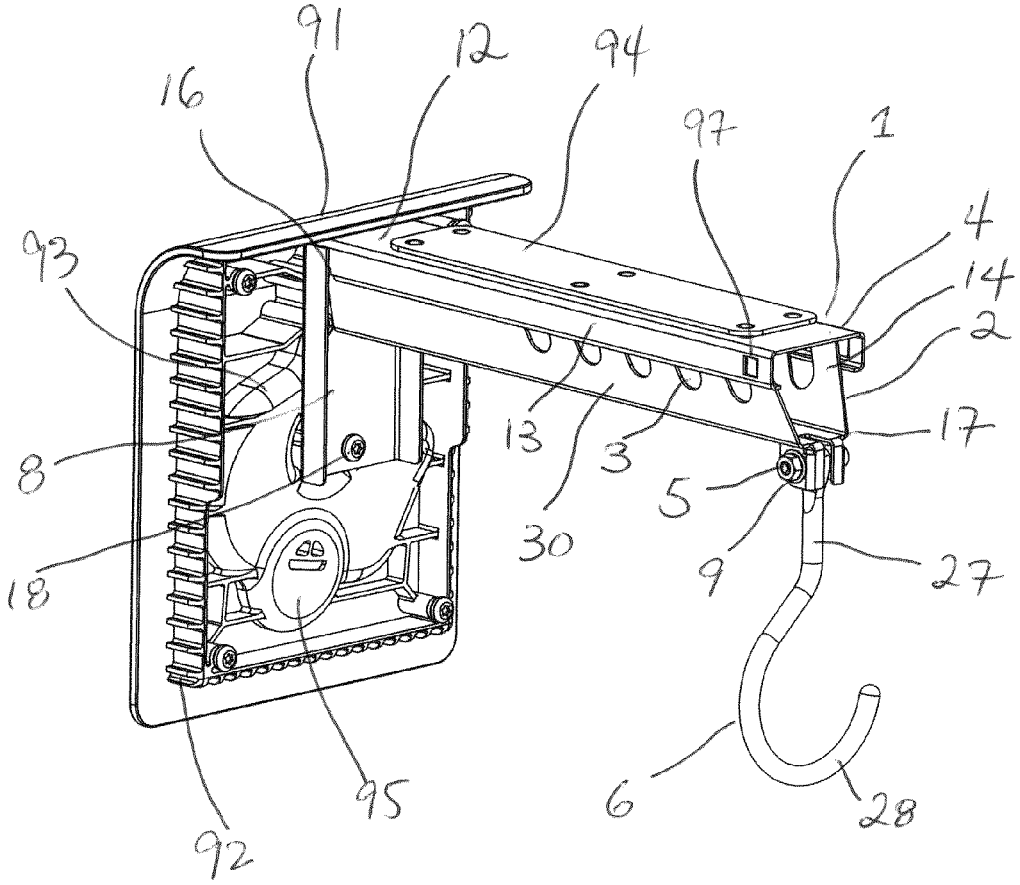
FIG. 45: A first isometric view of an embodiment of the garment hanger mechanism/system according to the present disclosure configured as a slider system with a trough shaped member portion (travel mode).
Figure 46:
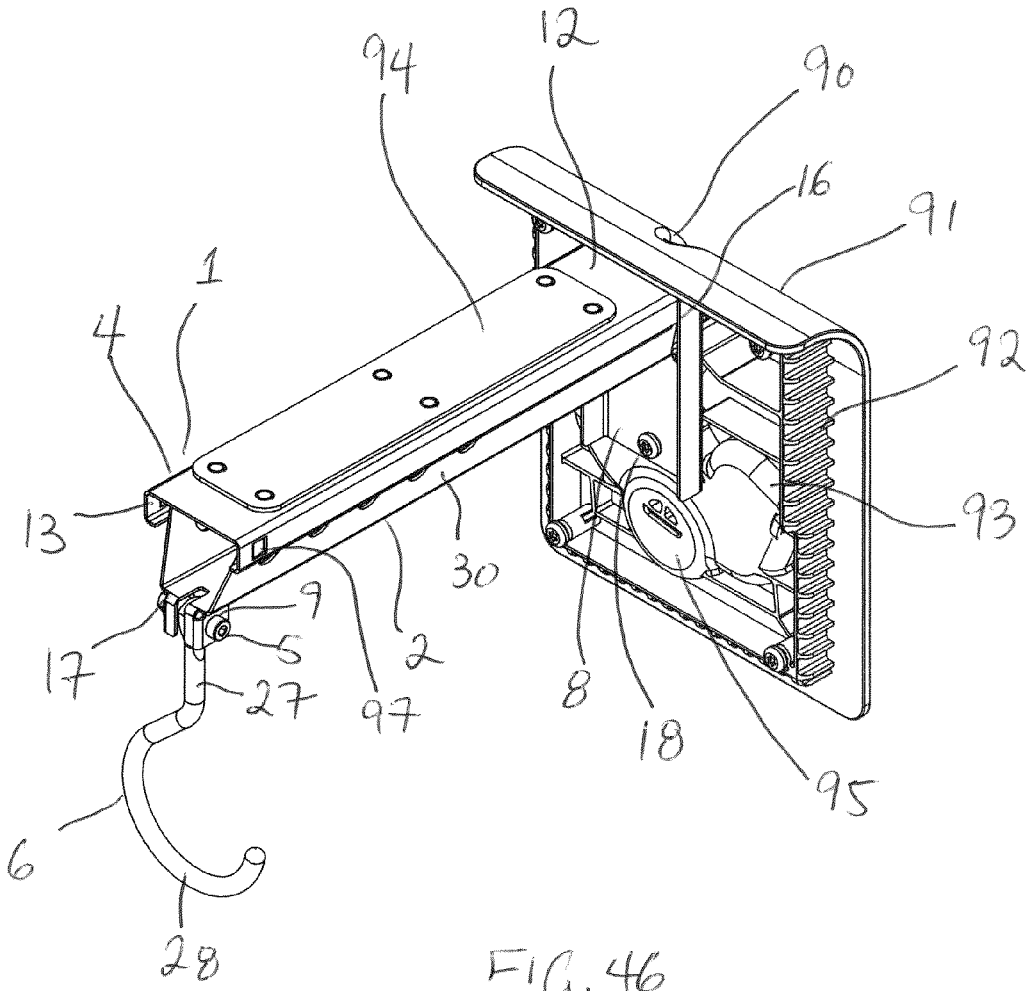
FIG. 46: A second isometric view of an embodiment of the garment hanger mechanism/system according to the present disclosure configured as a slider system with a trough shaped member portion (travel mode).
Figure 47:
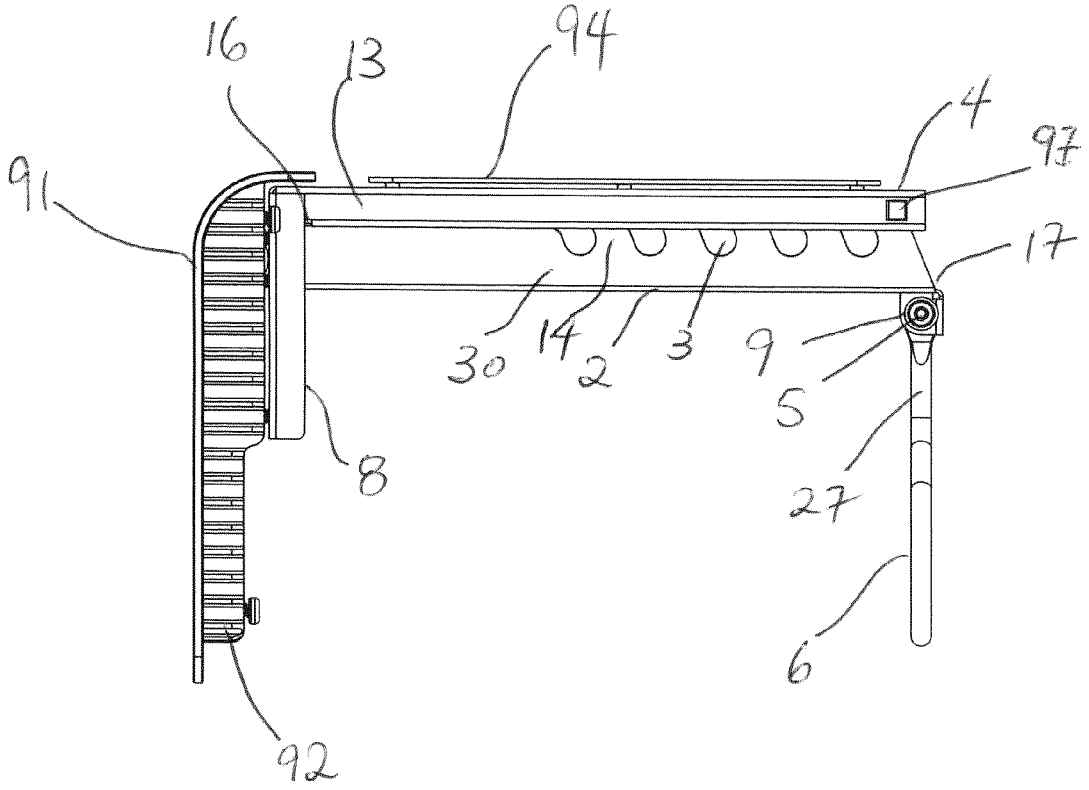
FIG. 47: A side view of an embodiment of the garment hanger mechanism/system according to the present disclosure configured as a slider system with a trough shaped member portion (travel mode).
Figure 48:
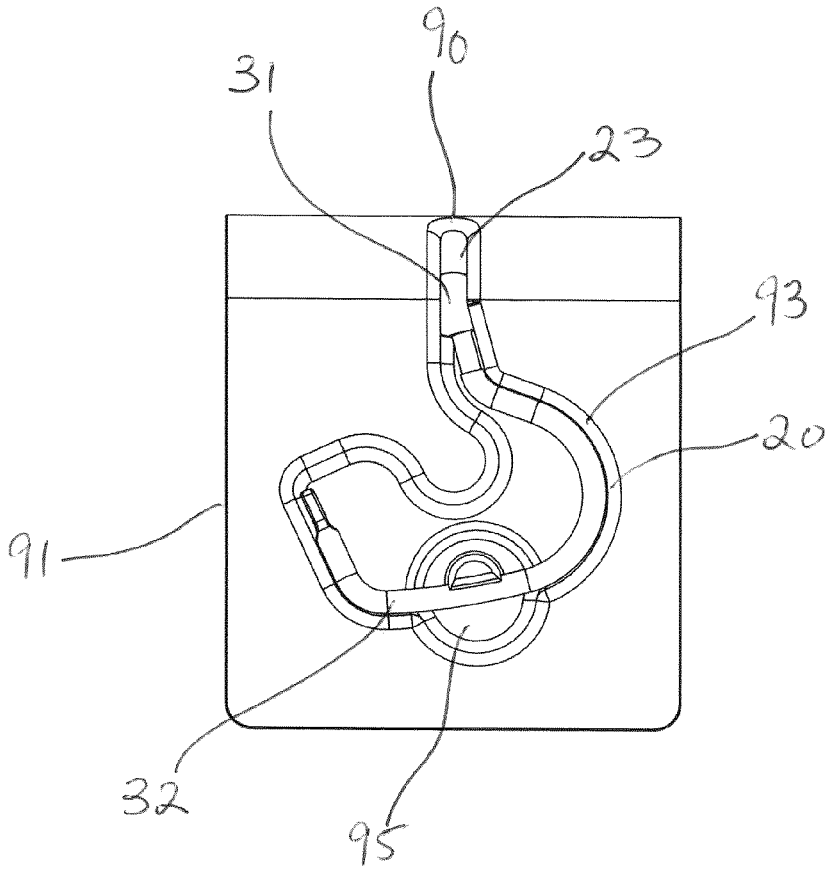
FIG. 48: A back view of an embodiment of the garment hanger mechanism/system (depicting the bag hanging means) according to the present disclosure configured as a slider system with a trough shaped member portion (travel mode).
Figure 49:
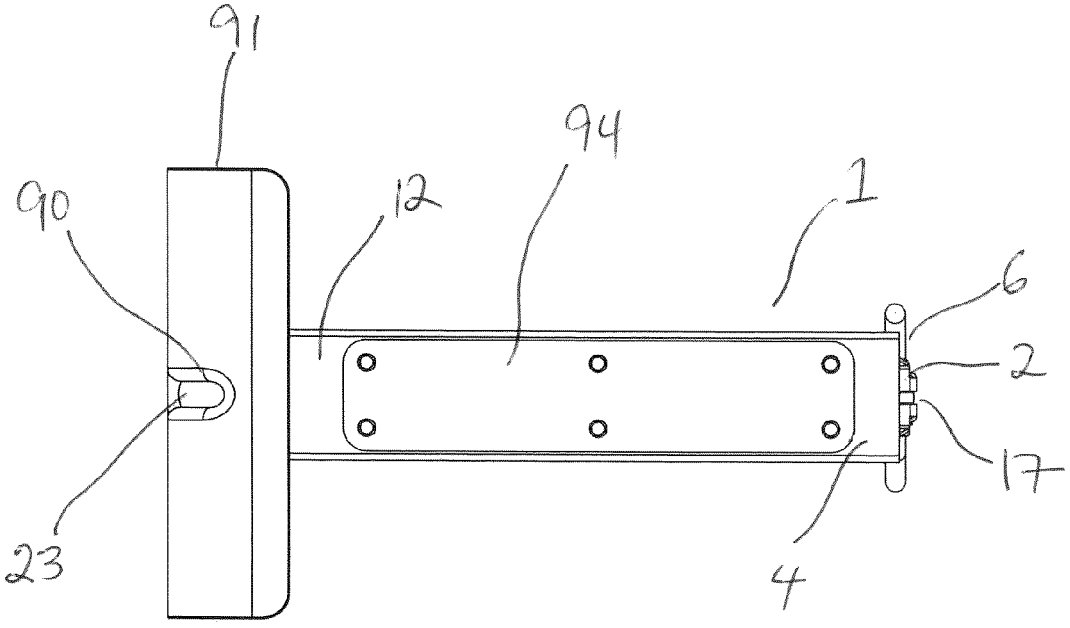
FIG. 49: A top view of an embodiment of the garment hanger mechanism/system according to the present disclosure configured as a slider system with a trough shaped member portion (travel mode).
Figure 50:
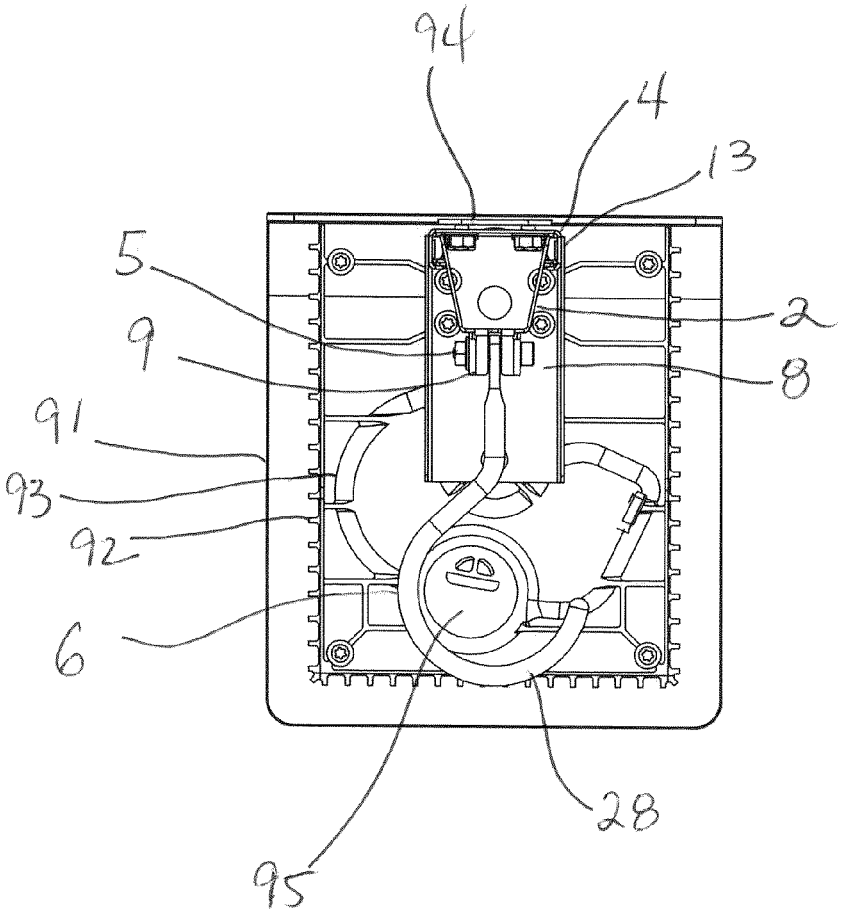
FIG. 50: A front view of an embodiment of the garment hanger mechanism/system according to the present disclosure configured as a slider system with a trough shaped member portion (travel mode).
Figure 51:
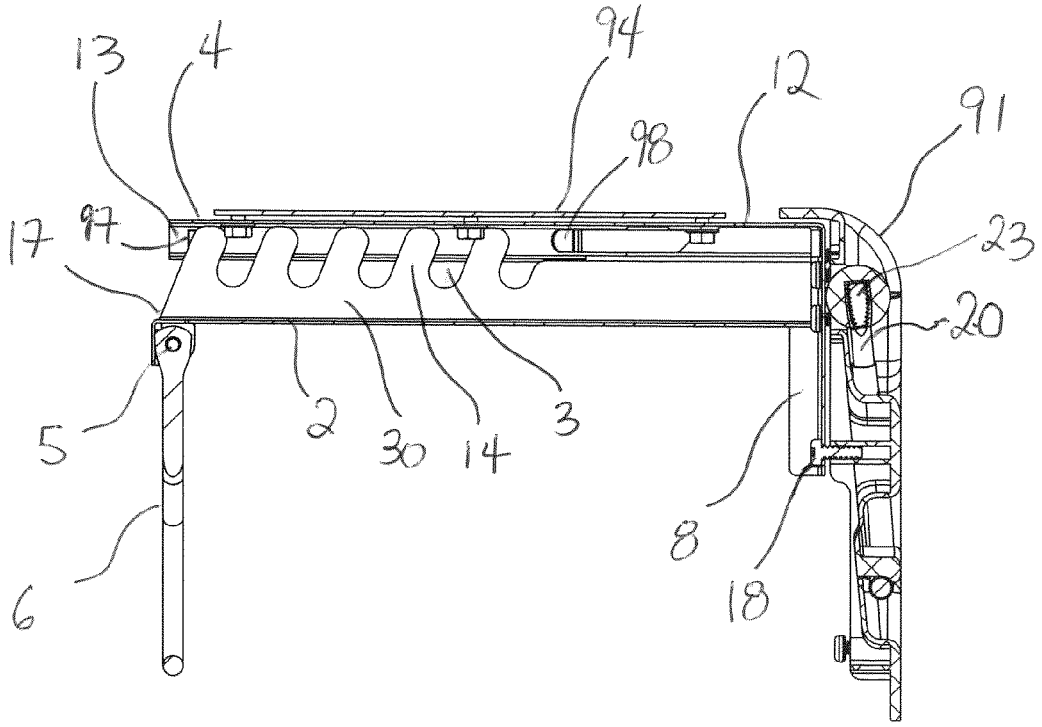
FIG. 51: A cross-sectional side view of an embodiment of the garment hanger mechanism/system according to the present disclosure configured as a slider system with a trough shaped member portion (travel mode).
Figure 52:
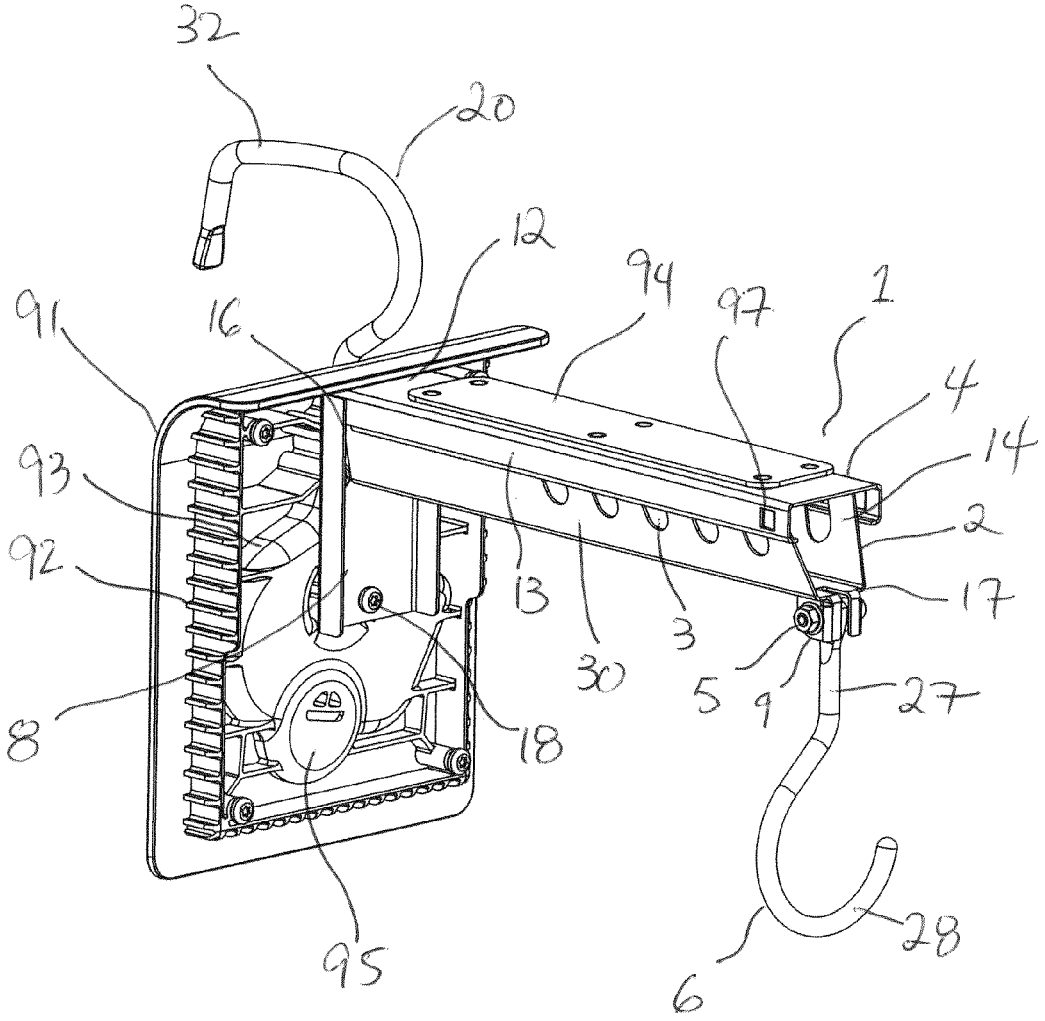
FIG. 52: A first isometric view of an embodiment of the garment hanger mechanism/system according to the present disclosure configured as a slider system with a trough shaped member portion (door mode, closed).
Figure 53:
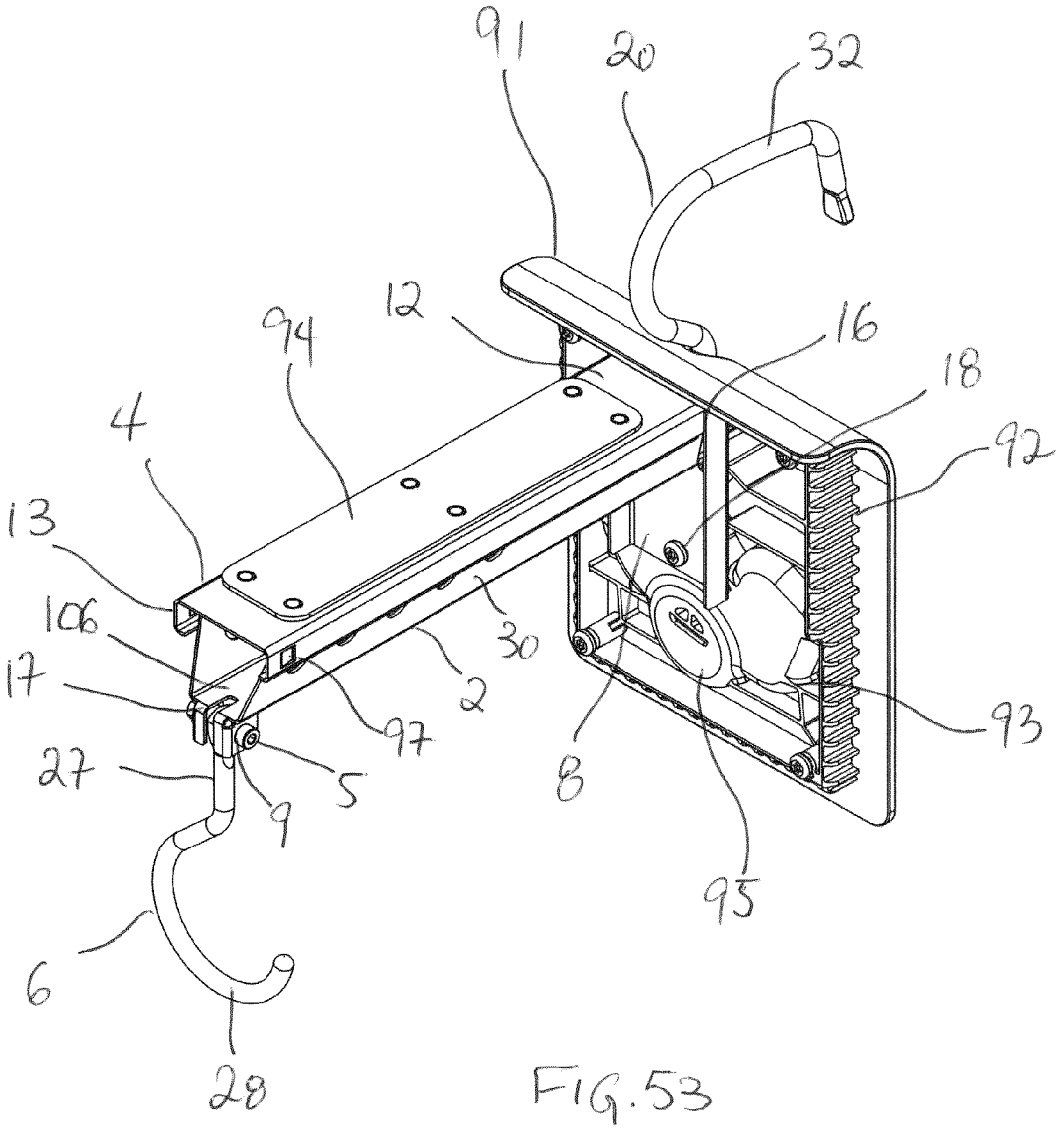
FIG. 53: A second isometric view of an embodiment of the garment hanger mechanism/system according to the present disclosure configured as a slider system with a trough shaped member portion (door mode, closed).
Figure 54:
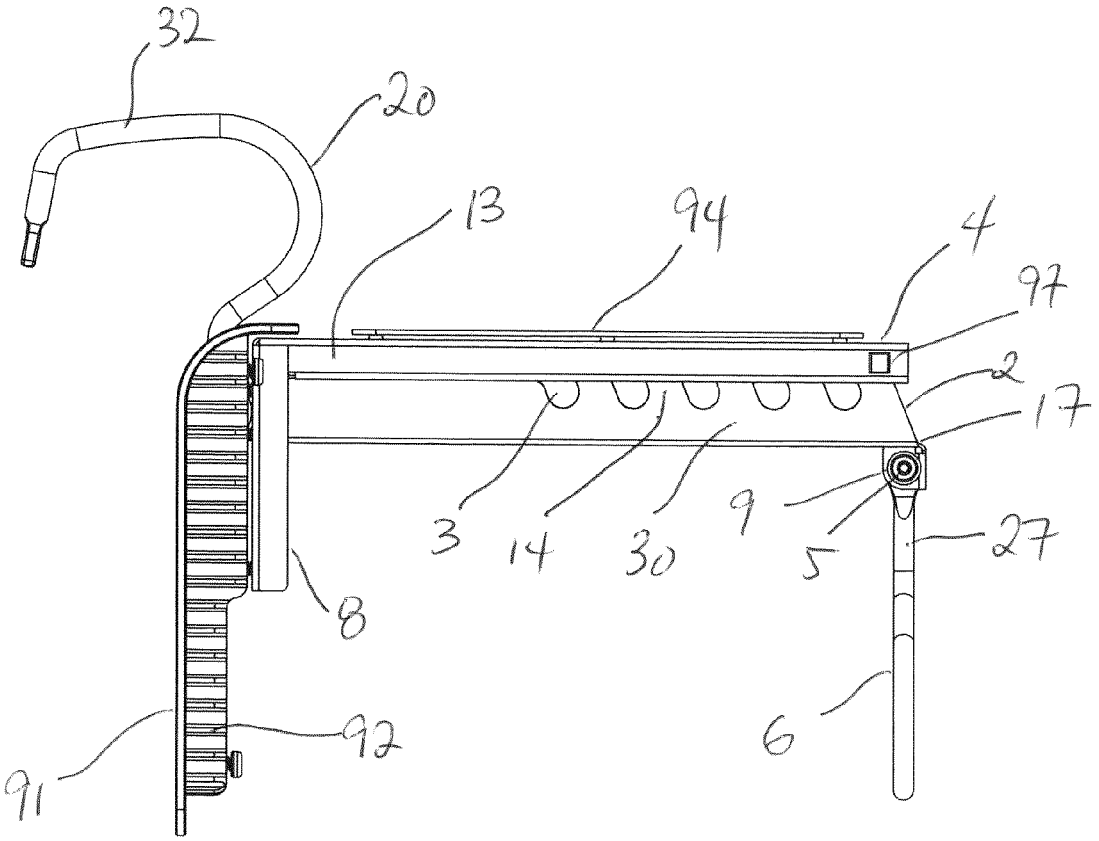
FIG. 54: A side view of an embodiment of the garment hanger mechanism/system according to the present disclosure configured as a slider system with a trough shaped member portion (door mode, closed).
Figure 55:
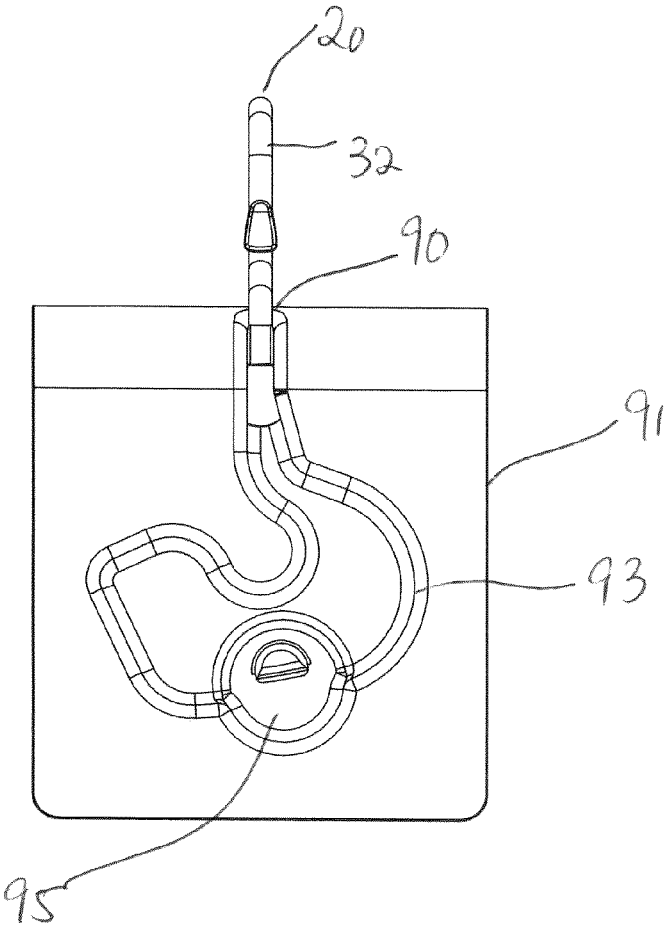
FIG. 55: A back view of an embodiment of the garment hanger mechanism/system (depicting the bag hanging means) according to the present disclosure configured as a slider system with a trough shaped member portion (door mode, closed).
Figure 56:
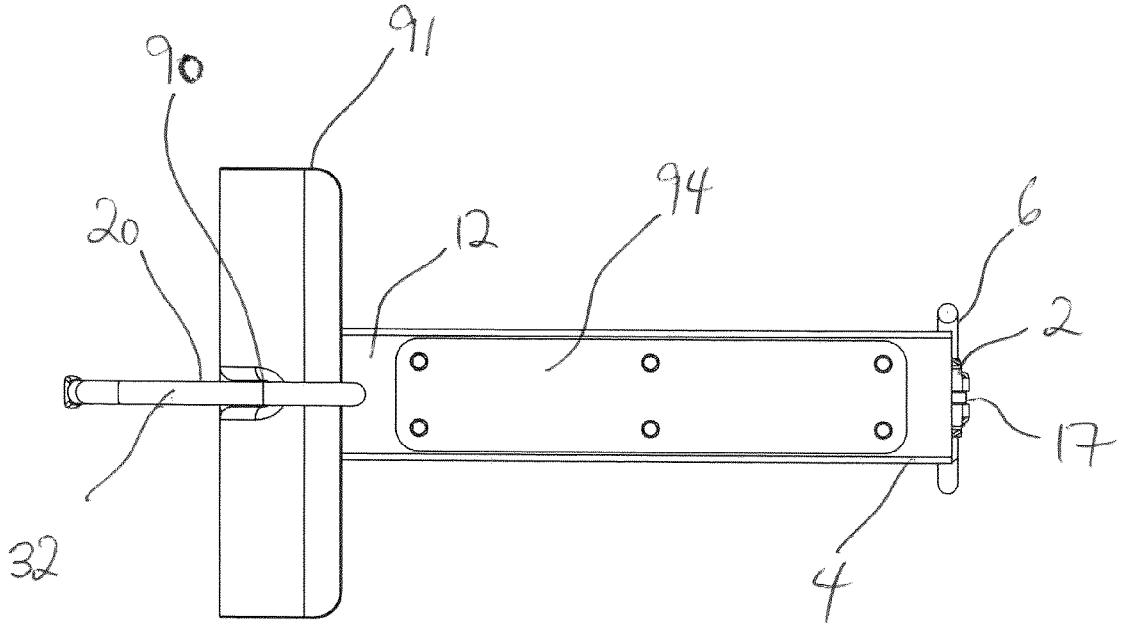
FIG. 56: A top view of an embodiment of the garment hanger mechanism/system according to the present disclosure configured as a slider system with a trough shaped member portion (door mode, closed).
Figure 57:
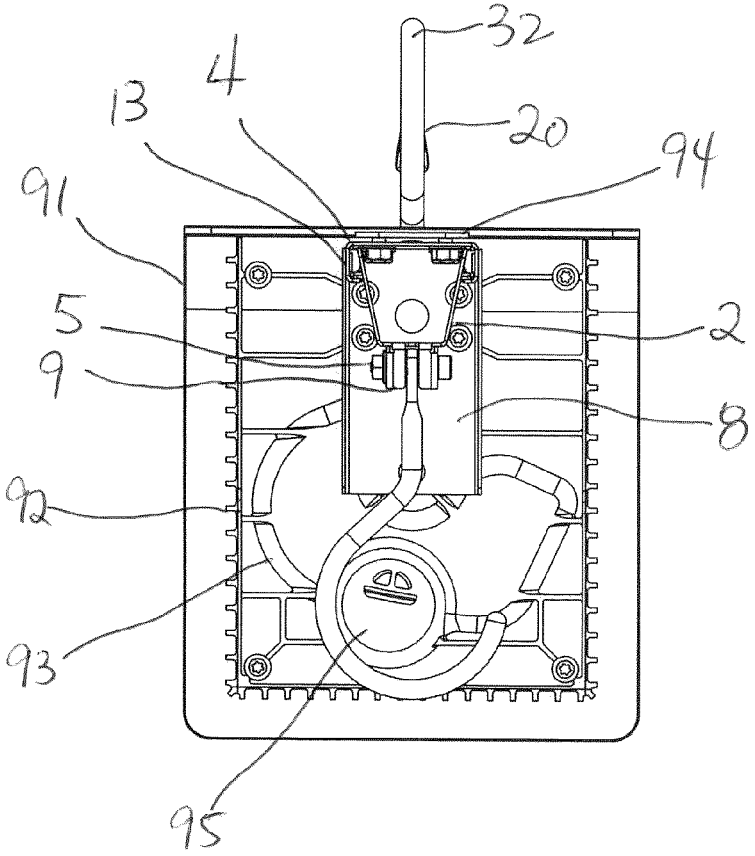
FIG. 57: A front view of an embodiment of the garment hanger mechanism/system according to the present disclosure configured as a slider system with a trough shaped member portion (door mode, closed).
Figure 58:
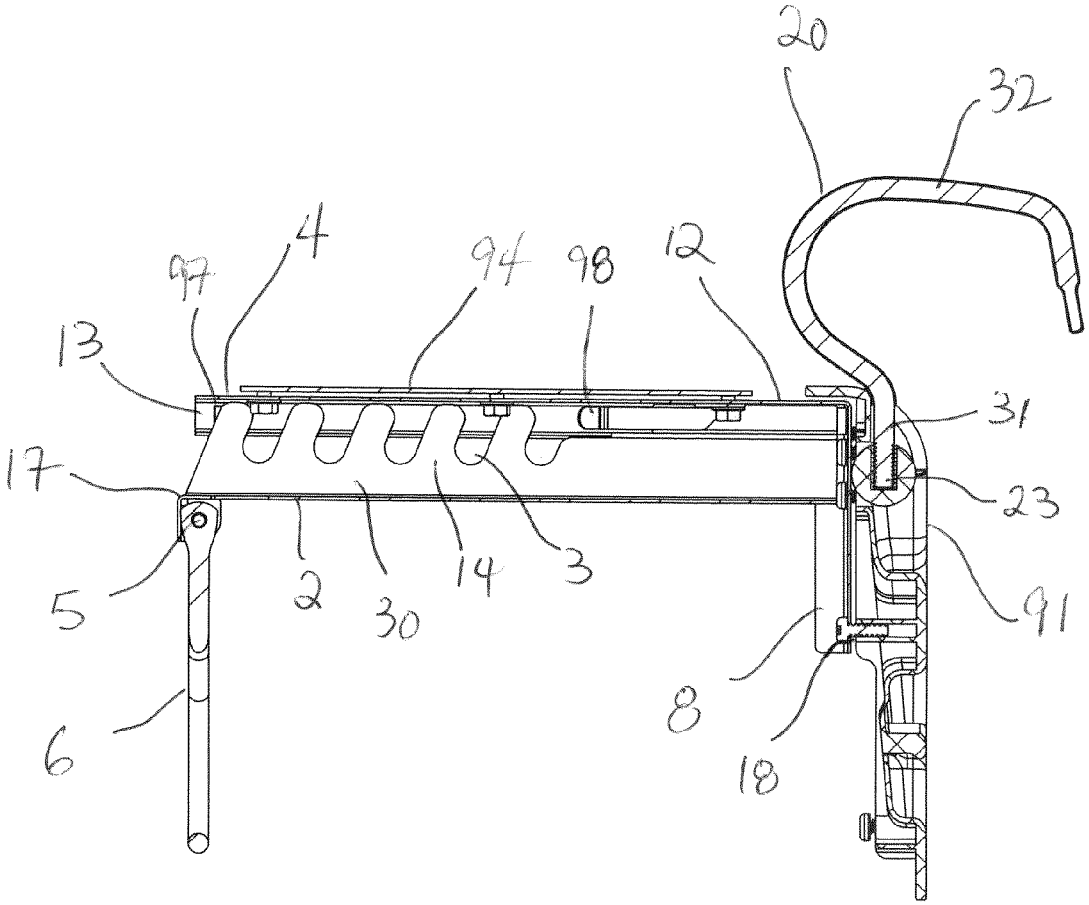
FIG. 58: A cross-sectional side view of an embodiment of the garment hanger mechanism/system according to the present disclosure configured as a slider system with a trough shaped member portion (door mode, closed).

Example 2: Supported Garment Hanger Mechanisms and Systems for Shell Case Travel Bag Other exemplary embodiments of supported, garment hanger mechanisms and systems for (semi-rigid or rigid) shell case travel bags are provided as illustrated in FIGS. 45-106. Like the travel bag depicted in FIGS. 28 to 39, shell case bags can have a sufficiently flexible construction to provide for the additional functionalities described in Example 1 for the travel bag, such as the option to create a shelf using one of the panels of the bag and a further hanging means (e.g. a strap).

In FIGS. 45 to 51, aspects of an embodiment of the garment hanger mechanism and system are shown for when a travel bag is packed and in travel mode. The garment hanger mechanism 1 is in the form of a slider system, including a hanger slider (member portion 2) and support arm slider rail 4. The hanger slider 2 has a trough configuration with a base portion 106 and angled walls 30 which engage with the slider rail 4. The garment hanger mechanism 1 is attached to molded structure 91 via a plate/bracket 8 using screws 18 to facilitate securing the mechanism to a panel of a travel bag. The slider rail 4 is also attached to plate 94 to facilitate securing the mechanism to another panel of the travel bag. The mechanism hanging means 6 is attached to the free end 17 of the hanger slider 2 using a shoulder machine screw 5 with a spring lock washer for tensioning and hex nut 9, in order to allow the hook 6 to articulate upwards from the stowed position indicated in the figures.

In the closed, travel mode for the garment hanger mechanism the hanger slider 2 is secured underneath the slider rail 4 by two tabs 98. Each tab 98 engages with a wall 30 of the hanger slider 2, as shown the cross-sectional view of FIG. 51.

In another embodiment shown in FIGS. 107 to 112, the hanger slider (member portion) has a single recess 3. A loop 113 formed at the front end of the slider rail 4. The loop facilitates the folding of the open travel bag when packing by way of a hooking means attached to a panel (not shown) of the travel bag. For example, the hooking means may be attached proximal to or at the opposite end of the travel bag from the panel(s) to which the garment hanger mechanism is connected.

The stability of the garment hanger mechanism and system, namely its 90° (degree) orientation relative to the plane of the main panel portion of the moulded structure 91, can be reinforced. In the embodiment of FIGS. 107 to 112, reinforcement of the garment hanger mechanism and system is achieved using two gussets 114. Alternatively, the 90° joint of the garment hanger mechanism can be reinforced with welding, or a brace can be used on each side to span the 90° angle between of the plate/bracket 8 (as labelled in FIG. 45) and the slider rail 4, in a manner similar to the gussets 114.

The moulded structure 91 also functions as a stowing compartment for the bag hanging (hook) means 20. Evident from the figures is a channel 93 and securing means 95 for stowing the bag hanging means. The wall structure 92 provides depth to allow for both the stowing of the bag hanging means on one side of the moulded structure 91 (see FIG. 48) and attachment of the plate/bracket 8 (which secures the garment hanger mechanism) to the other side of the moulded structure 91.

FIGS. 71 to 77 illustrate the integration of the garment hanger mechanism 1 and system in the closed (travel) mode, in a travel bag. As integrated into the travel bag, the garment hanger mechanism 1 is attached to panels (walls) 43 and 48. A finishing panel 96 coupled to the moulded structure 91 using screws, rivets, or bolts, facilitates the complete integration of the moulded structure 91 to the panel (wall) 48 of the bag.

Panel (wall) 45 defines the top of the travel bag. The moulded structure 102 provides the compartment housing for a retractable bag handle 41. The arms of the bag handle 41 retract in and out of the bag along guide rails 103 which extend for the length of panel (wall) 48 to the base (bottom) of the bag at panel (wall) 46. A wheel assembly comprising wheels 47 and support structure 104 is integrated at the bottom wall 46 of the bag. Handle features 100 and 101 and bumper features 105 are also shown as standard elements of a travel bag.

In FIGS. 52 to 58, aspects of an embodiment of the garment hanger mechanism and system are shown for when a travel bag is to be hung from a door or in a closet, still packed (closed, not extended). As illustrated, the bag hanging means 20 is no longer in its stowed position in the moulded structure 91. It is articulated about the end attached to the moulded structure 91 at the channel 93 entry point 90. For hanging the hook 20 on a door it is rotated to a position perpendicular to the plane of the moulded structure 91 (see FIG. 55).

In FIGS. 59 to 63, aspects of an embodiment of the garment hanger mechanism and system are shown for when a travel bag is to be hung from a door, unpacked (open, extended). The hanger slider 2 is extended outward from underneath the slider rail 4. After the last recess 3 has cleared the slider rail 4, the remainder of the hanger slider 2 incorporates a lip 99 which turns outward to engage and rest on the opposing lip of the slider rail wall 13 that turns in towards the wall 30. A tab structure 97 keeps the slider rail and hanger slider connected so that they do not fully disengage. The additional length of the hanger slider 2 that remains engaged with the slider rail 4 provides additional support to maintain the integrity of the garment hanger mechanism when in its extended (open) mode so that it can hold the weight of hung garments.

FIGS. 78 to 84 illustrate the integration of the garment hanger mechanism and system in a travel bag, in an open mode for a door, or partially implemented travel closet configuration. As integrated, all recesses available for receiving hangers with garments clear the panel (wall) 43 (see FIGS. 80, 82 and 84).

In FIGS. 64 to 70, aspects of an embodiment of the garment hanger mechanism and system are shown for when a travel bag is to be hung in a closet, unpacked (open, extended). The primary difference in this mode compared the door mode depicted in FIGS. 59 to 63 is the change in position of the mechanism hanging means (hook) 6 which is articulated about the end attached to the hanger slider 2 to a vertical upward pointing orientation, from a vertical downward pointing orientation. In this manner the two hooks 20 and 6 are aligned in parallel plains to be able to hook onto a closet rod.

FIGS. 85 to 91, illustrate the integration of the garment hanger mechanism and system in a travel bag, in an open, fully implemented travel closet configuration. As integrated, all recesses available for receiving hangers with garments clear the panel (wall) 43 (see FIGS. 87, 89 and 91).

FIGS. 92 to 101 illustrate an alternative garment hanger system for a shell-style travel bag. The garment hanger mechanism is as shown in FIGS. 45 to 70. The difference is in the manner in which the bag hanging means 20 is housed and integrated into a travel bag. As shown, the stem portion 31 of the bag hanging means 20 is housed in a channel formed by an extended encasement structure 110 positioned in tandem from the plate/bracket 8. Evident in these drawings is the L-shaped attachment system for the garment hanger mechanism 1 including mounting plates 94 and 8, where plate/bracket 8 abuts the slider rail 4 at 90° (degrees) to form a combined L-shaped structure at point 108. Screws, rivets, or bolts 109 are shown extending through the top 12 of the slider rail 4 able to engage with plate 94. Plate/bracket 8 is attached to moulded structure 91 for housing the bag hanging means 20.

In this variation of the moulded structure 91 there is no channel for securing the hook portion of the bag hanging means 20 since it is not articulated about its end for being stowed in travel mode. Instead the bag hanging means 20 is retracted in and out of the encasement structure for the stem 31 of the bag hanging means 20. When stowed, the hook portion of the bag hanging means is stowed in a pocket formed in the moulded structure 91.

Figure 103:
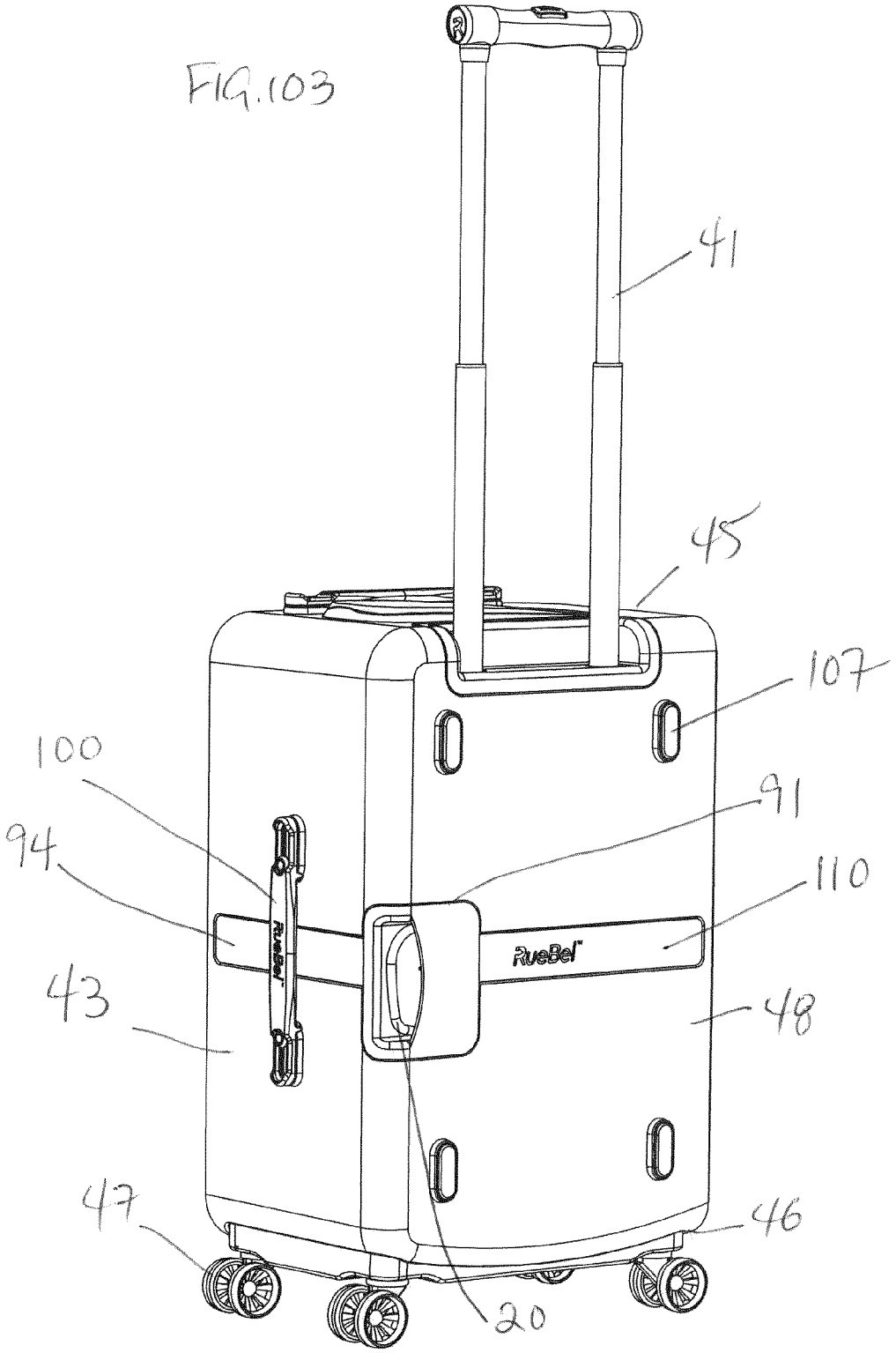
FIG. 103: An isometric view of another embodiment of the garment hanger mechanism/system (shown in FIGS. 98 to 100) integrated into a travel bag according to the present disclosure configured as a slider system with a trough shaped member portion (exterior view of bag, travel mode, closed).

FIG. 103 illustrates this alternative embodiment integrated into a travel bag showing the exterior of the bag in travel mode in an upright position with the handle 4 fully extended. The moulded structure 91 and encasement structure 110 for housing the bag hanging means 20 are integrated with the back panel (wall) 48 and plate 94 attaches slider rail 4 to panel (wall) 43. Additional bumper features 107 are also evident on the panel (wall) 48.

In still a further embodiment, the garment hanger system integrated into a travel bag as illustrated in FIGS. 102 and 104 provides a space saving and compact configuration for stowing and deploying the bag hanging means 20 and mechanism hanging means 6 (hooks). Both hooks are stowed in a compartment 111 built into panel (wall) 43 and can be stowed in the compartment 111 using the same securing means 112.

The disclosures of all patents, patent applications, publications and database entries referenced in this specification are hereby specifically incorporated by reference in their entirety to the same extent as if each such individual patent, patent application, publication and database entry were specifically and individually indicated to be incorporated by reference.

Although the invention has been described with reference to certain specific embodiments, various modifications thereof will be apparent to those skilled in the art without departing from the spirit and scope of the invention. All such modifications as would be apparent to one skilled in the art are intended to be included within the scope of the following claims.

What is claimed is:

1. A garment hanger mechanism for a multi-panel, foldable travel bag with first and second ends when unfolded and a substantially prismatic form when folded, the mechanism comprising:

a garment hanger member comprising first and second ends, wherein the first end of the garment hanger member is connected to a first side of a substantially rigid or semi-rigid structure integrated with a panel proximal to the first end of the travel bag, two side surfaces, a top surface, a bottom surface and a member portion with one or more recesses along its length for receiving clothes hangers;

a securing means configured to engage with and disengage from the member portion, and create an impediment over one or more recesses when engaged with the member portion, wherein the securing means is a support arm slider rail forming the top surface of the garment hanger member, the member portion is a hanger slider forming the bottom surface of the garment hanger member and the support arm slider rail and hanger slider slidably engage with one another to form the sides of the garment hanger member; and a mechanism hanging means operatively associated with the second end of the garment hanger member to hang the garment hanger member in a closet.

2. The garment hanger mechanism of claim 1, wherein the first end of the garment hanger member is connected to the substantially rigid or semi-rigid structure using a plate or bracket.

3. The garment hanger mechanism of claim 2, wherein the substantially rigid or semi-rigid structure is made of molded plastic configured to receive the plate or bracket.

4. The garment hanger mechanism of claim 1, wherein the garment hanger member is articulable about said first end from a packed position to an unpacked position.

5. The garment hanger mechanism of claim 1, wherein the mechanism hanging means is an articulable hook.

6. The garment hanger mechanism of claim 1, wherein the mechanism hanging means is used with a first bag hanging means connected to a second side of the substantially rigid or semi-rigid structure opposite the first side to, respectively, hang the garment hanger member and the travel bag in a closet.

7. The garment hanger mechanism of claim 6, wherein the first baq hanging means is an articulable hook.

8. A garment hanger system for a multi-panel, foldable travel bag with first and second ends when unfolded and a substantially prismatic form when folded, the system comprising:

a first bag hanging means, connected to a panel proximal to the first end of the travel bag;

a garment hanger member comprising first and second ends, wherein the first end of the garment hanger member is connected to a first side of a substantially rigid or semi-rigid structure integrated with a panel proximal to the first end of the travel bag, two side surfaces, a top surface, a bottom surface and a member portion with one or more recesses along its length for receiving clothes hangers;

a securing means configured to engage with and disengage from the member portion, and create an impediment over one or more recesses when engaged with the member portion, wherein the securing means is a support arm slider rail forming the top surface of the garment hanger member, the member portion is a hanger slider forming the bottom surface of the garment hanger member and the support arm slider rail and hanger slider slidably engage with one another to form the sides of the garment hanger member; and a mechanism hanging means operatively associated with the second end of the garment hanger member to hang the garment hanger member in a closet, wherein when the travel bag is unfolded, the first bag and mechanism hanging means can be used, respectively, to hang the travel bag and garment hanger member in a closet.

9. The garment hanger system of claim 8, wherein the first end of the garment hanger member is connected to the substantially rigid or semi-rigid structure using a plate or bracket.

10. The garment hanger system of claim 9, wherein the substantially rigid or semi-rigid structure is made of molded plastic configured to receive the plate or bracket.

11. The garment hanger system of claim 8, wherein the garment hanger member is articulable about said firstane end from a packed position to an unpacked position.

12. The garment hanger system of claim 8, wherein the mechanism hanging means is an articulable hook.

13. The garment hanger system of claim 8, wherein the first bag hanging means is connected to a second side of the substantially rigid or semi-rigid structure opposite the first side.

14. The garment hanger mechanism of claim 6, wherein the first bag hanging means can be stowed in the substantially rigid or semi-rigid structure.

15. The garment hanger system of claim 13, wherein the first bag hanging means can be stowed in the substantially rigid or semi-rigid structure.

16. The garment hanger system of claim 8, wherein the first bag hanging means is an articulable hook.

* * * * *